US006549745B2

(12) United States Patent
May et al.

(10) Patent No.: US 6,549,745 B2
(45) Date of Patent: Apr. 15, 2003

(54) METHOD AND APPARATUS FOR CONTROLLING OVERDRIVE IN A FRICTIONALLY DRIVEN SYSTEM INCLUDING A CONFORMABLE MEMBER

(75) Inventors: John W. May, Rochester, NY (US); David J. Quesnel, Pittsford, NY (US); Andreas Dickhoff, Kirchheim/Teck (DE); Donald S. Rimai, Webster, NY (US); Thomas N. Tombs, Brockport, NY (US)

(73) Assignee: NexPress Solutions LLC, Rochester, NY (US)

( * ) Notice: Subject to any disclaimer, the term of this patent is extended or adjusted under 35 U.S.C. 154(b) by 0 days.

(21) Appl. No.: 09/785,913

(22) Filed: Feb. 16, 2001

(65) Prior Publication Data

US 2002/0114650 A1 Aug. 22, 2002

(51) Int. Cl.[7] ..... G03G 15/01; G03G 15/20

(52) U.S. Cl. ..... 399/302; 399/313; 399/328

(58) Field of Search ..... 100/172, 176; 399/320, 328, 329, 330, 331, 297, 299, 302, 308, 307, 66; 219/216, 469

(56) References Cited

U.S. PATENT DOCUMENTS

| | | | | | |
|---|---|---|---|---|---|
| 2,126,705 | A | | 8/1938 | Schmidt | |
| 3,242,694 | A | | 3/1966 | Schmidt | |
| 3,566,781 | A | * | 3/1971 | Kunze | 100/160 |
| 3,705,489 | A | | 12/1972 | Smoltinger | 57/149 |
| 4,541,709 | A | * | 9/1985 | Kampschreur | 399/162 |
| 4,705,489 | A | | 11/1987 | Haarmann et al. | 464/69 |
| 4,735,541 | A | | 4/1988 | John | 414/431 |
| 5,140,379 | A | * | 8/1992 | Johnson | 399/297 |
| 5,269,222 | A | | 12/1993 | Johnson et al. | 101/228 |
| 5,283,621 | A | * | 2/1994 | Hashizume | 100/171 |
| 5,326,011 | A | | 7/1994 | Mager et al. | 226/181 |
| 5,378,302 | A | | 1/1995 | Meister | 156/497 |
| 5,390,010 | A | | 2/1995 | Yamahata et al. | 355/271 |
| 5,418,600 | A | * | 5/1995 | Genovese | 399/167 |
| 5,429,049 | A | | 7/1995 | Marozzi et al. | 102/228 |
| 5,505,401 | A | | 4/1996 | Lamothe | 242/412.2 |
| 5,522,785 | A | | 6/1996 | Kedl et al. | 492/21 |
| 5,542,353 | A | | 8/1996 | Cuir et al. | 101/492 |
| 5,617,134 | A | | 4/1997 | Lamothe | 347/264 |
| 5,630,583 | A | | 5/1997 | Yergenson | 271/119 |
| 5,799,232 | A | * | 8/1998 | Tompkins et al. | 399/167 |
| 5,835,835 | A | | 11/1998 | Nishikawa et al. | 399/328 |
| 5,899,603 | A | | 5/1999 | Markovics | 399/167 |
| 5,923,937 | A | * | 7/1999 | Thompson et al. | 399/302 |
| 5,946,525 | A | * | 8/1999 | Okamura et al. | 399/302 |

FOREIGN PATENT DOCUMENTS

| | | | | |
|---|---|---|---|---|
| EP | 0 413 941 A2 | | 2/1991 | G03G/15/20 |
| EP | 0 866 385 A2 | | 9/1998 | G03G/15/20 |
| EP | 1156393 A | * | 4/2001 | |
| JP | 04-233557 A | * | 8/1992 | G03G/15/01 |
| JP | 8-234584 | | 9/1996 | G03G/15/16 |

* cited by examiner

*Primary Examiner*—Robert Beatty

(57) ABSTRACT

Controlling image defects related to transfer or fusing of toner images in an electrostatographic machine, wherein engagement between an operational surface of a toner image bearing member or fusing member and an operational surface of another member forming a nip is adjusted using an engagement adjustment device in order to reduce or eliminate image defects relating to an overdrive or underdrive associated with the nip. The engagement adjustment device provides a preselected amount of overdrive or underdrive between a toner image bearing member or fusing member and a receiver member, which preselected amount includes zero.

39 Claims, 18 Drawing Sheets

METHOD AND APPARATUS FOR CONTROLLING OVERDRIVE IN A FRICTIONALLY DRIVEN SYSTEM INCLUDING A CONFORMABLE MEMBER

CROSS REFERENCE TO RELATED APPLICATION

This application is related to the following application filed on even date herewith:

U.S. patent application Ser. No. 09/785,853, filed Feb. 16, 2001, entitled METHOD AND APPARATUS FOR USING A CONFORMABLE MEMBER IN A FRICTIONAL DRIVE, in the names of Donald S. Rimai et al.

FIELD OF THE INVENTION

The invention relates generally to apparatus and methods for using frictional drives including conformable rollers in electrostatography, and more particularly to the use of frictional drives for transferring toner images in electrophotography.

BACKGROUND OF THE INVENTION

During the production of color images in an electrostatographic engine in general and in an electrophotographic engine in particular, latent images on photoconductive surfaces are developed by electrostatic attraction of triboelectrically charged colored marking toners. A latent image is created in a color electrophotographic engine by exposing a charged photoconductor (PC) using, for example, a laser beam or LED writer. Individual writing of each latent image must be properly timed so that the various toner images developed from the latent images can be transferred in registry. Each of these toner images corresponds to one of several color separations that will make up a final color image. The toned image separations must then be transferred, in register, to either a receiver or to an intermediate transfer member (ITM). The toner images can be transferred, either sequentially from a plurality of photoconductive elements to a common receiver in proper register, or transferred, sequentially, in proper register, to one or more ITMs from which all images are then transferred to a receiver. Alternately, each photoconductive surface may be associated with its own ITM, which transfers its toned image, in proper register with those of the other ITMs, to a receiver, for the purpose of enhancing the transfer efficiencies as described more fully in T. Tombs et al., U.S. Pat. No. 6,075,965. A toner image on the receiver is thermally fused in a fusing station, typically by passing the receiver through a pressure nip which includes a fuser roller and a pressure roller.

A key feature is that transfers must be performed in proper registry. The degree of misregistration that can be tolerated in an acceptable print depends on the image quality specifications. For high image quality color applications, allowable misregistration is typically less than 0.004 inch (0.1 mm) and preferably less than 0.001 inch (0.025 mm). Misregistration is often examined using 10× to 20× loupes to determine relative positions of interpenetrating fiducial line or rosette patterns. In systems involving elastomeric rollers and in particular in machines including compliant incompressible elastomeric rollers as intermediate transfer members as described by D. Rimai et al., U.S. Pat. No. 5,084,735, the rollers are known to deform as they roll under pressure against a photoconductive surface which may include a web or a drum. These intermediate transfer members also undergo deformations as they roll against receiver materials either as continuous webs or as cut sheets that can be supported by a web or by a backup roller assembly, or by combinations of these. Other prior art disclosing ITMs include U.S. Pat. Nos. 5,110,702; 5,187,526; 5,666,193 and 5,689,787.

Deformations of conformable members produce a phenomenon known as overdrive. Overdrive refers to the fact that in a nip including an elastomeric roller and a relatively rigid roller that roll without slipping, the surface speed of the rigid roller exceeds the surface speed of that portion of the elastomeric roller that is far from the nip. Far away from the nip means at a location where any distortions caused by the nip are negligible. The difference in peripheral speeds far from the nip is a result of the strains occurring in the elastomeric roller surface as it approaches and enters the nip.

The concept of overdrive may be better understood by referring to the sketches in FIGS. 1 and 2.

In FIG. 1*a*, a rigid cylindrical wheel or roller is driven without overdrive. In such an example, each point on the periphery has a velocity $v_0$ given by the product of the angular velocity $\omega$ and the radius r of the roller, i.e., $v_0=\omega r$.

In FIG. 1*b*, a deformable externally driven roller is illustrated. The deformation illustration is exaggerated to facilitate explanation of the concept that when a substantially incompressible compliant member is in a transfer nip, for example, a deformation will occur that causes the radius to be smaller in the nip area but to bulge out at pre-nip and post-nip areas. The dotted line shows the original circular rigid case of FIG. 1*a* for comparison. The relationship of $v_0=\omega r$ still holds true for points on the roller far from the nip area where there is no deformation. However, this relationship is not true for the points in the pre-nip, nip and post-nip areas. For the roller illustrated in FIG. 1*b* the speed of a point in the nip area has a higher magnitude than that far from the nip. The speed ratio of the roller surface in the nip divided by the speed at a point far from the nip area characterizes overdrive.

More particularly consider, for example, a conformable roller having an externally driven axle, frictionally driving with negligible drag a movable planar element having a nondeformable surface. If the external radius of the roller far from the nip is r and the peripheral speed of the roller far from the nip is $v_0$, then the surface velocity $V_{nip}$ of the distorted portion of the roller in nonslip contact with the planar surface is given by $$v_{nip}=\lambda\omega r$$

where $\lambda$ is a speed ratio defined by $$\lambda=(v_{nip}/v_0).$$

As defined here, overdrive (or underdrive) is numerically equal to the absolute value of the speed ratio minus one. The value of $\lambda$ is determined principally by an effective Poisson's ratio of the roller materials, such as produced by a roller including one or more layers of different materials, and secondarily, by the deformation geometry of the nip produced by the engagement. The Poisson ratios of high polymers, including elastomeric polymers which for practical purposes are almost incompressible, approach 0.5. The Poisson ratios for highly compressible soft polymeric foams approach zero. It has been shown by K. D. Stack, "Nonlinear Finite Element Model of Axial Variation in Nip Mechanics with Application to Conical Rollers" (Ph.D. Thesis, University of Rochester, Rochester, N.Y. (1995), FIGS. 5–6 and 5–7, pages 81 and 83) that the value of Poisson's ratio for $\lambda=1$ is about 0.3 for a roller driving a rigid planar element. For values of Poisson's ratio larger than about 0.3, the circumference of the roller distorted by the nip is greater than $2\pi r$, producing overdrive of the planar element with respect to the roller, i.e., the surface speed $v_{nip}$ of the distorted portion of the elastomeric roller within the nip and hence that of the planar element is greater than $v_0$ (i.e., $\lambda>1$). For values of Poisson's ratio smaller than about 0.3, the circumference of the elastomeric roller distorted by the nip is less than $2\pi r$, producing underdrive of the planar element with respect to the roller, i.e., the surface speed $v_{nip}$ within the nip is smaller than $v_0$ (i.e., $\lambda<1$). Conversely, if a nondeformable planar element frictionally drives, with negligible drag, a roller having a Poisson ratio less than about 0.3 and causes it to rotate, one may speak of overdrive of the roller with respect to the planar element because the surface speed of the driven roller far from the nip is faster than the speed of the planar element.

With reference to FIG. 2*b*, when a roller transfer member formed of an elastomer that has a Poisson ratio of about 0.45 to about 0.5 is driving a rigid planar element that is moving through a nip and there is no slippage between the roller and the rigid element, the rigid element will be overdriven relative to the speed of the roller far from the nip. Where the roller is formed of a compressible material (i.e., experiences relatively large volume reduction upon compression), such as a foam, the distortion of the roller may be such (see FIG. 2*a*) that the surface of the roller is contracted rather than stretched. Compare FIG. 2*a* with the example of the elastomeric roller of FIG. 2*b* having little or no volume change upon compression, with each roller shown in driving engagement with a rigid planar element. In the example of the highly compressible roller (relatively large volume change upon compression) of FIG. 2*a*, the rigid planar element such as a recording sheet may be subject to an underdrive condition.

For purpose of further illustration, FIG. 2*c* illustrates an exemplary apparatus, indicated by the numeral 5, which includes two counter-rotating rollers 1 and 2 forming a pressure nip 3. Far away from the nip, rollers 1 and 2 have peripheral speeds $v_1$ and $v_2$ respectively. Roller 2 is hard, and roller 1 is conformable, with roller 1 having a strained volume portion sketched by a cross-hatched region 4 in the vicinity of the nip (deformation of the surface of roller 1 is not depicted). Hereinafter, the terms "hard" and "nonconformable" are used interchangeably, and refer to materials for which the Young's modulus is greater than or equal to 100 MPa. Consider that one of the axles P or Q is caused to rotate by the action of an external agent, such as for example a motor, and the other axle is rotated by nonslip friction in the nip. The externally rotated roller is a driving roller, while the other is a (frictionally) driven roller. There are four extreme cases to consider. Case 1: roller 1 is the driving roller, and region 4 is a substantially incompressible elastomer, whereupon as explained above the peripheral velocity $v_2$ of roller 2 far from the nip is greater than the peripheral velocity $v_1$ of roller 1 far from the nip, and roller 2 is said to be overdriven. Case 2: the same materials as Case 1, except that roller 2 is the driving roller and roller 1 is the driven roller, whereupon roller 1 is said to be underdriven. Case 3: roller is the driving roller, and region 4 is a compressible resilient foam, whereupon the peripheral velocity $v_2$ of roller 2 far from the nip is smaller than the peripheral velocity $v_1$ of roller 1 far from the nip, and roller 2 is said to be underdriven. Case 4: the same materials as case 3, except that roller 2 is the driving roller and roller 1 is the driven roller, whereupon roller 1 is said to be overdriven. It should be noted that it is common practice to use the term "overdrive" in a generic or nonspecific fashion where either overdrive or underdrive technically exists.

It may be understood that to produce a frictional drive involving a conformable roller, there is a "lockdown" portion within the contact zone of the nip where there is substantially no slippage between the driving and driven members. Moreover, during the continual formation and relaxation of the pre-nip and post-nip bulges or deformations on the conformable roller as it rotates through the nip, there may also be locations in the contact zone of the nip where the surface velocities of the two surfaces in contact differ, i.e., there may be localized slippages. Such localized slippages may occur just after entry (i.e., before lockdown occurs) and just before exit of a transfer nip (i.e., after lockdown ceases). These pre-lockdown and post-lockdown slippages, if they happen, take place over distances which are small compared to the nip width, and occur in opposite directions inasmuch as they are related to the formation and relaxation of the pre-nip and post-nip deformations, respectively. In order to avoid confusion below, a frictional drive is hereinafter defined as being nonslip if a region exists in the nip (i.e., the lockdown region) wherein the coefficient of friction is sufficiently large to provide a continuous frictional driving linkage between the contacting members within the nip. This definition excludes any localized slippages that may occur in the contact areas near the entry and exit of the nip, because these localized slippages are in opposite directions and any effects on the drive produced by them effectively cancel. In other words, the frictional linkage in the "lockdown" portion is the only factor of importance in determining a driving connection produced by the nip. Hereafter, the words "nonslip", "slip" and "slippage" refer to an externally measured behavior of the members involved in the frictional drive, e.g., as described below in the specification of the present invention.

Two materials in contact in a pressure nip may have different thicknesses or different Poisson ratios, so that overdrive at their interface can cause squirming and undesirable stick-slip behavior. For example, when roller transfer members are used to make a color print, such behavior can adversely affect the final image quality, e.g., by causing toner smear or by degrading the mutual registration of color separation images. Moreover, variations in overdrive, which are referred to herein as "differential overdrive" can occur along the length of a pressure nip, such variations being caused, for example, by local changes in engagement, such as produced by runout, or by a lack of parallelism, or by variations of dimensions of the members forming a pressure nip, such as for example out-of-round rollers. A differential overdrive caused by runout, such as produced by a roller having a radius as measured from the axis of rotation that varies around the roller circumference, results in a speed ratio that fluctuates as the roller rotates.

Herein, the term engagement, in reference to a pressure nip formed between two members having operational surfaces, is defined as a nominal total distance the two members are moved towards one another to form the nip, starting from an initial undeformed, barely touching or nominal contact of the operational surfaces. In FIGS. 1*a* and 1*b*, for example, the engagement is the distance the axis of rotation of the roller is moved towards the rigid planar element from a nominal initial kissing position. In an example of two parallel rollers, the engagement is an initial separation of the two axes of rotation (defined by a nominal initial kissing position with neither roller distorted) minus the actual separation of the axes after the nip is formed.

During transfer of a toner image in an elastomeric nip exhibiting overdrive or underdrive, an image experiences a length change in the process direction. This change in length causes a distortion in the final image that is objectionable. Change in the writing speed of an electrostatic latent image can correct for overdrive in a simple single-color engine. In a color electrophotographic engine, however, high quality color separations preferably are properly registered to a spatial accuracy comparable with the resolution of the image. In a color electrophotographic engine including a plurality of color stations, proper registration can be achieved by having each color station behave exactly in the same manner with respect to image distortion, e.g. by using rollers made as identical as possible to each other. However, this is expensive and impractical.

Specifically, in order to produce proper electrophotographic images using techniques of the prior art, properties of rollers must not vary outside predetermined acceptable tolerances. The properties include acceptable runout, reproducible and uniform resistivity and dielectric properties, uniform layer thicknesses, parallelism of the members, and responses of the rollers to changes in temperature and humidity experienced during routine operation and machine warm-up. Rollers must also maintain their properties within tolerances during wear processes so that adverse effects are not experienced on the final images as a result of wear. If the effects of wear cannot be compensated, the components must be replaced.

A roller may have variations in the location of the roller surface relative to the roller center as a function of angle during rotation that is commonly known as "runout". Runout may be caused by out of round rollers or by improper centering of an otherwise round roller or both. Runout may vary along the length of a roller. Since the magnitude of the overdrive produced by a deformable roller depends on engagement, runout will temporally and spatially modify the engagement and overdrive during the production of a single image, producing distortions that are objectionable. Runouts of 0.001 inch (0.025 mm) can produce unacceptable registration problems, with runouts of less than 0.0002 inch (0.05 mm) needed to achieve acceptable registration based on measured sensitivity of overdrive to engagement.

Further, rollers used in these applications are made from polymers that can change dimension by absorption of moisture and can change dimensions due to temperature changes. These dimensional changes further complicate the registration of color separations if the changes are not the same in each of the color separation stations included in a color electrostatographic engine.

Methods based on the prior art to produce a workable electrophotographic engine with useful image quality require very expensive manufacturing processes to control the properties and dimensions of the elastomeric rollers.

What is needed is a method to alleviate or effectively eliminate image distortion caused by overdrive or underdrive phenomena. While this can be performed by expensive algorithms to the writing scheme using sensors to detect surface speeds of elements during writing and transfer, a much more cost-effective method is desired.

There are several disclosures in the prior art that relate to the peripheral speeds of rollers. T. Miyamoto et al., "Image Forming Apparatus with Peripheral Speed Difference Between Image Bearing and Transfer Members", U.S. Pat. No. 5,519,475 have mentioned this explicitly in their title but the entire disclosure of this patent is about the roughness characteristics of elastomeric surfaces. U.S. Pat. No. 5,519,479 teaches the use of peripheral speed differences between a photoconductive member and an intermediate transfer member (ITM) to reduce the apparent roughness of the surface. The patent notes transfers from the photoconductive members to transfer intermediates where there is a peripheral speed difference of 0.5% to 3%. Another patent, K. Tanigawa et al., "Image-Forming Apparatus with Intermediate Transfer Member", U.S. Pat. No. 5,438,398 also includes disclosure relating to peripheral speeds. In particular, embodiments 6 & 7 suggest that an intentional peripheral speed difference of 1% helps with "central dropout" defects. The patent notes that transfers of images are intentionally provided with differences in peripheral speeds but no description is provided relative to overdrive or underdrive as described herein. Another reference is M. Yamahata et al., "Drive Mechanism for an Electrophotographic Apparatus for Ensuring Equal Rotational Speeds of Intermediate Transfer Devices and Photosensitive Devices", U.S. Pat. No. 5,390,010. This reference specifically addresses the behavior of web photoconductors (PCs) and web ITMs with the central idea to use the same drive motor to drive an intermediate transfer web drive roller which in turn drives the web drive roller of a photoconductive web. Thus, disturbances in surface speed of the ITM web, such as might be caused by engagement of a cleaning station, etc., would be transmitted to the PC web so that there would not be image degradation due to slippage. Yamahata et al. do not discuss how this would affect the writing of an image. There is no disclosure in this patent of transfers where a nip is formed by an elastomeric member and the problems of overdrive or underdrive as it affects image registration. It is clear that this reference addresses the problem of slippage of the ITM relative to the PC when such slippage is caused by disturbances of the system.

U.S. Pat. No. 5,790,930 discloses a means for correcting for misregistration between an image-carrying member and an intermediate transfer web due to variations in the length of the two members. It accomplishes this by means of forcing a periodicity in the drive speeds. It can achieve this by means of either two motors or a single motor.

U.S. Pat. No. 5,376,999 discloses a method of correcting for speed mismatches between a photoconducting element and an intermediate transfer web due to the stretching of that web arising from the tension applied to that web. The strains described in this patent occur outside the nip. The patent discloses allowing one member to slip with respect to the other where both members are driven. There is no discussion of an elastomeric intermediate transfer member in this patent. In an elastomeric intermediate transfer member, the distortions occur due to the presence of stresses applied normally to the surface of the elastomeric member in the nip rather than due to stresses applied parallel to the surface of the elastomeric member.

U.S. Pat. No. 5,966,559 discloses a method and apparatus for adjusting a transfer nip between a toner image bearing member and a transfer backup roller in order to accommodate receiver stocks having different thicknesses. A sensor senses a parameter related to the thickness of a receiver member prior to movement of the receiver into the transfer nip and an adjustment device adjusts the nip spacing in order to reduce or eliminate an impact of the receiver entering the nip. This patent does not teach the use of the adjustment device to control engagement in the transfer nip.

In electrostatography in general and, more particularly in electrophotography, the elimination of overdrive or underdrive in a conformable nip is desirable because overdrive and variations in overdrive can cause image defects such as misregistration of color separation images objectionable to the customer. There is a need to provide simple, inexpensive means to control or eliminate overdrive related registration artifacts.

SUMMARY OF THE INVENTION

The invention includes a method and apparatus to control image defects related to transfer of toner images in an electrostatographic machine, including defects such as misregistration associated with overdrive or underdrive and variations in overdrive and underdrive in a transfer station including a toner image bearing member. Specifically, an engagement between an operational surface of a conformable toner image bearing member and an operational surface of another member forming a transfer nip is adjusted using an engagement adjustment device to control an overdrive or underdrive associated with the nip. In one aspect of the invention, a transfer nip for transferring a toner image includes two rollers supported by parallel shafts coaxial with each roller, the shafts separated by a controllable distance of separation and the engagement in the nip being controllably adjustable by an engagement adjustment device to increase or decrease the distance of separation. In another aspect of the invention, a transfer system includes a first transfer nip formed by a primary image forming member roller having a coaxial supporting first shaft and an intermediate transfer member roller having a coaxial supporting second shaft separated from the first shaft by a first controllable distance of separation, and a second transfer nip formed by the intermediate transfer roller and a transfer backup roller, the transfer backup roller having a coaxial supporting third shaft separated from the second shaft by a second controllable distance of separation, wherein the engagement in each of the first and second transfer nips is separately and controllably adjustable by an engagement adjustment device to respectively increase or decrease the distance of separation between the first and second shafts and the distance of separation between the second and third shafts. Preferably, an engagement adjustment device used according to the present invention in a toner transfer station provides a preselected amount of overdrive or underdrive between a toner image forming member and a receiver member to which a toner image is transferred. A transfer system according to the present invention may have a steady state controlled overdrive or underdrive, including the possibility of zero overdrive.

In yet another aspect of the invention, an engagement adjustment device is employed to control an overdrive or an underdrive in a fusing station of an electrostatographic machine.

BRIEF DESCRIPTION OF THE DRAWINGS

In the detailed description of the preferred embodiments of the invention presented below, reference is made to the accompanying drawings, in some of which the relative relationships of the various components are illustrated, it being understood that orientation of the apparatus may be modified. For clarity of understanding of the drawings, the illustrated relative dimensions of elements of the embodiments of the invention may be exaggerated.

DETAILED DESCRIPTION OF THE PREFERRED EMBODIMENTS

Figure 1A:
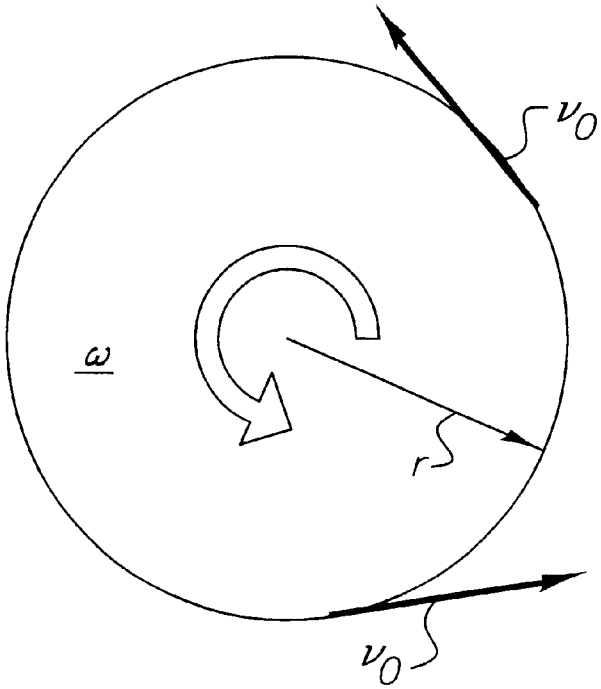
FIG. 1*a* is a schematic illustration of a rigid rotating roller.
Figure 1B:
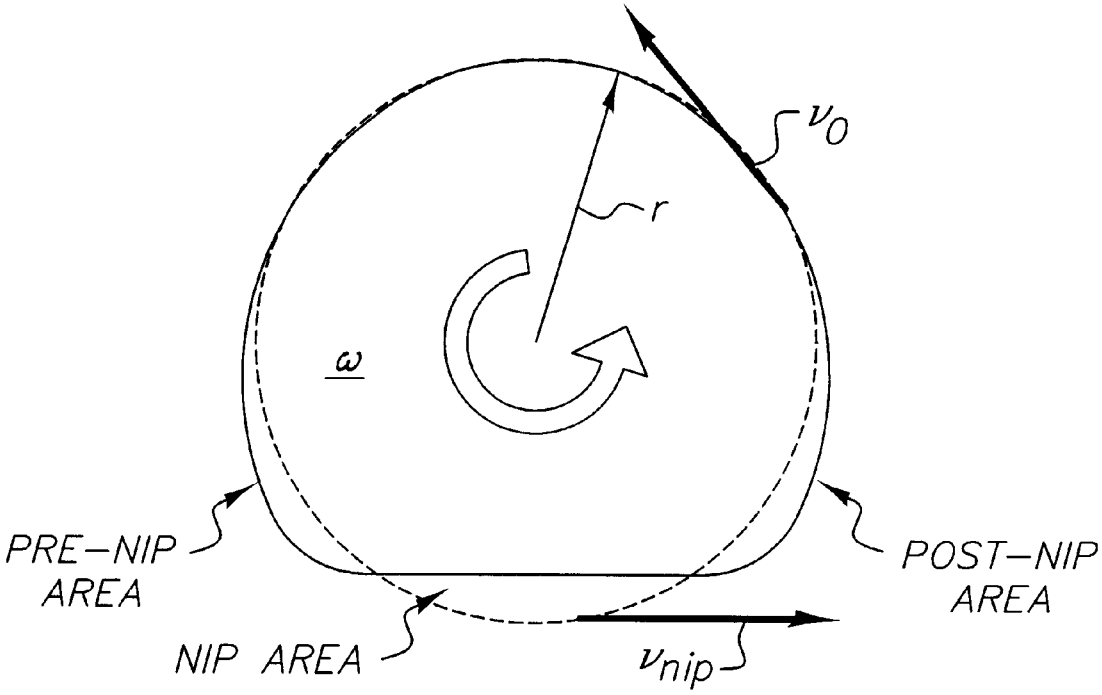
FIG. 1*b* is a schematic of an elastomeric rotating roller that is deformed when forming a nip (exaggerated deformation shown)

This invention discloses a general scheme for use in an electrostatographic machine, e.g., an electrophotographic reproduction device, to compensate for or accurately control an overdrive or underdrive that occurs when cylindrically symmetric conformable rollers, e.g., elastomeric rollers, are made to roll against surfaces that cause them to deform, thereby inducing strains in their surfaces. A difference in surface speeds resulting from overdrive or underdrive in a pressure nip is a result of strains occurring in a conformable roller surface as it approaches and enters the nip. In addition to strains produced by formation of the nip, external drag forces and external drag torques transmitted through a nip also cause strains in the surface of a conformable roller and thereby contribute to an observed magnitude of overdrive or underdrive. Since the magnitude of an overdrive or underdrive increases as the engagement between a conformable member and another member is increased, the overdrive or underdrive may be increased or decreased as the engagement is increased or decreased, respectively. Generally, the subject invention controls or eliminates overdrive or underdrive by providing a means for controllably and accurately adjusting one or more engagements between operational surfaces of moving members forming pressure nips with one another in a frictional drive. The invention may be used with pressure nips formed by rotatable members including rollers or webs, and a web may be included within a nip. The rotatable elements of the subject invention are shown as both rollers and webs in the examples of this description but may also include drums, wheels, rings, cylinders, belts, segmented platens, platen-like surfaces, and receiver members including receiver members moving through nips or adhered to drums or transport belts. As applied for example to a system of frictionally driven rollers included in a station for transferring a toner image from a toner image bearing member to another member, the invention provides controllable adjustments of the individual engagements between pairs of rollers, the adjustments being provided separately or simultaneously. More generally, the invention may be used in an electrostatographic machine for any system of frictionally driven rotatable elements in mutual nonslip engagements with one another, the rotations of which are produced by a pre-specified element which is a driving member. The driving member may be a roller, a web or other suitable member in frictional driving relation to one or more of the driven elements.

The application of suitable adjustments of engagement between a conformable member and another member can control overdrive or underdrive to acceptable or predetermined levels, or eliminate it. The adjustments of engagement can be applied to one or more members of a frictional drive train by an engagement adjustment device. An engagement adjustment device (EAD) is any mechanism known in the art for increasing or decreasing an engagement between rollers or between a roller and a web. An engagement adjustment device may include screws, cams, differential screws, gears, levers, ratchets, wedges, springs, tensioning members, motors, actuators, piezoelectrics, hydraulics, pneumatics, and the like. The magnitudes of the adjustments may be set manually or through an automatic system such as a servo system designed to directly control the overdrive or underdrive to specific values. The adjustments may be provided to control one or more individual nips, or the adjustments may be provided to control a net overdrive (or underdrive) measurable between any pair of members forming a succession of nips. Sensors may be used in such servo systems to assess the value of the adjustment(s) needed and so change the engagement(s) by the appropriate prime mover(s) through a feedback loop.

Although the various transfer embodiments will be described with reference to conformable and preferably compliant elastomeric intermediate transfer rollers and more generally to conformable intermediate transfer members (roller or belt), it will be appreciated that the electrostatographic primary image forming member may be made in the form of a compliant elastomeric roller and a toner image formed thereon transferred directly to a receiver sheet that is supported on a platen or a preferably non-compliant transfer roller while being driven through the transfer nip. More generally, an electrostatographic primary image forming member may be a conformable roller or a non-conformable (hard) roller, and the platen or transfer roller may have any amount of compliancy when used for direct transfer of a toner image from a primary imaging member to a receiver sheet.

Figure 3A:
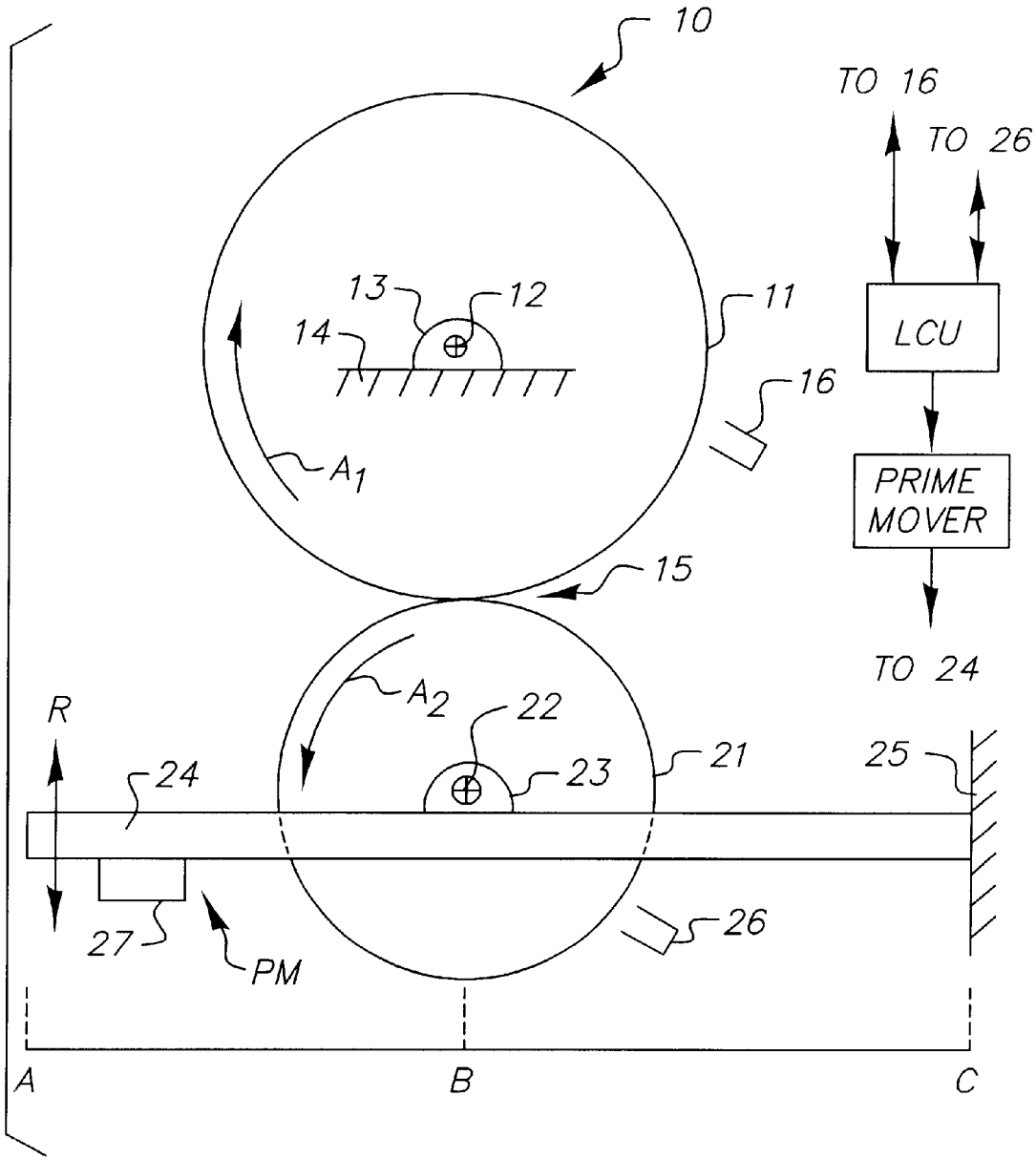
FIG. 3*a* is a schematic side elevational view of an embodiment of the invention including two rollers of which at least one is conformable.

FIG. 3*a* illustrates a generalized embodiment of the invention, designated as 10, including a rotating conformable roller 11 of an electrostatographic machine forming a pressure nip 15 with a counter-rotating roller 21. Roller 21 may be a hard roller or may have conformability. Apparatus 10 may be included in a toner transfer station as is well known in the art in which nip 15 is a transfer nip, roller 11 is a conformable toner image bearing member and roller 21 is a transfer backup roller biased with a voltage from a power supply (not shown) to induce electrostatic transfer of a toner image, the conformable toner image bearing member being one of the following: an electrographic primary imaging roller or an electrophotographic primary imaging roller such as disclosed for example in U.S. Pat. Nos. 5,715,505, 5,828,931 and 5,732,311, or an intermediate transfer member. Alternatively, apparatus 10 may be included in a toner fusing station in which nip 15 is a fusing nip and a toner image is fused to a receiver member (not shown) passing through the nip, roller 11 being a heated fuser roller and roller 21 a pressure roller as is well known in the art. Apparatus 10 is useful for precisely controlling an overdrive or underdrive produced in nip 15.

Conformable roller 11 rotates in a direction $A_1$ on a coaxial shaft 12 projecting from each end of roller 11. Shaft 12 is supported by bearings 13 secured to frame portions 14 of the electrostatographic machine. Roller 21 rotates in a direction $A_2$ on a coaxial shaft 22 projecting from each end of roller 21, shaft 22 being parallel to shaft 12 and supported by bearings 23. One of the rollers 11 and 21 is frictionally driven by the other in a nonslip condition of engagement in nip 15. Either of the rollers may be rotated by a frictional contact with an external member (not shown), or may be drivingly rotated by a motor connected, e.g., by a gearing connection, to either of shafts 12 and 22 (motor and gearing connection not shown). Generally, the frictional drive in nip 15 produces an underdrive or an overdrive. For example, if a conformal roller 11 is made of a relatively incompressible elastomeric material and frictionally drives a roller 21 which is relatively hard, roller 21 will be overdriven as explained previously above. An engagement adjustment device (EAD) is provided for controlling the amount of overdrive, e.g., by controlling the speed ratio (see above) to a preferably predetermined value. A preferred EAD includes two parallel lever arms 24, each lever arm supporting a bearing 23 (one lever arm 24 and one bearing 23 are shown). Lever arms 44 are preferably straight although any suitable shape may be employed as is suitable. Lever arms 24 are fixedly secured to rigid frame portions 25 of the electrostatographic machine (one frame portion 25 is shown). It is preferred that bearings 23 and lever arms 24 are attached to one another. An engagement in the nip 15 is adjusted by cooperatively moving lever arms 24 simultaneously up, or simultaneously down, while maintaining parallelism between shafts 12 and 22 (thereby respectively increasing, or reducing, engagement). A prime mover (PM) is provided to move lever arms 24, the prime mover 27 being applied preferably near to the free ends of the lever arms for maximum mechanical advantage, as indicated by the double-ended arrow labeled R. The prime mover (not illustrated in detail) may for example include a piezoelectric actuator, a screw moving for example through a fixed plate, a cam mounted on an axle parallel to shafts 12 and 22, or any other suitable device for controlling the position of the lever arms. Movements of a prime mover may be accomplished by appropriate mechanical coupling to a suitable drive mechanism, either via a manually activated drive or via a motor drive, or by electrical signals, e.g., to a piezoelectric actuator. The lever arms 24 are preferably rigid and are preferably moved independently by a separate prime mover acting on each lever arm, in which case the lever arms may also serve for adjusting parallelism between shafts 12 and 22. Alternatively, the lever arms 24 may be yoked together and acted upon by one prime mover. The frame portions to which lever arms 24 are secured, e.g., frame portion 25, are preferably sufficiently strong such that negligible strain is produced in the frame portions or in the junctions between the lever arms and the frame portions when the lever arms are moved by the prime mover. Similarly, frame portion supporting bearing 13 is sufficiently strong so that negligible strain is produced when lever arms 24 are moved. It will be appreciated that very small changes of engagement may be achieved for relatively small motions provided by the prime mover(s). For example, in FIG. 3*a* let the point B be located on an extension of an imaginary line through the centers of shafts 12 and 22, the point B also being located on a straight line ABC perpendicular to the extension at B, the distance AC being the same as the length of a lever arm 24. If point A moves up a very small distance, say Δ, the distance between shafts 12 and 22 will be decreased by an amount equal to (BC/AC)Δ, and if, for example AC=3BC, an engagement may consequently be readily increased by an amount Δ/3. Typically, changes of engagement required to be produced by the apparatus 10 are less than about ±0.003 inches or less, and if AC=3BC it may be seen that the corresponding motions of the free end of lever arm 24 along arc R will be about ±0.009 inches or less. Generally, the range of movements along arc R depends on the mechanical advantage of the lever arms 24. A screw mechanism such as a differential screw may for example be used to provide accurate, repeatable precision movements of lever arms 44. Alternatively, a cam having for example a slightly ellipsoidal shape, i.e., of low eccentricity, may be used to provide the motions indicated by the double ended arrow R. As a mechanically equivalent alternative to using lever arms 24 for moving roller 21 against the fixed axis roller 11 as shown in FIG. 3*a*, the axis of roller 21 may instead be the fixed axis and lever arms similarly used to move conformable roller 11 to alter the engagement (not illustrated). Although levers 24 may be included in a preferred engagement adjustment device for adjusting an engagement between a conformable roller and another roller, e.g., such as shown in FIG. 3*a*, the invention includes any suitable means for controllably adjusting the engagement to provide a predetermined speed ratio, e.g., between rollers 11 and 21.

A logic and control unit (LCU) may be employed to control the motion of the prime mover(s) of an engagement adjustment device (EAD) used to control the engagement in nip 15. For example, the LCU sends signals to prime mover(s) to actuate lever arms 24, e.g., through a feedback loop using for example sensors 16 and 26 to sense the movement of fiducial marks placed for example on the outer surfaces of rollers 11 and 21, respectively. The sensors send signals to the LCU and from the LCU other signals are sent to actuate the prime mover(s) and ultimately the lever arms 24. The fiducial marks are preferably in the form of identically spaced parallel fine lines or bars. These lines or bars are preferably perpendicular to the direction of rotation of the rollers, and preferably have a predetermined center-to center distance which is known precisely. The fiducial marks may be included as permanent markings of, or in, the outer layers of rollers 11 and 21 and may be placed for example near one edge of each of the rollers, i.e., outside of the toner image area of a toner transfer station (or the image fusing area of a toner fusing station). Alternatively, fiducial marks such as in the form of fine lines or rulings may be provided on wheels secured coaxially to shafts 12 and 22. It will be evident that the movement of the fine markings or rulings past the sensor may be interpreted by the LCU as an angular velocity, whereupon if the outer radius of the ITR is known with precision, the surface speed of a roller may be calculated as the product of this radius multiplied by the measured angular velocity.

In an apparatus 10 including roller 11 as an electrostatographic toner image bearing member, e.g., a primary image forming member or an intermediate transfer member, the fiducial marks on the surface of the roller may be provided in the form of a toner test image, such as for example an electrophotographically created set of parallel equi-spaced toned bars or lines formed perpendicular to the direction of rotation of roller 11. These toned bars or lines on the surface of roller 11 are preferably formed at a known spatial frequency, i.e., the number of bars or lines written per unit length is, say, equal to f and is stored in the LCU. The toner test image is transferred via nip 15 to a receiver (not shown), and the receiver may be a test sheet used specifically for adjusting overdrive or underdrive. The receiver may be adhered to roller 21 and sensor 26 used to measure a frequency, say f', of passage of the toned bars or lines on the receiver past the sensor, and this frequency is sent to the LCU. Generally, as a result of overdrive or underdrive in nip 15, f and f' will not be the same. An adjustment of engagement is provided via lever arms 24 such that a difference (f−f') between the frequencies f and f' is made equal to an operational or a predetermined value stored in the LCU. This operational or predetermined value corresponds to an operational or predetermined speed ratio of the peripheral speeds of rollers 11 and 21 far from nip 15. Alternatively, the test sheet may not be adhered to roller 21 after passage through the nip 15, and a sensor (not shown) may be used to measure a spatial frequency f" on a portion of the surface of the test sheet receiver carrying a transferred toner bar test image after that portion has passed through nip. A difference (f−f") is made equal to an operational or a predetermined value by the EAD. Inasmuch as embodiment 10 includes only two rollers, it is generally not possible using an EAD to eliminate overdrive (or underdrive) unless substantial drag forces or torques are present, such drag forces or torques being inherent to the system or applied by external mechanical means. As a result of controlling overdrive (or underdrive) to an operational or a predetermined level using the EAD, a toner image which is transferred, e.g., to a receiver in nip 15 from a conformable toner image bearing roller 11 has a predictable distortion which may be eliminated or compensated for when creating the toner image on roller 11, e.g., by means of a programmable digital laser image writer as is well known. In a color electrostatographic machine that includes a plurality of similar individual color stations, each station may be used to make a similar set of short bars or lines, e.g., on a test receiver, with each set being preferably displaced, e.g., in a direction parallel to the axis of shaft 12, so that no set overlaps another, and a similar frequency measuring procedure is used in each station. When all stations have adjusted the respective engagements by suitable EADs applied separately in each station so that the speed ratios are the same in all stations, it will be evident that a full color image made immediately subsequent to the test sheet passing through the machine will be in good registration. A test sheet may be utilized at any convenient time, e.g., between runs. Thereby, changes in dimensions of rollers or other members due to wear, aging, temperature changes and so forth may be compensated for in a simple way without the need for complicated adjustments to the individual image writers.

Preferably, the prime mover 27 is a piezoelectric actuator applied to each of lever arms 24, each piezoelectric actuator supported or attached to a rigid frame portion of the electrostatographic machine, with actuation provided by a voltage to the actuator from a programmable power supply as controlled by the LCU (piezoelectric actuator support not illustrated). In order to compensate in real time for differential overdrive associated for example with slightly out-of-round precision rollers 11 and 21 for which the runout is for example typically of the order of 0.001 inch or less, an AC voltage signal may be applied to the piezoelectric actuators in order to dampen or null out fluctuations of engagement, i.e., fluctuations from a nominal or mean value of engagement associated with differential overdrive in nip 15, thereby producing a speed ratio between rollers 11 and 21 which has a much reduced or a negligible variation over short periods of time, e.g., on a time scale of revolution of one of the rollers. A frequency of the required AC voltage signal is typically of the order of less than about 100 Hz, and the piezoelectric actuators are provided with a correspondingly suitable frequency of response as may be necessary. It may be useful to employ an auxiliary device such as for example a piezoelectric sensor or a transducer to sense mechanical displacements or pressure changes associated with differential overdrive caused by runout. Fluctuating displacements or pressure changes in nip 15 are converted by the auxiliary device to a time varying voltage signal which is sent to the LCU and thereby used, in feedback mode, to actuate nulling or damping response movements to be applied to lever arms 24 by the piezoelectric activators so as to smooth out speed ratio fluctuations associated with the runout. The auxiliary sensor may be conveniently located, for example, between one of the bearings 23 and a corresponding lever arm 24, i.e., sandwiched between them such that a sensing area of the piezoelectric sensor abuts the bearing, the sensor securely attached to both bearing 23 and the lever arm 24 (piezoelectric sensor not illustrated).

Figure 3B:
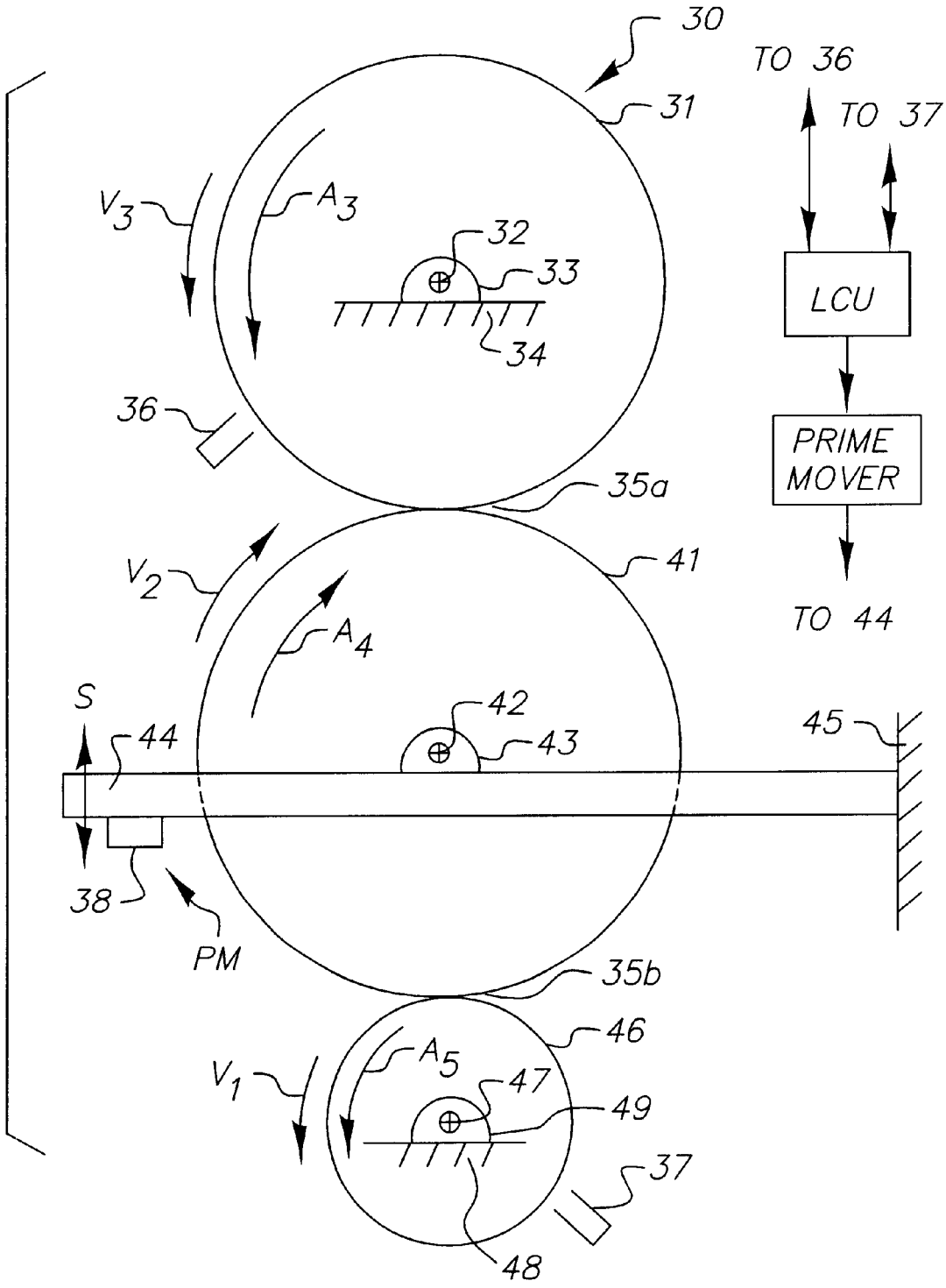
FIG. 3*b* is a schematic side elevational view of another embodiment of the invention including three rollers of which at least one is conformable.
Figure 8:
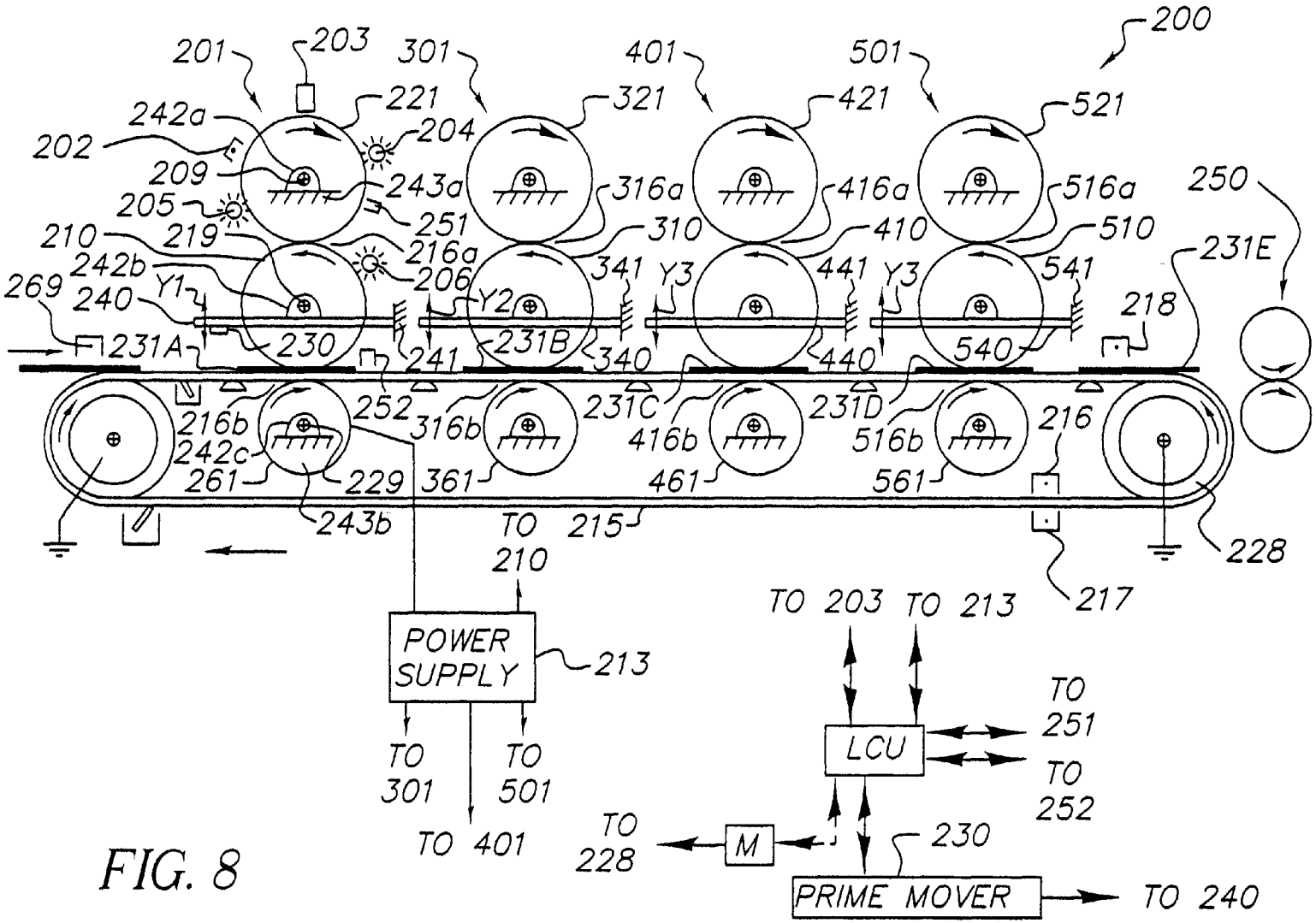
FIG. 8 is a schematic side elevational view of yet another embodiment of the invention.

FIG. 3*b* illustrates another embodiment of the invention, indicated as 30, for transferring a toner image in an electrostatographic machine. Apparatus 30 includes a primary image forming member (PIFM) roller 31 forming a first transfer nip 35*a* with a conformable intermediate transfer roller (ITR) 41, and a transfer backup roller 46 forming a second transfer nip 35*b* with ITR 41. Typically, rollers 31 and 46 are relatively nonconformable or hard. However, in some applications one or both of rollers 31 and 46 may have conformability. PIFM 31 is shown rotating in a direction $A_3$ and is provided with a coaxial shaft 32 projecting from each end of roller 31. Shaft 32 is supported at each end by bearings 33 secured to frame portions 34 of the electrostatographic machine. Roller 41 is shown rotating in a direction $A_4$ on a coaxial shaft 42 projecting from each end of roller 41, shaft 42 being parallel to shaft 32 and supported by bearings 43. One of the rollers 31 and 41 is frictionally driven by the other in a nonslip condition of engagement in the first transfer nip 35*a*. Roller 46 is shown rotating in a direction $A_5$ on a coaxial shaft 47 projecting from each end of roller 46, shaft 47 being parallel to shaft 42. Shaft 47 is supported at each end by bearings 49 secured to frame portions 48 of the electrostatographic machine. One of the rollers 41 and 46 is frictionally driven by the other in a nonslip condition of engagement in the second transfer nip 35*b*. The drive for the system of rollers including rollers 31, 41 and 46 may be provided by a frictional contact with an external member (not shown), or as an alternative, one of rollers 31, 41 and 46 may be drivingly rotated by a motor connected, e.g., by a gearing connection, to one of shafts 32,42 and 47 (motor and gearing connection not shown). Shafts 32, 42 and 47 are shown as coplanar in FIG. 3*b*. Alternatively, shafts 32 and 42 may lie in one plane and shafts 42 and 47 in another (not illustrated). A toner image formed on PIFM 31 is transferred via nip 35*a* to ITR 41 and subsequently transferred to a receiver sheet in nip 35*b*. The receiver sheet may be adhered to roller 46 or alternatively the receiver sheet is fed through the nip 35*b* by a suitable feeding mechanism as is well known. A first voltage from a first power supply is applied to ITR 41 to urge electrostatic transfer of a toner image in nip 35*a* and a second voltage from a second power supply is applied to roller 46 to urge electrostatic transfer of a toner image in nip 35*b*. PIFM 31 is photoconductive. Alternatively, PIFM is an electrographic roller. Various stations (not shown) but similar to that described below for the embodiment of FIG. 8 are positioned about photoconductive PIFM 31 as is well known to form an electrostatic image and develop the image with dry pigmented insulative toner particles. The toner is typically pigmented, e.g., cyan, magenta, yellow or black, or the toner may have other pigments or colorants or physical characteristics, i.e., the toner may be unpigmented or can include magnetic toner particles. The photoconductive roller 31 is typically composed of a metallic cylindrical core on which is formed a thin photoconductive structure. The photoconductive structure may be composed of one or plural layers as is well known and may be covered by a thin insulating layer (individual layers of PIFM 31 not shown). The photoconductive structure may be included in a replaceable removable seamless tubular sleeve (not shown) surrounding the core member, in the manner as disclosed in copending U.S. patent application Ser. No. 09/680,133, filed in the names of Arun Chowdry et al.

The intermediate transfer roller (ITR) 41 has a metallic core, either solid or as a shell. On the core is coated or formed thereon a preferably relatively compliant and elastomeric layer whose thickness is between 0.2 mm and 20 mm and the layer preferably has a Young's modulus between 0.5 MPa and 100 MPa and more preferably a Young's modulus between 1 MPa and 50 MPa and an electrical bulk or volume resistivity between $10^6$ and $10^{12}$ ohm-cm, preferably $10^7$ to $10^9$ ohm-cm. Alternatively, the compliant layer may be included in a replaceable removable seamless tubular sleeve on the core member, in the manner as disclosed in copending U.S. patent application Ser. No. 09/680,139, filed in the names of Robert Charlebois et al. The compliant elastomeric layer preferably has a relatively hard surface or covering layer(s) to provide functionality as described in Rimai, et al., U.S. Pat. No. 5,666,193 and in Tombs et al., U.S. Pat. No. 5,689,787 and Vreeland et al., U.S. Pat. No. 5,714,288. The hard covering layer is relatively thin (0.1 micrometer to 20 micrometers in thickness) and has a Young's modulus greater than 50 MPa and preferably greater than 100 MPa. Young's modulus is determined on a macroscopic size sample of the same material using standard techniques, such as by measuring the strain of the sample under an applied stress using a commercial device such as an Instron Tensile tester and extrapolating the slope of the curve back to zero applied stress. The material covering the core of ITR 41, i.e., including the compliant elastomeric layer and the preferred hard outer coating covering the compliant layer as a composite member, is preferably for all practical purposes incompressible and preferably has a Poisson ratio of between or in the range of approximately 0.45 to 0.50. The Poisson ratio of this composite material may be determined by applying a load to the material and measuring the deflection of the material in a direction perpendicular to the direction of the applied load and dividing this deflection amount by the deflection in the direction of the load. Since the latter measurement is a negative value a negative of the obtained resulting division result is taken. In determining Poisson ratio of the compliant roller it will be understood that it is that of the composite material forming the roller from and including the outer layer radially inward through the compliant layer and up to but not including a non-elastomeric element such as the core or other non-elastomeric element. A non-elastomeric element is defined as a member having a Young's modulus greater than 100 MPa.

There will generally be peripheral speed mismatches caused by overdrive and underdrive in the two transfer nips, and the length of a toner image formed on PIFM 31 will generally not be the same as the length of the same toner image after the second transfer of the toner image to the receiver in nip 35*b*. Typically, rollers 31 and 46 are relatively nonconformable and the conformable ITR 41 is preferably made from a relatively incompressible elastomeric compliant material. As a result, an overdrive or an underdrive produced in nip 35*a* tends to be canceled by an opposite effect in nip 35*b*, i.e., by a corresponding underdrive or overdrive, and in this particular case the net overdrive or underdrive produced by the two nips 35*a,b* will therefore be small. An engagement adjustment device (EAD) is provided for controlling the net amount of overdrive or underdrive in the system of rollers 31, 41 and 46, e.g., by controlling the output speed ratio to a preferably predetermined value. Preferably, the net overdrive as measured between rollers 31 and 46 is controlled to be zero. A preferred EAD is shown in FIG. 3*b* and includes two lever arms 44 each supporting a bearing 43 around one projecting end of shaft 42 (one lever arm and one bearing are shown). Lever arms 44 are preferably straight although any suitable shape may be employed as is suitable. It is preferred that bearings 43 and lever arms 44 are attached to one another. Lever arms 44 are fixedly secured to rigid frame portions 45 of the electrostatographic machine. Engagements in both nips 35*a* and 35*b* are simultaneously adjusted by cooperatively moving lever arms 44 simultaneously up, or simultaneously down, while maintaining parallelism between shafts 32 and 42 and also between shafts 42 and 47. When lever arms 44 are moved simultaneously up, the engagement in nip 35*a* is increased while the engagement in nip 35*b* is decreased. Conversely, when lever arms 44 are moved simultaneously down, the engagement in nip 35*a* is decreased while the engagement in nip 35*b* is increased. A prime mover (PM) is provided to move lever arms 44, the prime mover 38 being applied preferably near to the free ends of the lever arms for maximum mechanical advantage, as indicated by the double-ended arrow labeled S. The prime mover (not illustrated in detail) may for example include a piezoelectric actuator, a screw moving for example through a fixed plate, a cam mounted on an axle parallel to shafts 32 and 42, or any other suitable device for controlling the position of the lever arms. Movements of a prime mover may be accomplished by appropriate mechanical coupling to a suitable drive mechanism, either via a manually activated drive or via a motor drive or by electrical signals, e.g., to a piezoelectric actuator. The lever arms 44 are preferably rigid and are moved independently by a separate prime mover acting on each lever arm, in which case the lever arms may also serve for aiding provision of parallelism between shafts 32, 42 and 47. Alternatively, the lever arms 44 may be yoked together and acted upon by one prime mover. The frame portions 45 to which lever arms 44 are secured are preferably very strong such that negligible strain is produced in the frame portions or in the junctions between the lever arms and the frame portions when the lever arms are moved by the prime mover. Similarly, frame portions supporting bearings 33 and 49 are sufficiently strong so that negligible strains are produced when lever arms 44 are moved. It will be appreciated that very small changes of engagement may be achieved for relatively small motions provided by the prime mover(s), as discussed above for embodiment 10. Because a motion of lever arms 44 affects both nips 35*a,b* simultaneously, the EAD of apparatus 30 can be more sensitive than that of apparatus 10, and even very small motions as indicated by the double ended arrow S can produce significant changes to the net overdrive or underdrive caused by the tandem actions of both nips. Thus, use for example of piezoelectric actuators as prime movers can provide precise and repeatable displacements for actuating lever arms 44. As an alternative, a differential screw mechanism may for example be used to provide accurate, repeatable precision adjustments of the engagements. As another alternative, a cam having for example a slightly ellipsoidal shape, i.e., of low eccentricity, may be used to provide the motions indicated by the double ended arrow S. Although levers 44 may be included in an engagement adjustment device such as shown in FIG. 3*b* for simultaneously adjusting engagements between a conformable roller and other rollers, the invention includes any suitable other alternative engagement adjustment device for controllably adjusting these engagements.

Figure 3C:
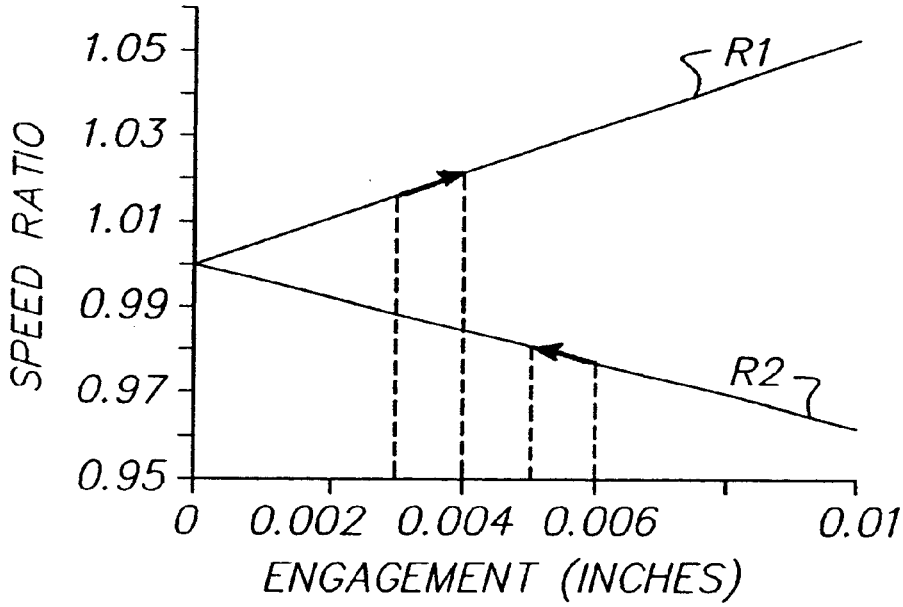
FIGS. 3*c* and 3*d* show hypothetical illustrative graphs of speed ratio as function of engagement for an elastomeric nip including an elastomeric roller.
Figure 3D:
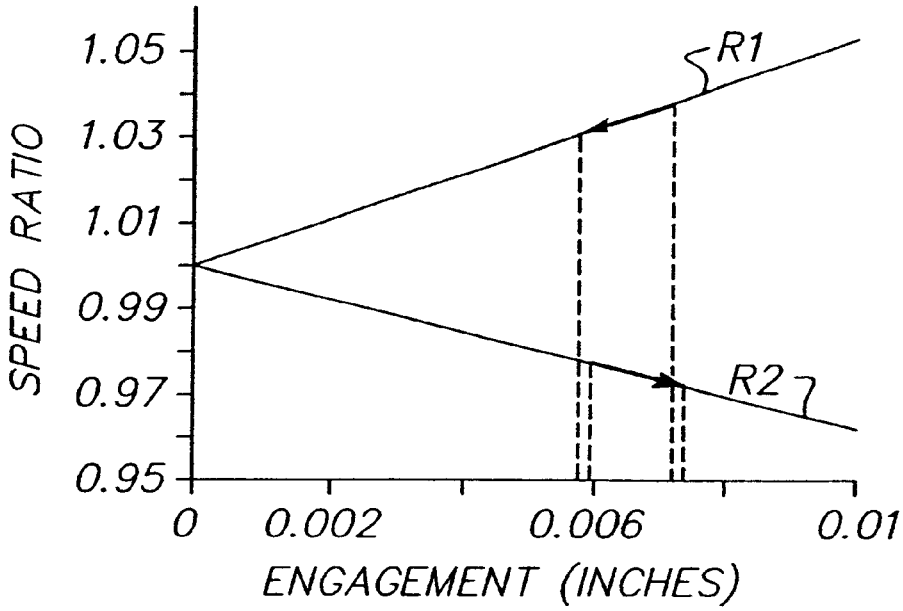
Figure 3E:
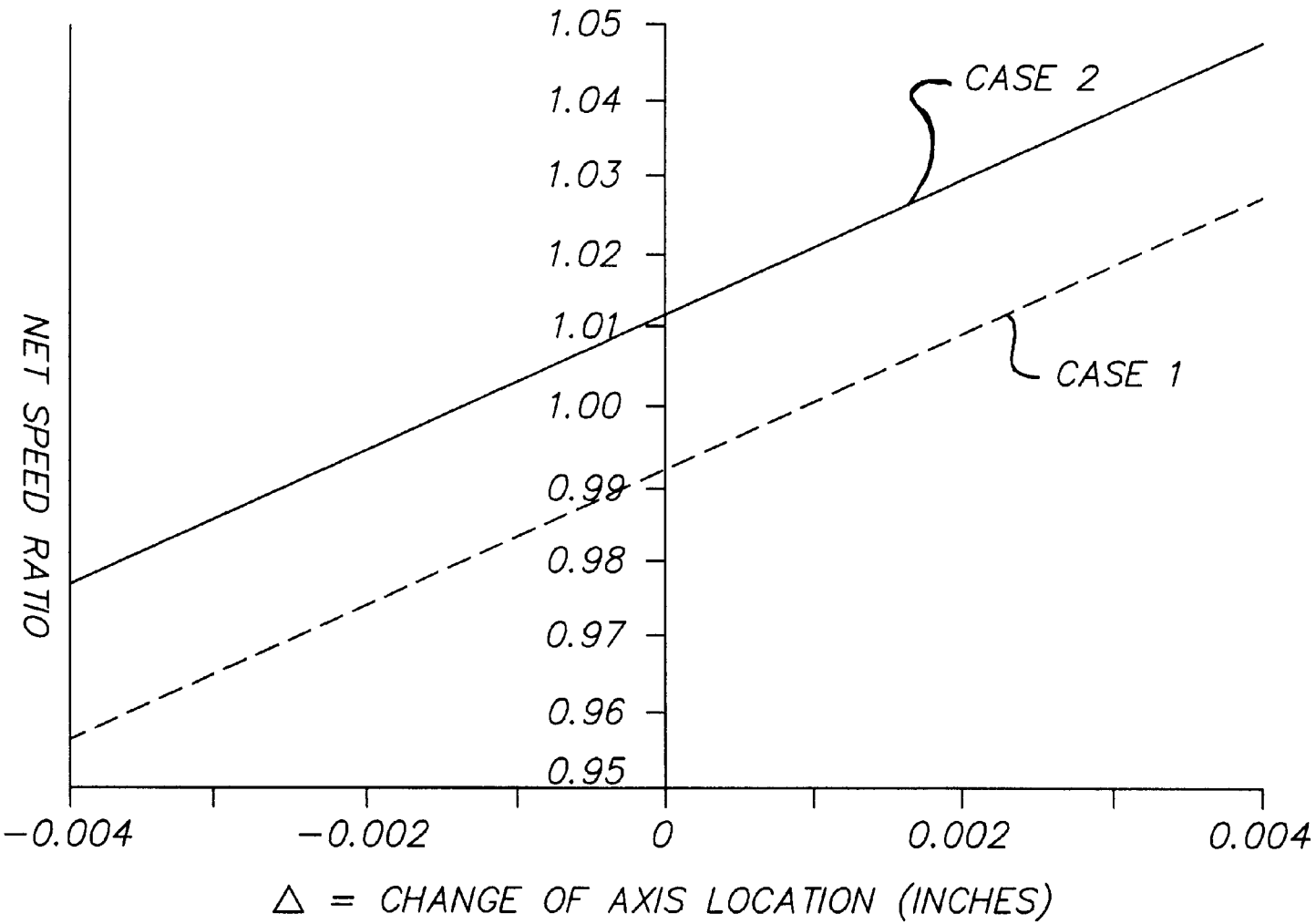
FIG. 3*e* shows hypothetical illustrative graphs of net speed ratio as determined by two successive elastomeric nips in a three roller transfer system.

In order to better appreciate the dual action by lever arm 44 for simultaneously adjusting the engagements in nips 35*a* and 35*b*, reference is made to FIGS. 3*c*, 3*d* and 3*e*, in which peripheral speeds $v_1$, $v_2$ and $v_3$ far away from both nips are indicated for rollers 46, 41 and 31, respectively. Peripheral speed ratios $R_2$ and $R_1$ may be defined as $R_1=v_3/v_2$ and $R_2=v_2/v_1$. The net or overall speed ratio of roller 31 referred to roller 46 is given by the product $R_1R_2=v_3/v_1$. For illustrative purposes only, rollers 31 and 46 are taken to be relatively hard rollers while roller 41 is taken to be a compliant elastomeric roller, i.e., incompressible for all practical purposes, and in FIG. 3*c* the peripheral speed ratios as functions of engagement are indicated for an idealized condition of zero drag (see also FIG. 7). Specifically, $R_1$ is represented for simplicity as a linear function of engagement having for purpose of illustration the form $R_1=1+5E$, where E is the engagement measured in inches. The speed ratio $R_1$ increases with increasing engagement, reflecting an overdrive of roller 31 by roller 41. Similarly, $R_2$ is described for purposes of illustration by a similar functional relation having for purpose of illustration a slightly smaller sensitivity to engagement, i.e., $R_2=(1+4E)^{-1}$, where $R_2$ decreases with increasing engagement reflecting an underdrive of roller 41 by roller 46. Generally, before engagements are adjusted by a motion of lever arm 44 along the arc S, there are initial values of engagement, say $E_1$ in nip 35*a*, and $E_2$ in nip 35*b*. When lever arm 44 is moved, with shafts 32, 42 and 47 being coplanar as depicted in FIG. 3*b*, the engagement in nip 35*a* is changed by an amount $\Delta$ to $(E_1+\Delta)$, and the engagement in nip 35*b* is therefore changed to $(E_2-\Delta)$. In Case 1, as shown in FIG. 3*c*, $E_1$ has for purpose of illustration been chosen to be 0.003000", and $E_2$ chosen to be 0.006000". In FIG. 3*e*, the lower dotted line is the value of the product $R_1R_2$ calculated as a function of $\Delta$ for Case 1, and the value of $R_1R_2$ is 1.0000 for a value of $\Delta$=0.001000". As indicated for Case 1 by the arrows in FIG. 3*c*, overdrive is eliminated if the engagement in nip 35*a* is increased from 0.003000" to 0.004000" and the engagement in nip 35*b* is simultaneously decreased from 0.006000" to 0.005000". In Case 2, shown in FIG. 3*d*, $E_1$ is 0.007000" and $E_2$ is 0.006000". The upper solid line of FIG. 3*e* shows $R_1R_2$ calculated as a function of Δ for Case 2, and on this line the value of $R_1R_2$ is equal to 1.0000 for Δ=−0.001223". Thus, as shown for Case 2 by the arrows in FIG. 3*d*, overdrive is eliminated if the engagement in nip 35*a* is decreased from 0.007000" to 0.005777" and the engagement in nip 35*b* is simultaneously increased from 0.006000" to 0.007223". Cases 1 and 2 illustrate the fact that a net speed ratio $R_1R_2$ equal to 1.0000 may be achieved by moving shaft 42 up or down, typically by a distance of the order of about 0.001", depending on the initial engagements present in nips 35*a* and 35*b* immediately prior to such a moving of shaft 42.

In the embodiment of apparatus 30, lever arms 44 are used for moving roller 41 relative to the fixed axes of rollers 31 and 46 as shown in FIG. 3*b*. In an alternative embodiment (not illustrated) the axis of roller 41 is instead the fixed axis, i.e., with bearing 43 fixedly secured to a frame portion and each of the separations between shafts 32 and 42 and shafts 42 and 47 being adjustable, separately or jointly, by an engagement adjustment device (EAD). In this alternative embodiment, lever arms 44 are not used, and an EAD includes appropriate prime movers for moving the respective shafts of one or both rollers 31 and 46 in order to alter the engagements in nips 35*a* and 35*b*. Preferably, both of the separations between shafts 32 and 42 and shafts 42 and 47 are simultaneously adjusted. Movements of a prime mover may be accomplished by appropriate mechanical coupling to a suitable drive mechanism, either via a manually activated drive or via a motor drive. It is further preferred that when an engagement in nip 35*a* is increased, the engagement in nip 35*b* is decreased, or vice versa. A preferred EAD of the alternative embodiment includes two sets of rigid lever arms and corresponding prime movers for moving both of shafts 32 and 47 in a parallel fashion entirely similar to that described above for apparatus 30.

A logic and control unit (LCU) may be employed to control the motion of the prime mover(s) of an engagement adjustment device (EAD) used to control the engagements in nips 35*a* and 35*b*. For example, the LCU sends signals to prime mover(s) to actuate lever arms 44, e.g., through a feedback loop using for example sensors 36 and 37 to sense the movement of fiducial marks placed for example on the outer surfaces of rollers 31 and 46, respectively. The sensors send signals to the LCU and from the LCU other signals are sent to actuate the prime mover(s) and ultimately the lever arms 44. The fiducial marks are preferably in the form of identically spaced parallel fine lines or bars. These lines or bars are preferably perpendicular to the directions of rotation of the rollers, and preferably have a predetermined center-to center distance which is known precisely. The fiducial marks may be included as permanent markings of, or in, the outer layer of rollers 31 and 46 and may be placed for example near one edge of each of the rollers, i.e., outside of the toner image area. Alternatively, fiducial marks such as in the form of fine markings or rulings may be provided on wheels secured coaxially to shafts 32 and 47. It will be evident that the movement of the fine markings or rulings past the sensor may be interpreted by the LCU as an angular velocity, whereupon if the outer radii of rollers 31 and 46 are known with precision, the surface speeds of each roller may be calculated as the product of its radius multiplied by its measured angular velocity. As a result of controlling overdrive (or underdrive) to an operational or a predetermined level using the EAD, a toner image which is transferred, e.g., to a receiver in nip 35*b* from a conformable intermediate transfer roller 41 has a predictable distortion which may be eliminated or compensated for when creating the toner image on primary image roller 31, e.g., by a programmable digital laser image writer as is well known. Preferably, any net overdrive or underdrive between rollers 31 and 46 is eliminated by the EAD, thereby producing an undistorted toner image on the receiver and requiring no extra programming of the image writer.

The fiducial marks on the surface of roller 31 may be provided in the form of a toner test image, such as for example an electrophotographically created set of parallel equi-spaced toned bars or lines formed perpendicular to the direction of rotation of roller 31. These toned bars or lines on the surface of roller 31 are sensed by a sensor 36 and corresponding signals are sent from sensor 36 to the LCU, the number of bars or lines passing the sensor in unit time being equal to a frequency g which is stored in the LCU. The toner bar test image is transferred to intermediate transfer roller 41 via nip 35*a* and then a receiver (not shown) passing through nip 35*b*, and the receiver may be a test sheet used specifically for correcting for overdrive or underdrive. The test sheet may be adhered to roller 46 and sensor 37 used to measure a frequency, say g', of passage of the toned bars or lines on the receiver past the sensor, and this frequency is sent to the LCU. Generally, as a result of overdrive or underdrive in nip 35*b*, g and g' will not be the same. An adjustment of the engagements in both nips 35*a* and 35*b* is provided via lever arms 44 such that a difference between the frequencies g and g' is equal to an operational or a predetermined value stored in the LCU. This operational or predetermined value corresponds to an operational or predetermined speed ratio of the peripheral speeds of rollers 31 and 46 far from nips 35*a* and 35*b*, respectively. Preferably, the operational or predetermined difference (g−g') equals zero, and the corresponding operational or predetermined speed ratio is 1.000. Alternatively, the test sheet may not be adhered to roller 46 after passage through the nip 35*b*, and a sensor (not shown) is used to measure a spatial frequency g" on a portion of the surface of the test sheet receiver carrying a transferred toner bar test image after that portion has passed through nip 35*b*, and a difference (g−g") made equal to an operational or a predetermined value by the EAD. Preferably, the operational or predetermined difference (g−g") equals zero, and the corresponding operational or predetermined speed ratio is 1.000.

Preferably, the prime mover 38 is a piezoelectric actuator applied to each of lever arms 44, each piezoelectric actuator supported or attached to a rigid frame portion of the electrostatographic machine, with actuation provided by a voltage to the actuator from a programmable power supply as controlled by the LCU (support for piezoelectric actuator not illustrated). In order to compensate in real time for differential overdrive associated for example with slightly out-of-round precision rollers 31, 41 and 46 for which the runout is for example typically of the order of 0.001 inch or less, an AC voltage signal may be applied to the piezoelectric actuators in order to dampen or null out fluctuations of engagement, i.e., fluctuations from a nominal or mean value of engagement associated with nips 35*a* and 35*b*, thereby producing a net speed ratio between rollers 31 and 46 which has a much reduced or a negligible variation over short periods of time, e.g., on a time scale of revolution of one of the rollers. A frequency response for the required AC voltage signal is typically of the order of less than about 100 Hz, although any suitable frequency response may be used as necessary. It may be useful to employ an auxiliary device such as for example a piezoelectric sensor or a transducer to sense mechanical displacements or pressure changes associated with differential overdrive caused by runout. Fluctuating displacements or pressure changes in nips 35*a* and 35*b* are converted by the auxiliary device to a time varying voltage signal which is sent to the LCU and thereby used, in feedback mode, to actuate nulling or damping response movements to be applied to lever arms 44 by the piezoelectric activators so as to smooth out speed ratio fluctuations associated with the runout. The auxiliary sensor may be conveniently located, for example, between one of the bearings 41 and a corresponding lever arm 44, i.e., sandwiched between them such that a sensing area of the piezoelectric sensor abuts the bearing, the sensor securely attached to both bearing 41 and the lever arm 44 (piezoelectric sensor not illustrated).

In a color electrostatographic machine that includes a plurality of individual color stations similar to embodiment 30, each station may be used to make a similar set of short bars or lines, e.g., on a test receiver, with each set being preferably displaced, e.g., in a direction parallel to the axis of shaft 32, so that no set overlaps another, and a similar frequency measuring procedure is used in each station. After passage through a first secondary transfer nip, e.g., nip 35*b*, the test receiver is transported by known means, e.g., rollers or other means, through similar secondary nips in each of the plurality of stations.

Alternatively, a toner test image formed on roller 31 and transferred to a test receiver may include a registration test pattern, e.g., a well known rosette pattern of dots similar to that typically used in color printing applications. In a color machine that includes a plurality of individual color stations similar to embodiment 30, a separate registration test pattern from each station is transferred to form a composite toner image on the test receiver sheet as it passes sequentially through the stations. The composite image on the test sheet is examined for registration, e.g., by using a loupe. If registration of one or more of the color images with the remaining color images is not satisfactory, then an engagement adjustment device (EAD) is used to adjust the engagement , e.g., manually in the corresponding color stations. A second set of test images is similarly formed and transferred to another test sheet and further adjustments to engagements made by corresponding EADs. This procedure is repeated with subsequent test sheets until the registration is satisfactory.

When all stations have adjusted the respective engagements by suitable EADs applied separately in each station so that the speed ratios are the same in all stations and preferably equal to 1.000 in all stations, it will be evident that a full color image made immediately subsequent to the test sheet passing through the machine will be in good registration. A test sheet may be utilized at any convenient time, e.g., between runs. Thereby, changes in dimensions of rollers or other members due to wear, aging, temperature changes and so forth may be compensated for in a simple way without the need for complicated adjustments to the individual image writers.

Figure 4A:
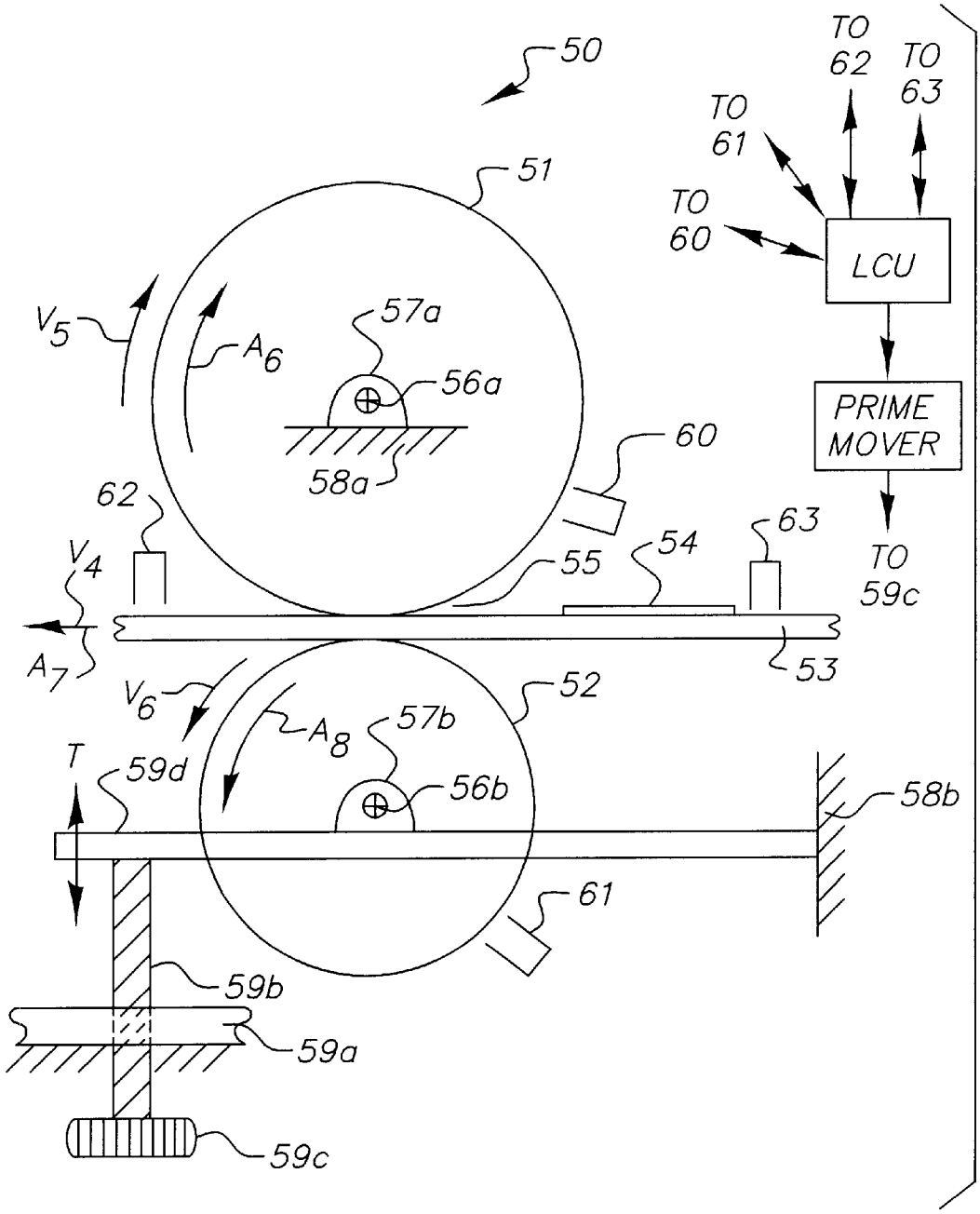
FIGS. 4*a* and 4*b* are schematic side and front elevational views respectively of yet another embodiment of the invention.
Figure 4B:
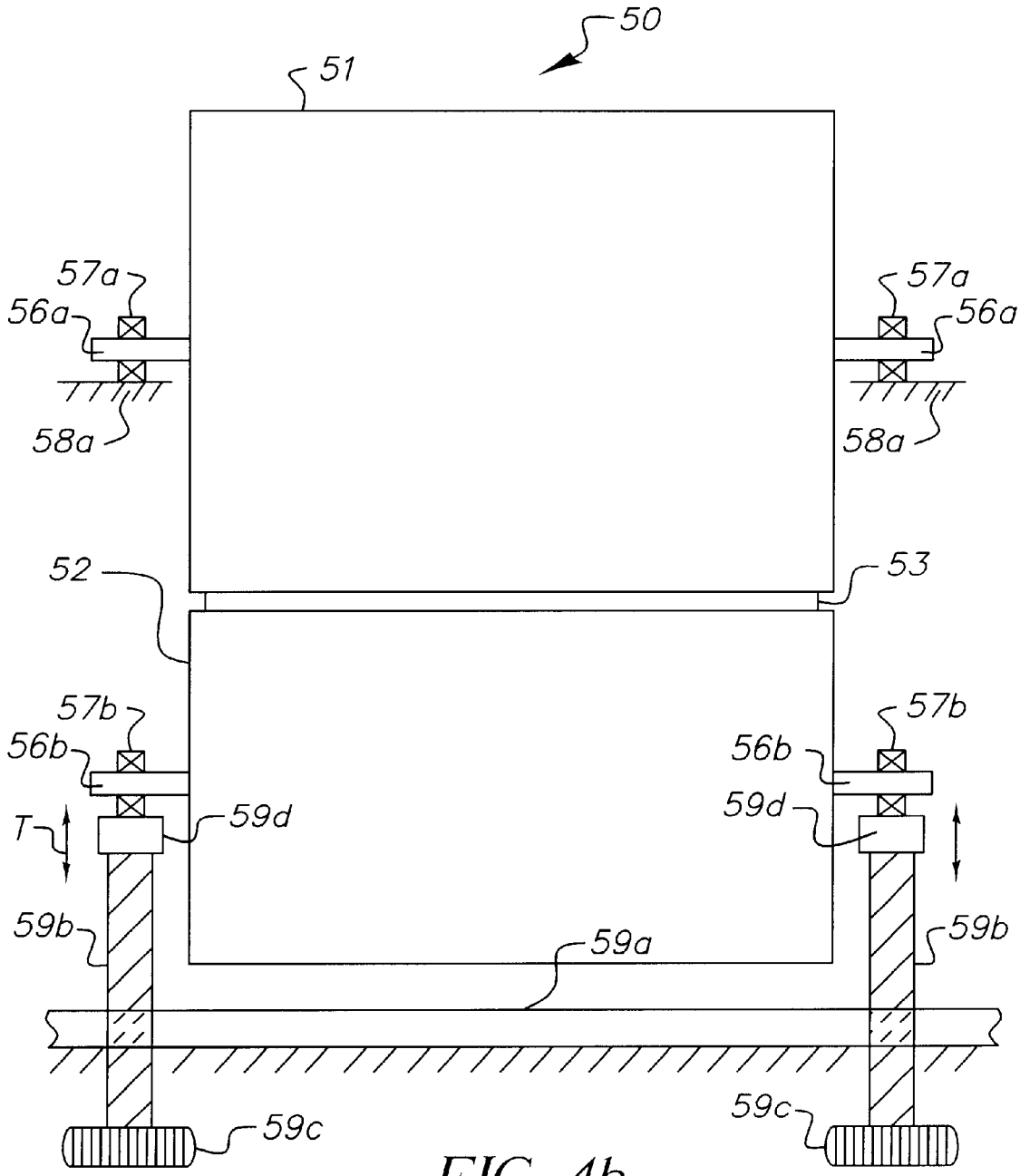

FIGS. 4*a* and 4*b* show side and front views of a third embodiment of the invention including an engagement adjustment device, wherein an image transfer assembly 50 includes a conformable primary image forming member roller (PIFM) 51 engaged in a nonslip condition of engagement with a transport web 53 in a pressure nip 55. (In lieu of a roller, a web type conformable primary imaging member may be used with a backup roller). The transport web 53 is contained in pressure nip 55 by a backup roller 52, the web frictionally driving both the PIFM 51 and the backup roller. Transport web 53 moves a receiver 54 through nip 55 where a toner image is transferred from PIFM 51 to the receiver. Rotatable web 53 is in the form of an endless loop tensioned around at least one and preferably two or more supporting rollers (not shown), one of which supporting rollers is a driving roller rotated by a motor (not shown). An electrical bias to the backup roller 52 is preferably used to assist transfer. Web 53 is preferably insulating. During transport the receiver 54 is adhered to the web 53, e.g., held electrostatically or by grippers, and frictional nonslip drive is maintained by the web whether or not the receiver is in nip 55. The conformable PIFM 51 is an electrophotographic photoconductive roller. Alternatively, PIFM 51 may be an electrographic conformable roller, e.g., as disclosed in U.S. Pat. No. 5,732,311. Photoconductive roller 51 is preferably a compliant elastomeric roller in which the elastomeric material is for all practical purposes incompressible such as described in U.S. Pat. No. 5,828,931. Alternatively, in some applications roller 51 may include a compressible resilient foam layer. Various stations (not shown) but similar to that described below for the embodiment of FIG. 8 are positioned about the photoconductive roller 51 as is well known to form an electrostatic image, develop the image with dry pigmented insulative toner particles and transfer the toner image in the nip 55 to the receiver 54. The toner is typically pigmented, e.g., cyan, magenta, yellow or black, or the toner may have other pigments or physical characteristics, i.e., the toner may be unpigmented or can include magnetic toner particles. The photoconductive roller 51 may be composed of a metallic cylindrical core on which is formed for example a compliant blanket layer, a flexible thin conductive electrode layer which is preferably grounded and coated on the blanket layer, and a thin photoconductive structure coated on the electrode layer. The photoconductive structure may be composed of one or plural layers as is well known and may be covered by a thin insulating layer (individual layers of PIFM 51 not shown). The photoconductive structure may be included in a replaceable removable seamless tubular sleeve (not shown) surrounding the core member.

Conformable roller 51 rotates in a direction of arrow $A_6$ on a coaxial shaft 56*a* projecting from each end of roller 51, shaft 56*a* being supported at each end by bearings 57*a* secured to frame portions 58*a* of the electrostatographic machine (see FIG. 4*b*). Roller 52 rotates in a direction of arrow $A_8$ on a coaxial shaft 56*b* projecting from each end of roller 52, shaft 56*b* being parallel to shaft 56*a* and supported by bearings 57*b*. Transport web 53 is shown moving at a speed $v_4$ in the direction of arrow $A_7$. Peripheral speeds of rollers 51 and 52 far away from nip 55 (where the rollers are undistorted) are respectively $v_5$ and $v_6$. Generally, the frictional drive in nip 55 produces an underdrive or an overdrive of roller 51. Thus if conformal roller 51 is for all practical purposes incompressible, roller 51 will be underdriven by web 53. Or, if conformal roller includes a compressible foam layer, roller 51 may be subject to an overdrive. Similarly, roller 52 may be subject to an overdrive or an underdrive by web 53, depending on the mechanical properties of the roller and the web. Typically, the web 53 is made of a high modulus, flexible, material. Because no direct mechanical driving connection is provided between rollers 51 and 52, the rotary motion of roller 52 has no effect on that of roller 51. Therefore, a speed ratio $R_3=v_5/v_6$ is determined entirely by any independent overdrives or underdrives produced by nonslip frictional contact with the upper and lower sides of web 53. It will be evident that a speed ratio $R_4=v_5/v_4$ given by the peripheral speed of imaging roller 51 divided by the speed of web 53 is critical in determining the length of a toner image after transfer of the toner image to receiver 54, and that this length may differ from the length of the toner image when formed on imaging roller 51.

An engagement adjustment device (EAD) including a prime mover is provided for controlling the amount of overdrive, e.g., by controlling the speed ratio $R_4$ to a preferably predetermined value. Alternatively, an EAD may be used to control the speed ratio $R_3$ and thereby indirectly control $R_4$. Movements of a prime mover may be accomplished by appropriate mechanical coupling to a suitable drive mechanism, either via a manually activated drive or via a motor drive. A preferred EAD includes two parallel lever arms 59*d*, each lever arm supporting a bearing 57*b* as shown in FIG. 4*b*. Lever arms 59*d* are preferably straight although any suitable shape may be employed as is suitable. Lever arms 59*d* are fixedly secured to a rigid frame portion or portions 58*b* of the electrostatographic machine. It is preferred that bearings 57*b* and lever arms 59*d* are attached to one another. An engagement in the nip 55 is adjusted by cooperatively moving lever arms 59*d* simultaneously up, or simultaneously down, while maintaining parallelism between shafts 56*a* and 56*b* (thereby respectively increasing, or reducing, engagement). A prime mover is provided to move lever arms 59*d*, acting preferably near to the free ends of the lever arms for maximum mechanical advantage as indicated by the double-ended arrow labeled T. The prime mover may be any suitable device for controlling the position of the lever arms 59*d*. A preferred EAD includes screws 59*b* moving through a fixed plate 59*a*, the fixed plate preferably being a rigid frame member of the electrostatographic machine. The screws 59*b* are preferably differential screws as are well known in the art (simple screws are shown for illustration purposes in FIG. 4*a,b*). The screws 59*b* may be adjusted manually to alter the engagement in nip 55. Preferably, the screws 59*b* are terminated by gears 59*c*, and a driving gearing connection is provided to each of gears 59*c*. The driving gearing connection may be manually operated or it may include a reversible motor to provide a preferably independent reversible drive to each of the gears, i.e., a clockwise or anti-clockwise rotation. Preferably, for maximum control of the lever arms 59*d* when moved along the arc T, a single rotation of a gear (not shown) meshing with and rotating each of gears 59*c* produces a fraction of one rotation of each of gears 59*c*. The lever arms 59*d* are preferably rigid and are preferably moved independently by separate screws 59*b* acting on each lever arm as shown in FIG. 4*b*, in which case the lever arms may also serve for adjusting parallelism between shafts 56*a* and 56*b*. As an alternative to a common plate 59*a*, each screw 59*b* may pass through a separate fixed plate (not illustrated). The lever arms 59*d* may be yoked together and acted upon by one screw, the screw acting for example on the yoke (not illustrated). The frame portion(s) 58*b* to which lever arms 59*d* are secured are preferably very strong such that negligible strain is produced in the frame portions or in the junctions between the lever arms and the frame portions when the lever arms are moved by the screws 59*b*. Similarly, the frame portion(s) 58*a* supporting bearings 57*a* are negligibly strained when lever arms 59*d* are moved.

Although levers 59*d* may be included in a preferred engagement adjustment device such as shown in FIG. 4*a*, the invention includes any suitable other alternative engagement adjustment device for controllably adjusting the engagement. As a mechanically equivalent alternative to using lever arms 59*d* for moving roller 52 against the fixed axis roller 51, the axis of roller 52 may instead be the fixed axis and lever arms similarly used to move conformable roller 51 to alter the engagement (not illustrated).

A logic and control unit LCU provides control of the elements used to create the images on the photoconductor roller 51 and preferably also provides control over the drive imparted to the driving web 53. A feedback loop using for example sensors 60 and 61 to sense the movement of indicia or fiducial marks placed on the surfaces of rollers 51 and 52 may be used in conjunction with the LCU to control the prime mover for adjusting the engagement in nip 55, in a manner entirely similar to that described above for embodiment 10 of FIG. 3*a*. The engagement is adjusted to make the speed ratio $v_5/v_6$ equal to a predetermined value. As described previously above, a resulting controlled overdrive or underdrive may be compensated by sending a signal from the LCU to an image writer used for writing an electrostatic latent image on roller 51, so that the electrostatic latent image may be expanded or compressed as is suitable to provide toner images which are undistorted after transfer to receiver 54. Alternatively, indicia or fiducial marks such as in the form of fine lines or rulings may be provided on wheels secured coaxially to shafts 56*a* and 56*b*, and sensed by sensors 60 and 61, as described above for embodiment 10 of FIG. 3*a*. Preferably, a feedback loop using sensors 60 and 62 is used, sensor 60 sensing a speed $v_5$ of indicia or fiducial marks located in or on the surface of roller 51, and sensor 62 being placed to sense a speed $v_4$ of indicia or fiducial marks located in or on the surface of web 53. Alternatively, indicia or fiducial marks may be located on receiver sheet 54. For example, receiver 54 may be a test sheet, to which a toner test image created on roller 51 is transferred in nip 55, as described above for embodiment 10 of FIG. 3*a*. The engagement in nip 55 is adjusted via screws 59*c* to make the speed ratio $v_5/v_4$ equal to a predetermined value. Inasmuch as embodiment 50 includes only two rollers, it is generally not possible using an EAD to eliminate overdrive (or underdrive) unless substantial drag forces or torques are present, such drag forces or torques being inherent to the system or applied by external mechanical device.

As an alternative to forming a toner image test pattern on roller 51 and transferring it to receiver 54, a test pattern including a set of lines or bars perpendicular to the direction of motion of the web 53 and made from a transferable material such as for example an ink may be formed on the upper (outer) surface of the web by known mechanisms, e.g., by an ink jet device, and transferred to roller 51 in nip 55. In a manner entirely similar to that described above, as the test bar pattern passes a sensor 63 a first frequency may be measured by the LCU of the passage of the bars and compared with a second frequency measured via sensor 60, and an engagement adjustment device actuated to adjust the engagement in nip 55 to provide a predetermined difference between the first and second frequencies.

The web 53 moving in a direction of arrow $A_7$ through nip 55 can carry the receiver sheet 54 through one or more other imaging stations (not shown) similar to station 50 in a multistation color imaging apparatus, each of which other stations similarly includes a conformable photoconductive roller, a backup transfer roller producing a pressure nip through which web 53 is driven, and an engagement adjustment device (EAD) for controlling the engagement of each photoconductive roller with web 53 via signals to the EAD from the LCU. A toner image of a first color is transferred to receiver 54 in station 50, a second color is transferred in registry in the next station, and so forth, thereby producing a full color toner image on receiver 54. For example, the colors in order from right to left may be black, cyan, magenta and yellow to form a 4-color image. After passing through all of the imaging stations, the receiver is detached from web 53 by known means and transported to a fusing station (not shown).

In the multistation apparatus, the speed ratios between of all the individual photoconductor rollers and the web 53 are controlled to be the same, i.e., the peripheral speeds are made to differ from the speed of the web by a predetermined amount. Each of the single color toner images which form the full color image has an equal amount of distortion, thereby producing an image having an improved registration. As is known, when a digital device such as a writer including for example a scanning laser beam is used to form an electrostatic latent image on the surface of the photoconductive roller 51, the writer may be programmed to compensate for a toner image distortion caused by an overdrive or underdrive in nip 55. Thus, because each of the single color toner images which form the full color image has an equal amount of distortion, as provided by this invention, the compensation provided for the writer is the same for each station. This improves greatly over an apparatus where engagement adjustment devices are not used, in which an optimized registration would require the exact amount of overdrive-induced or underdrive-induced distortion produced by each station to be separately compensated for, which is comparatively difficult. Thus, in a machine that includes a plurality of individual color stations, as described above, each station may be used to make a similar toner test image on each photoconductive roller, e.g., a similar set of toned short bars or lines, with each set displaced in a direction parallel to the roller shafts so that no set overlaps another. A first frequency with which each set of lines passes sensor 60 is measured and stored in the LCU, and compared with a corresponding second frequency of lines in the same toner image transferred on receiver 54 and passing sensor 60. An engagement adjustment device, e.g., as shown in FIGS. 4*a,b* is used to make a difference between the first and second frequencies equal to a predetermined difference. The same predetermined difference of frequencies is similarly produced in each of the other stations. When all stations have adjusted the corresponding peripheral speeds of the respective photoconductor rollers by suitable adjustments of engagement applied separately in each station, it will be evident that a full color image made immediately subsequent to the test sheet passing through the machine will be in good registration. Subsequent to the making of the test image including all the sets of colored lines, a shrinking or lengthening of the transferred test images due to an overdrive or an underdrive associated with the predetermined frequency difference may be compensated for by a programmable image writer, e.g., used with roller 51 in order to produce an undistorted full color toner image on the receiver 54. A test sheet may be utilized at any convenient time, e.g., between runs. Thereby, changes in dimensions of rollers or other members due to wear, aging, temperature changes and so forth may be compensated for in a simple way without the need for complicated adjustments to the individual writers.

Alternatively, a toner test image formed on roller 51 and transferred to a test receiver may include a registration test pattern, e.g., a well known rosette pattern of dots similar to that typically used in color printing applications. In a color machine that includes a plurality of individual color stations similar to embodiment 50, a separate registration test pattern from each station is transferred to form a composite toner image on the test receiver sheet as it passes sequentially through the stations. The composite image on the test sheet is examined for registration, e.g., by using a loupe. If registration of one or more of the color images with the remaining color images is not satisfactory, then an engagement adjustment device (EAD) is used to adjust the engagement, e.g., manually in the corresponding color stations. A second set of test images is similarly formed and transferred to another test sheet and further adjustments to engagements made by corresponding EADs. This procedure is repeated with subsequent test sheets until the registration is satisfactory.

Figure 5A:
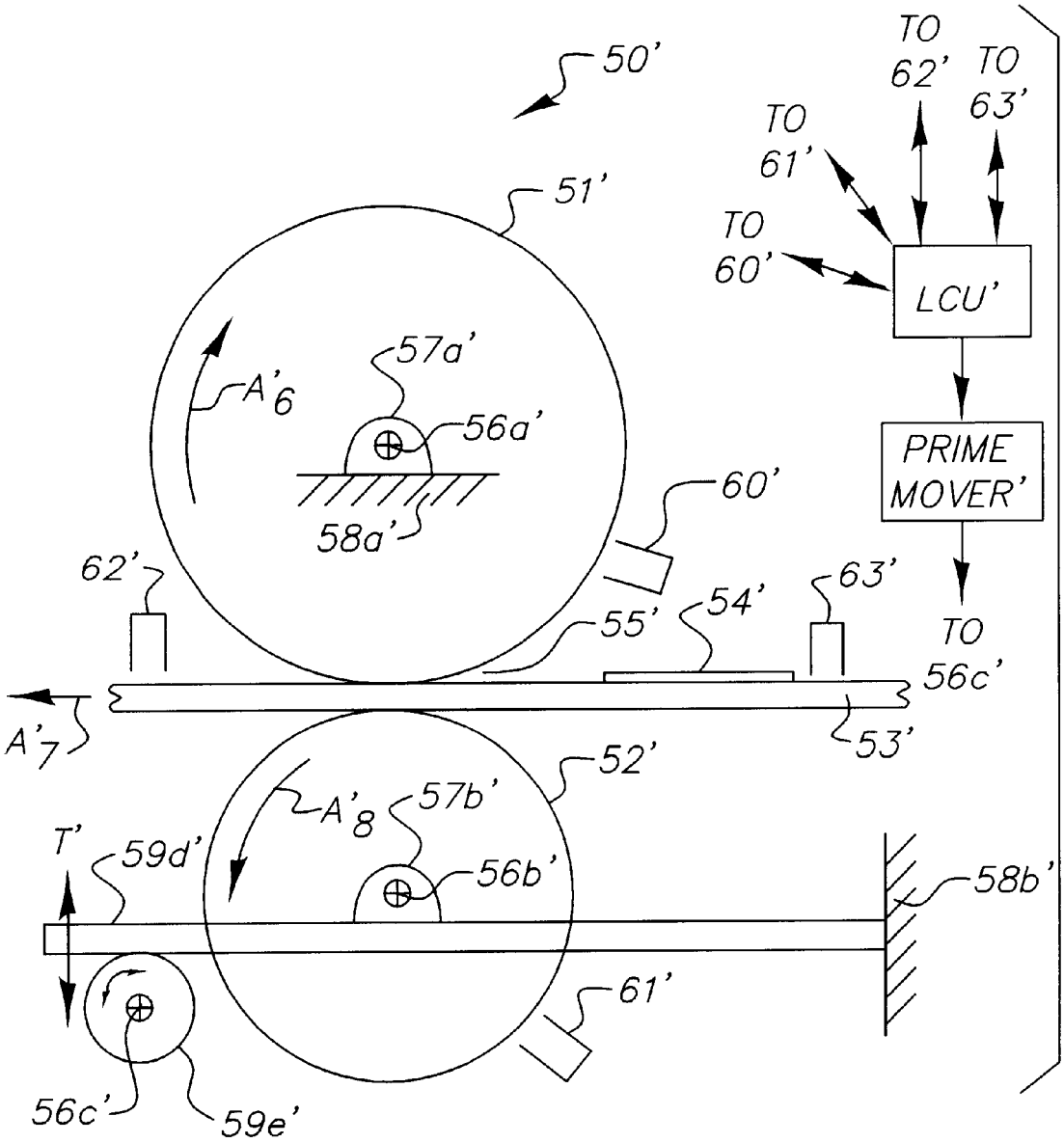
FIGS. 5*a* and 5*b* are schematic side and front elevational views respectively of still another embodiment of the invention.
Figure 5B:
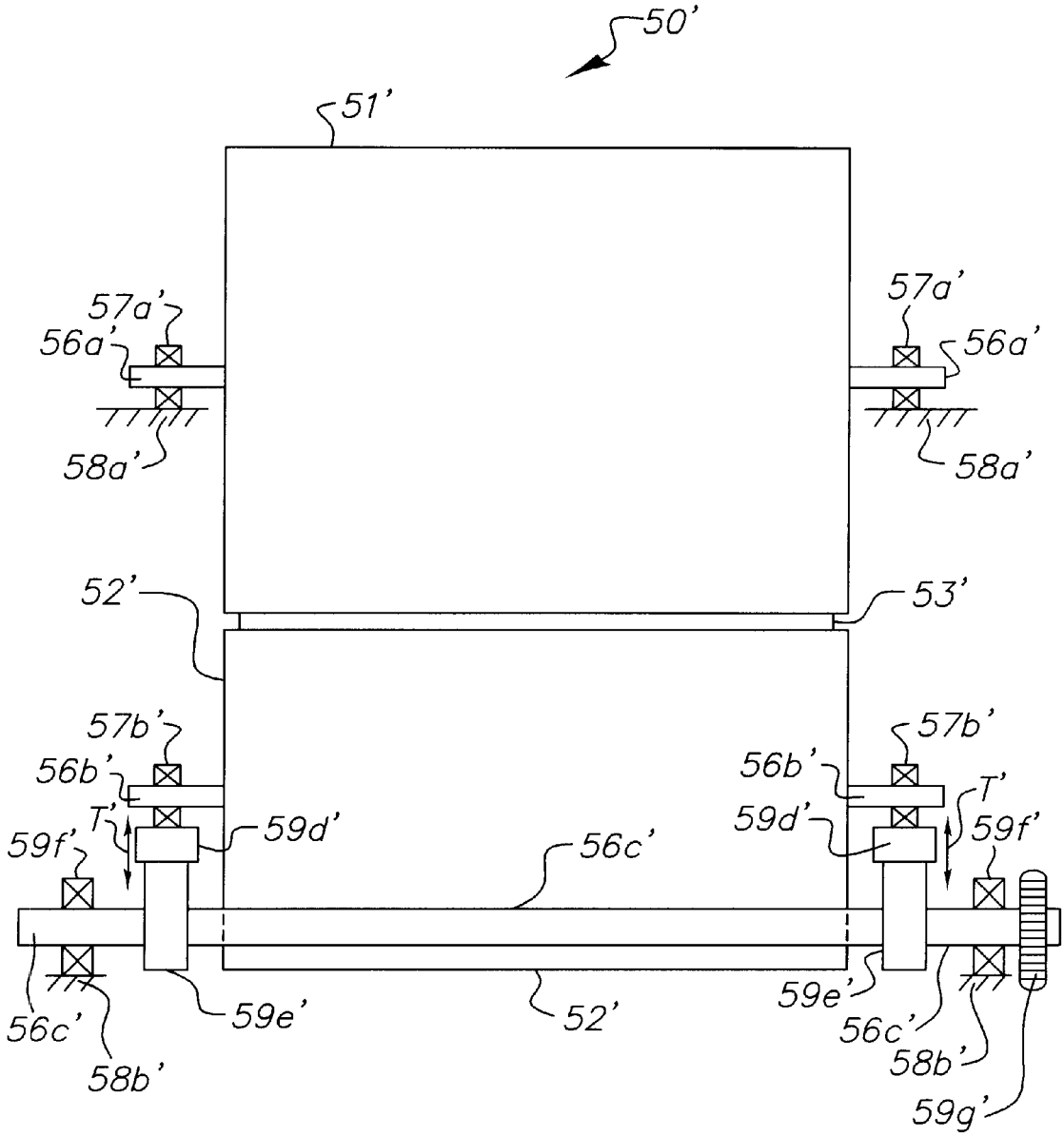

FIGS. 5*a* and 5*b* show side and front views of another embodiment of the invention including an engagement adjustment device, wherein an image transfer assembly 50' in an electrostatographic machine includes a conformable primary image forming member roller (PIFM) 51' engaged in a nonslip condition of engagement with a transport web 53' in a pressure nip 55'. Single primed (') entities are similar in all respects to corresponding unprimed entities of embodiment 50 shown in FIGS. 4*a,b*. Movements of a prime mover of an engagement adjustment device may be accomplished by appropriate mechanical coupling to a suitable drive mechanism, either via a manually activated drive or via a motor drive. Embodiments 50 and 50' differ in the mechanism provided for moving lever arms 59*d'*. Thus, a member having a noncircular portion including for example an elliptical cam 59*e'* having a small eccentricity is mounted on a rotatable shaft 56*c'* engaged with lever arm 59*d'*. As shown in FIG. 5*b*, shaft 56*c'* preferably supports two cams 59*e'*, one outside each end of roller 52', the shaft 56*c'* being supported by bearings 59*f'*. The bearings 59*f'* are fixedly secured to rigid frame portions 58*b'* of the electrostatographic machine. Shaft 56*c'* is preferably terminated by a gear 59*g'*, and a driving gearing connection is provided to gear 59*g'*. The driving gearing connection may be manually operated or it may include a reversible motor to provide a preferably independent reversible drive to the gear, i.e., a clockwise or anti-clockwise rotation. Preferably, for maximum control of the lever arms 59*d'* when moved along the arc T', a single rotation of a gear used to mesh with and rotate gear 59*g'* produces a fraction of one rotation of gear 59*g'*. Each of cams 59*e'* is preferably rotatably adjustable from any fixed angular disposition on shaft 56*c'* to another fixed disposition (fixing the disposition of a cam on the shaft is not illustrated, but any suitable mechanism of unlocking the cam from a first disposition and locking the cam in a second disposition may be used). Thus, independent rotational adjustments of the respective dispositions of each cam 59*e'* on shaft 56*c'* can be used to adjust the parallelism between shafts 56*a'* and 56*b'*. These adjustments of the dispositions of the cams are preferably done prior to making images and prior to using the engagement adjustment device. Alternatively, instead of a common shaft 56*c'* holding both cams 59*e'*, separate shafts may be used in an alternative embodiment to embodiment 50' (not illustrated), each shaft being mounted in a bearing fixedly secured to a separate rigid frame member and each shaft preferably provided with a gear 59*g'* and an independent driving gearing connection for independent adjustments of engagement at each end of roller 52'. In this alternative embodiment, the dispositions of each of the cams 59*e'* can be immovably fixed on each shaft. As a mechanically equivalent alternative to using lever arms 59*d'* for moving roller 52' against the fixed axis roller 51', the axis of roller 52' may instead be the fixed axis and lever arms similarly used to move conformable roller 51' to alter the engagement (not illustrated). In applications using embodiment 50', an overdrive or an underdrive is adjusted to a predetermined value by an engagement adjustment device. However, inasmuch as embodiment 50' includes only two rollers, it is generally not possible using an engagement adjustment device to eliminate overdrive (or underdrive)

unless substantial drag forces or torques are present, such drag forces or torques being inherent to the system or applied by external mechanical mechanisms. Actuation of an engagement adjustment device in embodiment 50' may be accomplished by using fiducial marks, appropriate sensors such as 60', 61', 62' and 63', and prime movers in conjunction with the LCU' as described above for embodiment 50.

In a multistation color imaging apparatus, the web 53' moving in a direction of arrow $A_7$' through nip 55' can carry the receiver sheet 54' through one or more other imaging stations similar to station 50' (not shown) with respective engagement adjusting devices employed as described above for the multistation color imaging apparatus using stations similar to embodiment 50.

Figure 6A:
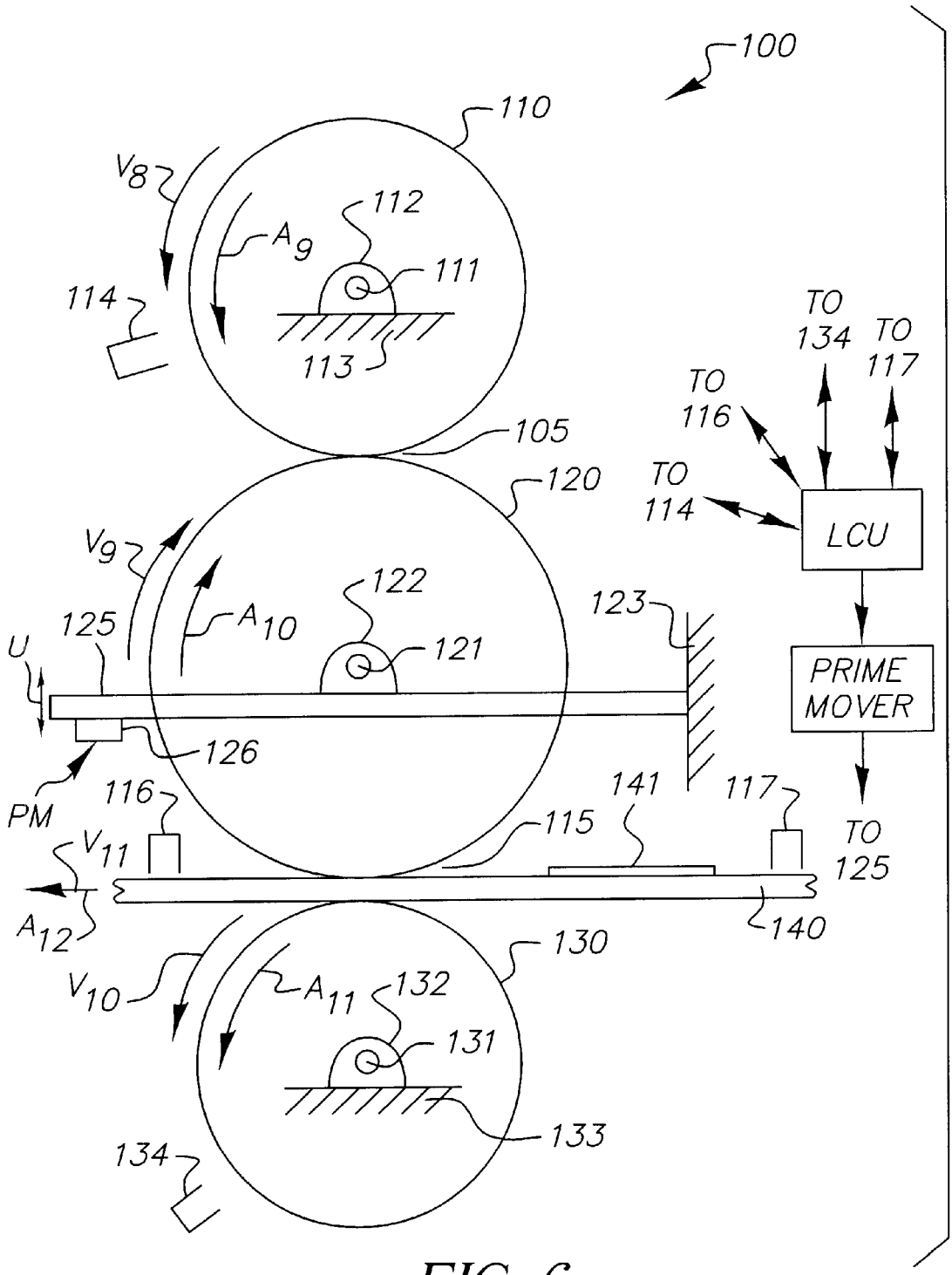
FIG. 6*a* is a schematic side elevational view of another embodiment of the invention.

FIG. 6*a* shows yet another embodiment of the subject invention, i.e., a transfer system, designated as 100, of an electrostatographic machine. Transfer system 100 includes a primary image forming member 110, a conformable intermediate transfer member 120, a transfer backup roller 130 and a moving transport web 140. Photoconductive imaging roller 110 forms a first transfer nip 105 in a pressure contact with the intermediate transfer roller (ITR) 120, and backup roller 130 forms a second transfer nip 115 with ITR 120, the transport web 140 being captured under pressure between rollers 120 and 130. Typically, rollers 110 and 130 are relatively nonconformable or hard. However, in some applications one or both of rollers 110 and 130 may have some conformability. Transport web 140, of which a portion is shown, has the form of a rotating endless loop and moves in a direction of arrow $A_{12}$. Web 140 is a driven web supported in tension by at least one and preferably two or more supporting rollers (not shown) one of which supporting rollers is a driving roller rotated by a motor (not shown). PIFM 110 is shown rotating in a direction $A_9$ and is provided with a coaxial shaft 111 projecting from each end of roller 110. Shaft 111 is supported by bearings 112 secured to frame portions 113 of the electrostatographic machine. Roller 120 is shown rotating in a direction $A_{10}$ on a coaxial shaft 121 projecting from each end of roller 120, shaft 121 being parallel to shaft 111 and supported by bearings 122. Roller 120 is frictionally driven by the driven web 140 in a nonslip condition of engagement in transfer nip 115, and roller 110 is frictionally driven by roller 120 in a nonslip condition of engagement in transfer nip 105. Roller 130 is shown rotating in a direction $A_{11}$ on a coaxial shaft 131 projecting from each end of roller 130. Shaft 131 is parallel to shaft 121 and supported by bearings 132 secured to frame portions 133 of the electrostatographic machine. Roller 130 is frictionally driven by the web 140 in a nonslip condition of engagement in the second transfer nip 115. Shafts 111, 121 and 131 are parallel to one another and are coplanar. A toner image formed on imaging roller 110 is transferred via nip 105 to ITR 120 and subsequently transferred to a receiver sheet 141 in nip 115. A first voltage from a first power supply is applied to ITR 120 to urge electrostatic transfer of a toner image in nip 105 and a second voltage from a second power supply is applied to roller 130 to urge electrostatic transfer of a toner image in nip 115.

Rollers 110 and 120 and 130 respectively have mechanical and electrical characteristics similar to those of the photoconductive imaging roller 31, the intermediate transfer roller 41, and the backup roller 46 of embodiment 30 shown in FIG. 3*b*. Also, web 140 has characteristics similar to those of web 53 of embodiment 50 shown in FIGS. 4*a,b*. Various stations (not shown) but similar to those described for the embodiments of FIG. 3*b* and FIG. 8 are positioned about the photoconductive roller 110, including charging, exposing, developing, and cleaning stations as is well known. Peripheral speeds of rollers 110, 120 and 130 far away from nips 105 and 115 (i.e., where the rollers are undistorted) are respectively $v_8$, $v_9$, and $v_{10}$. Generally, the frictional drive of roller 110 by roller 120 in nip 105 produces an overdrive of roller 110 when conformable roller 120 is an elastomeric roller which is for all practical purposes incompressible and roller 110 is relatively nonconformable, or, an overdrive may occur when roller 120 includes a compressible foam layer. Similarly, conformable roller 120 may be subject to an underdrive or an overdrive by web 140, i.e., roller 120 will be underdriven when the roller is for all practical purposes incompressible, or roller 120 may be overdriven when the roller includes a compressible layer. Typically, the web 140 moving at a speed $v_{11}$ is made of a high modulus, flexible, material. A nonslip frictional drive of roller 120 is provided whether or not receiver 141 is in nip 115. Because no direct mechanical driving connection is provided between rollers 120 and 130, the rotary motion of roller 120 has no effect on that of roller 130. Because roller 110 is typically relatively nonconformable compared to conformable roller 120, the effect of an underdrive (overdrive) of roller 120 by web 140 tends to a great extent to be canceled by the corresponding overdrive (underdrive) of roller 110 by roller 120. In FIG. 6*a*, speed ratios $R_4$ and $R_3$ may be defined as $R_3=v_8/v_9$ and $R_4=v_9/v_{11}$. The net or overall speed ratio of roller 110 referred to web 140 is given by the product $R_3R_4=v_8/v_{11}$. The speed ratio $v_8/v_{11}$ is critical in determining the length of a toner image after transfer of the toner image from roller 120 to receiver 141, and this length may differ from the length of the same toner image when formed on imaging roller 110. Hence, $v_8/v_{11}$ needs to be precisely controlled.

An engagement adjustment device (EAD) is provided for moving shaft 121 towards shaft 111 in parallel fashion, thereby increasing an engagement in nip 105 and simultaneously decreasing an engagement in nip 115. Alternatively, the EAD can move shaft 121 towards shaft 131 in parallel fashion, thereby increasing an engagement in nip 115 and simultaneously decreasing an engagement in nip 105. The direction of movement of shaft 121 is chosen so that the speed ratio $v_8/v_{11}$ is made equal to a predetermined value, this value preferably being 1.000 in order to eliminate any net overdrive or underdrive between roller 110 and web 140. For illustrative purposes only, web 140 and roller 110 are taken to be relatively hard while roller 41 is taken to be a compliant elastomeric roller, i.e., incompressible for all practical purposes. In such a case, a peripheral speed of imaging roller 110 divided by a speed of web 140 is usually not very dependent on the detailed mechanical properties of roller 120. Control of the speed ratio $v_8/v_{11}$ by the EAD may be understood by analogy to FIGS. 3*c*, 3*d* and 3*e*, in which peripheral speeds $v_1$, $v_2$ and $v_3$ far away from both nips 35*a* and 35*b* are indicated in FIG. 3*b* for rollers 46, 41 and 31, respectively. In FIG. 6*a*, the analogous speeds far away from nips 105 and 115 are $v_{10}$, $v_9$, and $v_8$, respectively. Thus, in order to understand the effect of using an EAD to move the shaft 121, the speed ratios $R_3$ and $R_4$ may be respectively substituted for the ratios $R_1$ and $R_2$ in the previous discussion above relating to FIGS. 3*c*, 3*d* and 3*e*.

A preferred EAD includes two lever arms 125 fixedly secured to a rigid frame portion 123 (only one lever arm visible). The lever arms are preferably attached to bearings 122. A prime mover (PM) 126 moves the free end of each lever arm 125 along the arc U. The lever arms 125 have characteristics as described above. Prime movers may include screws, cams, gears and so forth as previously described for embodiments 10, 30, 50 and 50' above. A prime mover is activated for example manually, or alternatively by a motor using for example a feedback servo system as described above, or by any other suitable driver. Thus, analogously to embodiment 30 of FIG. 3*b*, sensors 114 and 134 may be used to sense fiducial marks on the surfaces of rollers 110 and 130 and corresponding frequency signals sent to the LCU where the two frequencies are compared, and a signal sent from the LCU to a prime mover to move lever arm 125 such that the speed ratio $v_8/v_{11}$ is preferably adjusted to 1.000. Alternatively, sensors 114 and 116 may be similarly used in conjunction with a toner bar test image formed on roller 110, transferred to roller 120 and then transferred to a test receiver in nip 115, as described above. As another alternative, analogous to an alternative of embodiment 50 described above, a transferable test image, e.g., a bar image formed on web 140 and sensed by sensor 117 may be transferred to roller 120 and thence to roller 110 where it is sensed by sensor 114, the signals from both sensors 117 and 114 being sent to the LCU and an adjustment signal sent from the LCU to a prime mover to actuate lever arm 125. Alternatively, fiducial marks or fine markings on wheels secured coaxially to shafts 111 and 131 may be sensed by sensors 114 and 134 in order to measure angular velocities of rollers 110 and 130 and convert these angular velocities to peripheral speeds in the LCU, as also described above.

In the embodiment of apparatus 100, lever arms 125 are used for moving roller 120 relative to the fixed axes of rollers 110 and 130 as shown in FIG. 6*a*. In an alternative embodiment (not illustrated) the axis of roller 120 is instead the fixed axis, i.e., with bearing 122 preferably attached to a frame portion and one or both of the separations between shafts 111 and 121 and shafts 121 and 131 being adjustable by an engagement adjustment device (EAD). In this alternative embodiment, lever arms 125 are not used and the respective shafts of rollers 110 and 130 are moved by an EAD, separately or jointly, in order to alter the engagements in nips 105 and 115. Preferably, both of the separations between shafts 111 and 121 and shafts 121 and 131 are simultaneously adjusted. Movements of a respective prime mover may be accomplished by appropriate mechanical coupling to a suitable drive mechanism, either via a manually activated drive or via a motor drive, or by any other suitable driver. It is further preferred that when an engagement in nip 105 is increased, the engagement in nip 115 is decreased, or vice versa. A preferred EAD of the alternative embodiment includes two sets of rigid lever arms and corresponding prime movers for moving both of shafts 111 and 131 in a parallel fashion entirely similar to that described above for apparatus 30. Although lever arms as described herein are preferably included in the embodiment 100 of FIG. 6*a* and in alternative embodiments to embodiment 100, the invention includes any suitable other engagement adjustment device for controllably adjusting the engagements in nips 105 and 115, either separately or simultaneously.

Preferably, the prime mover 126 is a piezoelectric actuator 126 applied to each of lever arms 125, each piezoelectric actuator supported or attached to a rigid frame portion of the electrostatographic machine, with actuation provided by a voltage to the actuator from a programmable power supply as controlled by the LCU (not illustrated). In order to compensate in real time for differential overdrive associated for example with slightly out-of-round precision rollers 110, 120 and 130 for which the runout is for example typically of the order of 0.001 inch or less, an AC voltage signal may be applied to the piezoelectric actuators in order to dampen or null out fluctuations of engagement, i.e., fluctuations from a nominal or mean value of engagement associated with nips 105 and 115, thereby producing a net speed ratio between roller 110 and web 140 which has a much reduced or a negligible variation over short periods of time, e.g., on a time scale of revolution of one of the rollers. A frequency of the required AC voltage signal is typically of the order of less than about 100 Hz, and the piezoelectric actuators are provided with a correspondingly suitable frequency of response as may be necessary. It may be useful to employ an auxiliary device such as for example a piezoelectric sensor or a transducer to sense mechanical displacements or pressure changes associated with differential overdrive caused by runout. Fluctuating displacements or pressure changes in nips 105 and 115 are converted by the auxiliary device to a time varying voltage signal which is sent to the LCU and thereby used, in feedback mode, to actuate nulling or damping response movements to be applied to lever arms 125 by the piezoelectric activators so as to smooth out speed ratio fluctuations associated with the runout. The auxiliary sensor may be conveniently located, for example, between one of the bearings 122 and a corresponding lever arm 125, i.e., sandwiched between them such that a sensing area of the piezoelectric sensor abuts the bearing, the sensor securely attached to both bearing 122 and the lever arm 125 (not illustrated).

Figure 6B:
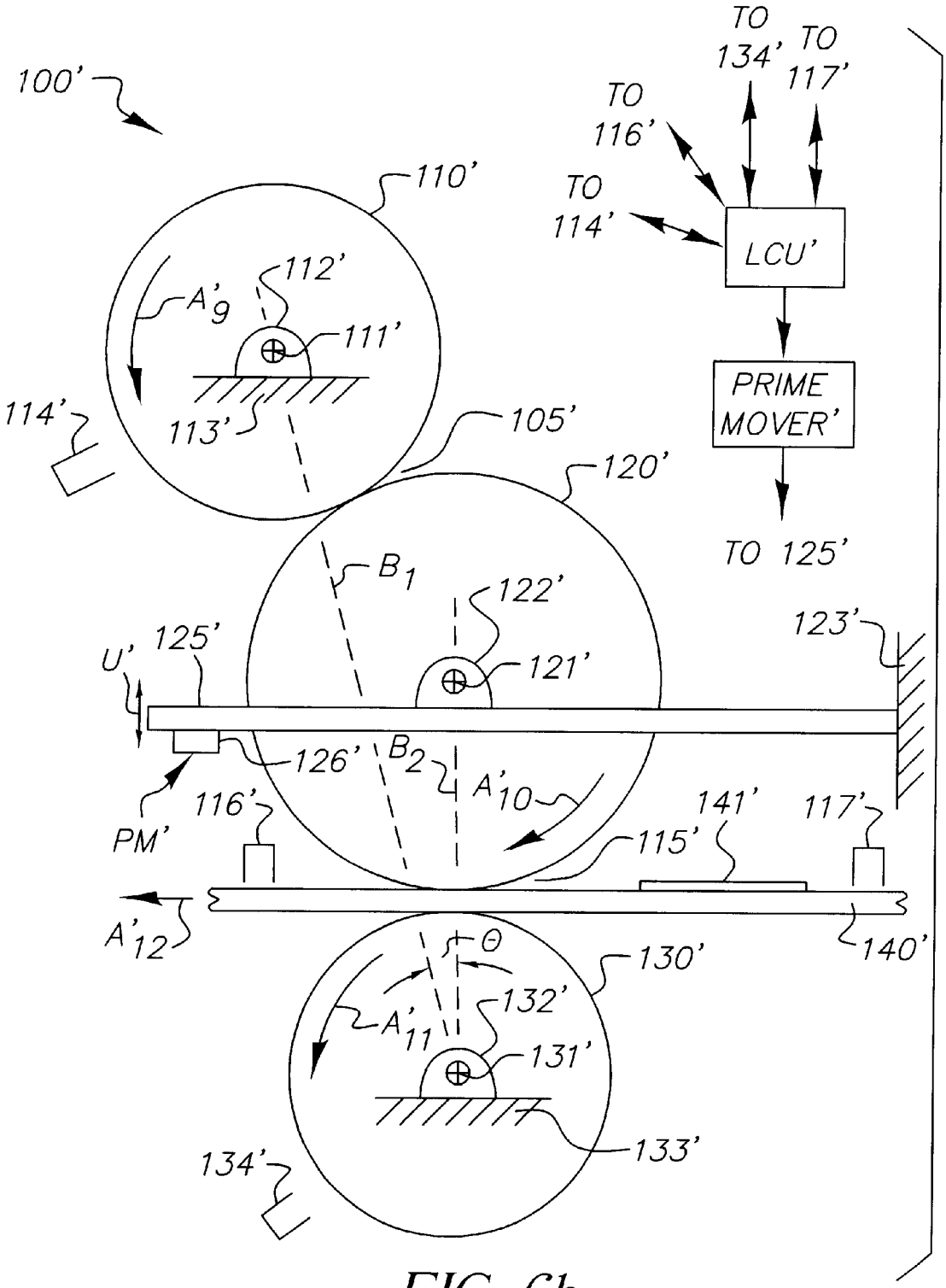
FIG. 6*b* is a schematic side elevational view an alternative to the embodiment of the invention shown in FIG. 6*a;*

FIG. 6*b* shows an alternative embodiment to the above embodiment, designated as 100', wherein single primed (') entities are in all respects similar to those of embodiment 100. Apparatus 100' differs from apparatus 100 in that shafts 111', 121' and 131' are mutually parallel but not coplanar. Shafts 111' and 131' are fixed while shaft 121' is moved by an engagement adjustment device (EAD) to simultaneously adjust the engagements in nips 105' and 115'. Dashed lines subtending an angle θ and labeled $B_1$ and $B_2$ respectively connect shafts 111' and 131' and shafts 121' and 131', the lines $B_1$ and $B_2$ being perpendicular to shafts 111', 121' and 131'. When movable shaft 121' is moved by an EAD along line $B_2$ towards fixed shaft 131', an increase of engagement in nip 115' has a magnitude greater than the accompanying decrease of engagement in nip 105'. Similarly, when movable shaft 121' is moved by an EAD along line $B_2$ away from fixed shaft 131', a decrease of engagement in nip 115' has a magnitude greater than the accompanying increase of engagement in nip 105'. In other words, a motion of shaft 121' along $B_2$ produces a larger displacement in nip 115' than in nip 105', and this difference in displacement is determined by the magnitude of the angle θ. The larger is θ, the greater the difference in displacement. A suitable magnitude of θ will be determined by various factors, for example including the mechanical properties and dimensions of rollers 110', 120' and 130' or constrained by space limitations in a machine. Apart from the fact that rollers 110', 121' and 131' are not coplanar and that the directions of motion of adjustments to engagement in nips 105' and 115' are not parallel, the primed entities of embodiment 100' are otherwise employed entirely similarly to the corresponding entities of embodiment 100, including the associated EADs and prime movers. A preferred EAD includes lever arms 125', although any suitable EAD may be used as is appropriate. A preferred prime mover for lever arms 125' is a piezoelectric actuator 126' as described herein for embodiment 100, preferably used in conjunction with an auxiliary piezoelectric sensor or transducer as described for embodiment 100 in order to suppress effects of differential overdrive.

Another alternative to embodiment 100' not including lever arms 125' includes a fixed shaft 121' and movable shafts 111' and 131', with engagements in nips 105' and 115' being adjustable in a manner described above by one or more EADs, either jointly or separately.

Figure 6C:
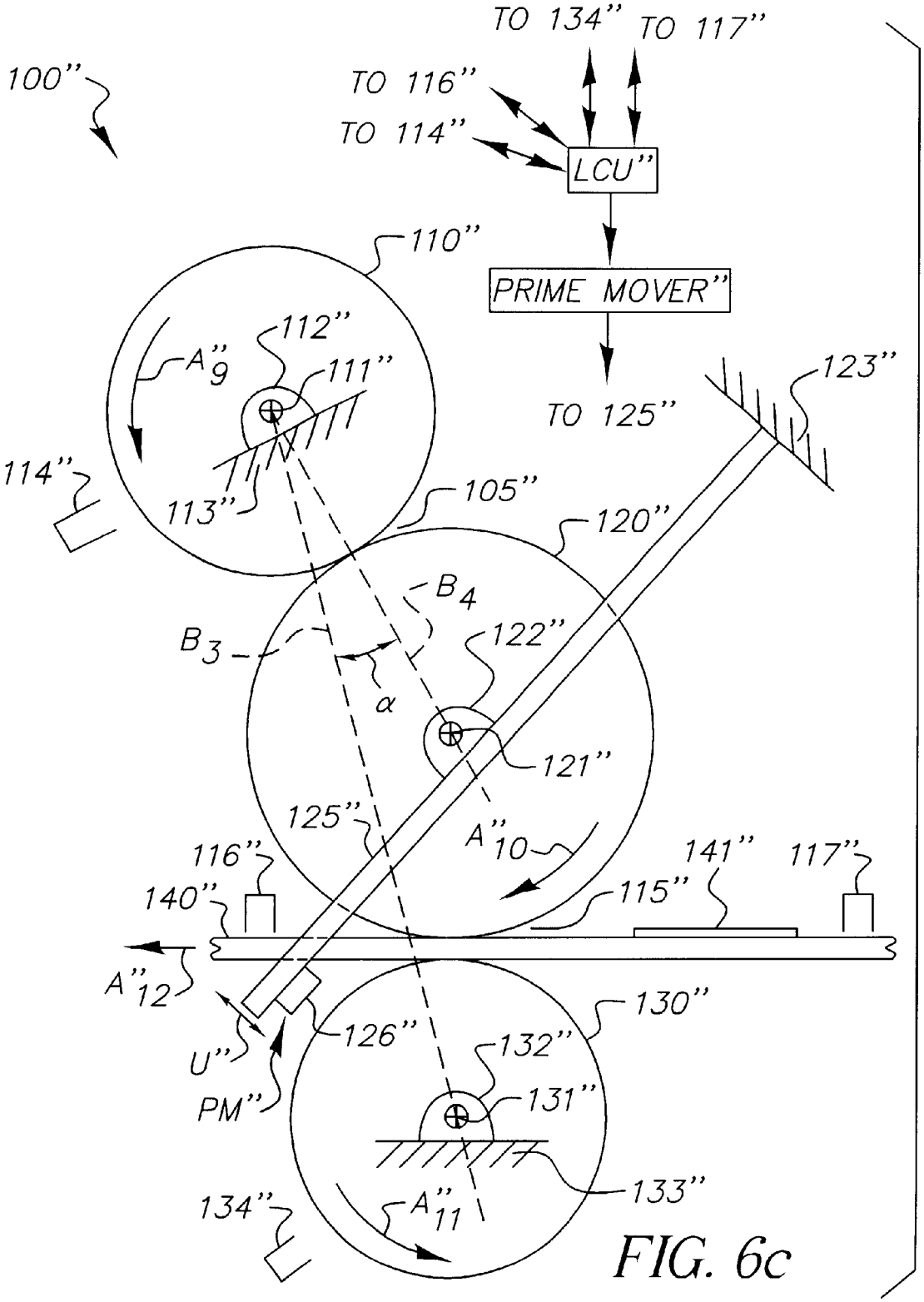
FIG. 6*c* is a schematic side elevational view of another alternative to the embodiment of the invention shown in FIG. 6*a;*

FIG. 6*c* shows another alternative embodiment to the embodiment immediately above, designated as 100", wherein double primed (") entities are in all respects similar to those of embodiment 100. Apparatus 100" differs from apparatus 100 in that shafts 111", 121" and 131" are mutually parallel but not coplanar. Shafts 111" and 131" are fixed while shaft 121" is moved by an engagement adjustment device (EAD) to simultaneously adjust the engagements in nips 105" and 115". Dashed lines subtending an angle $\alpha$ and labeled $B_3$ and $B_4$ respectively connect shafts 111" and 131" and shafts 121" and 131" the lines $B_3$ and $B_4$ being perpendicular to shafts 111", 121" and 131". When movable shaft 121" is moved by an EAD along line $B_4$ towards fixed shaft 111", an increase of engagement in nip 105" has a magnitude greater than the accompanying decrease of engagement in nip 115". Similarly, when movable shaft 121" is moved by an EAD along line $B_4$ away from fixed shaft 111", a decrease of engagement in nip 105" has a magnitude greater than the accompanying increase of engagement in nip 115". In other words, a motion of shaft 121" along $B_4$ produces a larger displacement in nip 115" than in nip 105", and this difference in displacement is determined by the magnitude of the angle $\alpha$. The larger is $\alpha$, the greater the difference in displacement. A suitable magnitude of $\alpha$ will be determined by various factors, for example including the mechanical properties and dimensions of rollers 110", 120" and 130" or constrained by space limitations in a machine. Apart from the fact that rollers 110", 121" and 131" are not coplanar and that the directions of motion of adjustments to engagement in nips 105" and 115" are not parallel, the double primed entities of embodiment 100" are otherwise employed entirely similarly to the corresponding entities of embodiment 100, including the associated EADs and prime movers. A preferred EAD includes lever arms 125", although any suitable EAD may be used as is appropriate. A preferred prime mover for lever arms 125" is a piezoelectric actuator 126" as described herein for embodiment 100, preferably used in conjunction with an auxiliary piezoelectric sensor or transducer as described for embodiment 100 in order to suppress effects of differential overdrive.

Figure 2A:
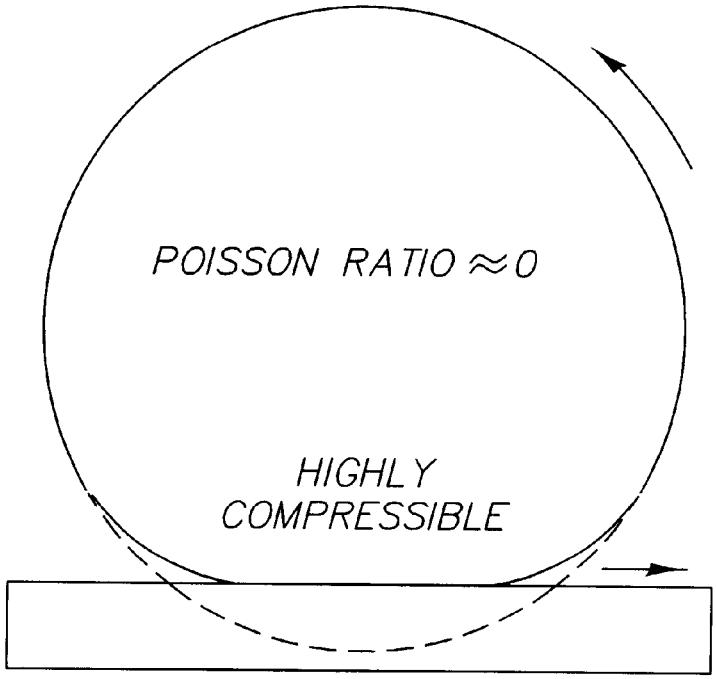
FIGS. 2*a* and 2*b* are respective schematic illustrations each of a rotating elastomeric roller in engagement with a rigid planar element for the cases respectively of a highly compressible elastomeric roller material such as a foam material and an incompressible elastomeric roller material, wherein the incompressible elastomeric material substantially retains an equal volume between strained and unstrained states.
Figure 2B:
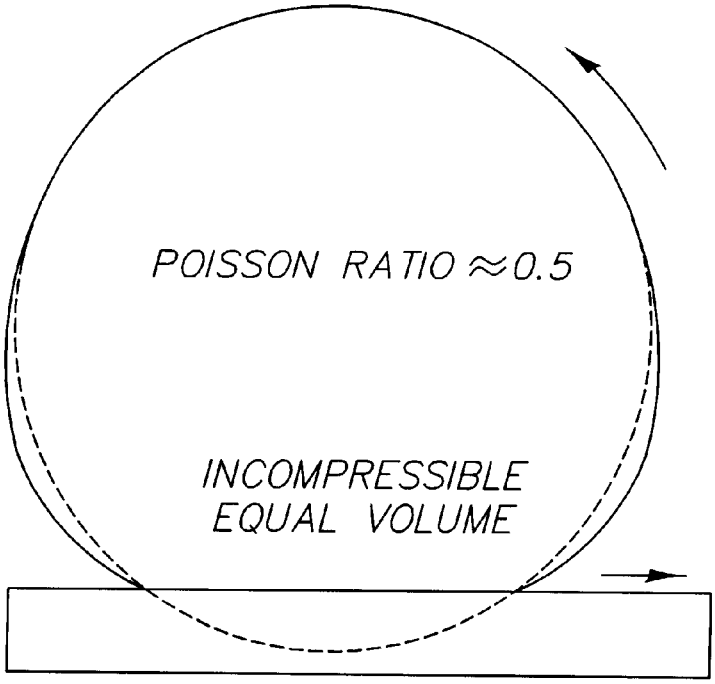
Figure 2C:
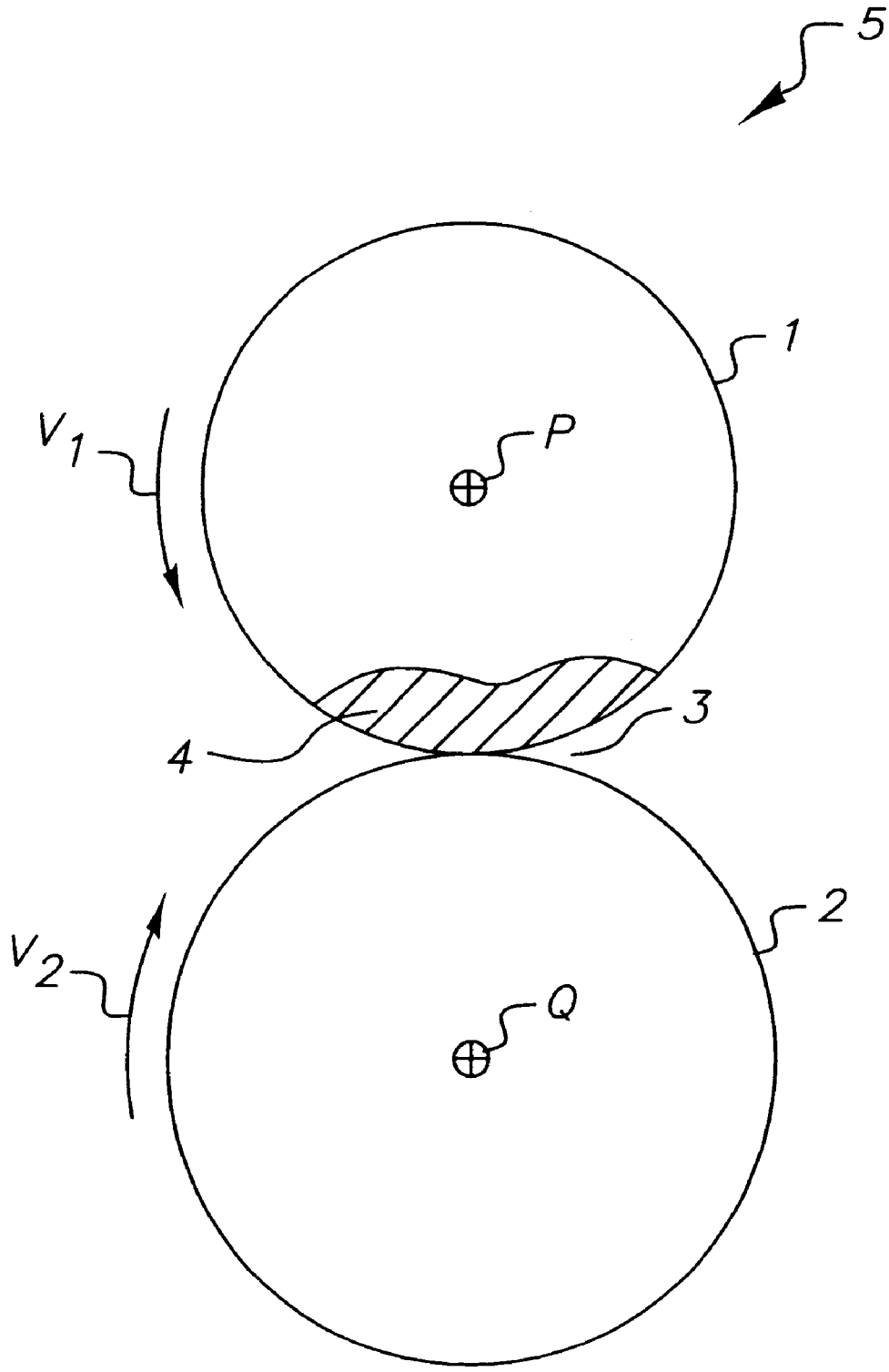
FIG. 2*c* schematically illustrates a conformable roller in nip engagement with a counter-rotating hard roller.
Figure 7:
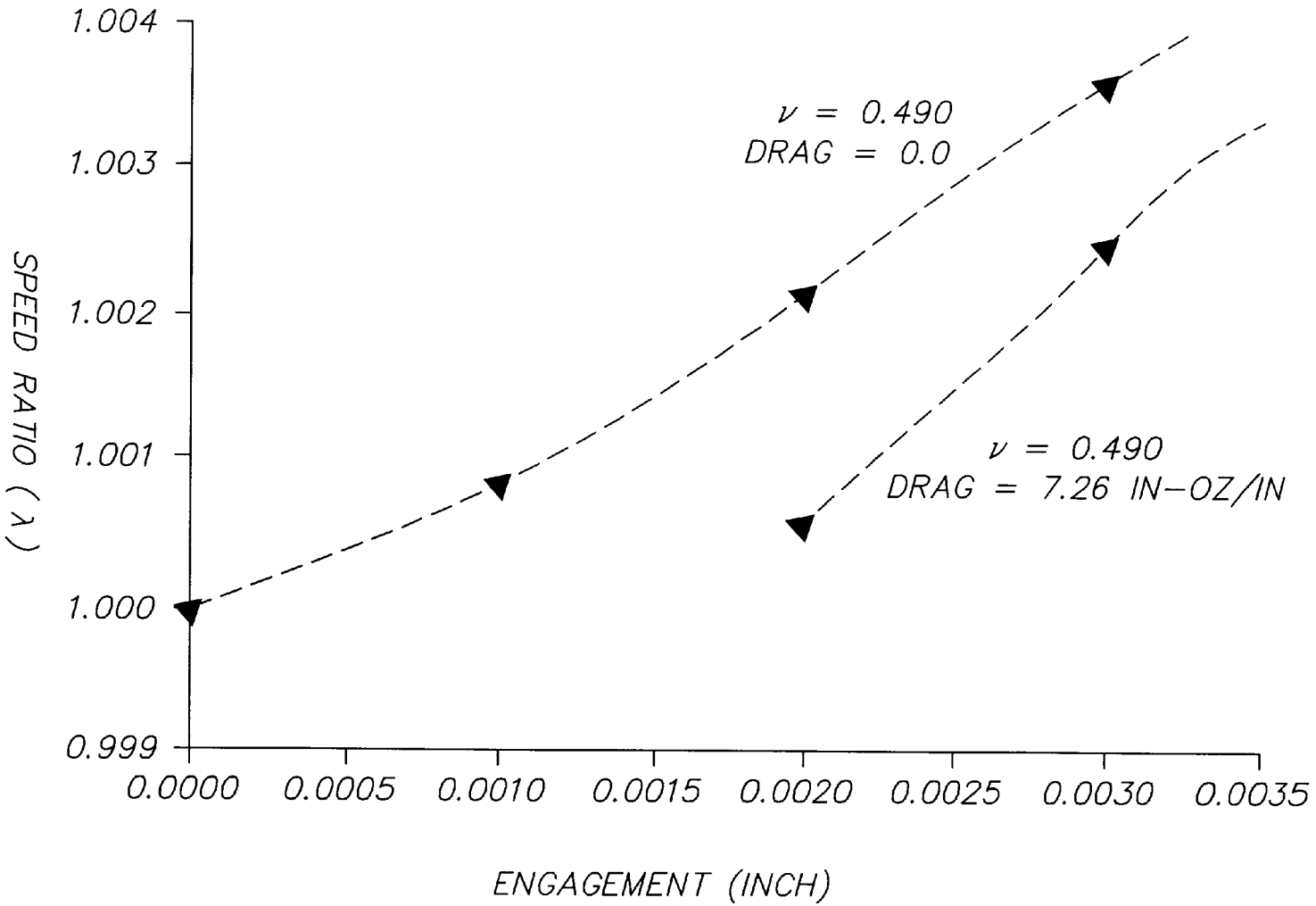
FIG. 7 is a graph illustrating speed ratio (related to overdrive) vs. engagement for a compliant intermediate transfer roller against a rigid plate.

FIG. 7 shows a computer simulated rolling behavior of a compliant elastomeric intermediate transfer roller suitable for use in an electrophotographic engine as a function of engagement. This simulation was performed using a geometry equivalent to that shown in FIG. 2*b* considering the case of driving of a rigid plate on a frictionless support. Speed ratio, i.e., the ratio of the speed of the plate divided by the peripheral speed of the roller far from the nip is on the ordinate, and engagement on the abscissa. For purpose of illustration the roller includes a rigid cylindrical core 339 mm in diameter and a 6 mm thick blanket layer surrounding the core, the blanket layer being for all practical purposes incompressible with a Poisson ratio $\nu$ equal to 0.490. It may be seen that for zero drag the plate is overdriven by the roller for all engagements, and the sensitivity of the speed ratio to engagement is similar to the slope of the upper line of FIG. 3*c*. On the other hand, for a constant drag force equivalent to a retarding torque on the roller shaft of 7.26 inch-ounces per inch along the roller, the curve is displaced and a smaller engagement is required to produce the same speed ratio. In practical systems, drag is always present to a greater or a lesser extent, such as for example drags produced by development stations and cleaning stations. A typical value of drag has been chosen in FIG. 7 to show that speed ratios of 1.000 can be obtained for geometries of practical interest by adjusting the engagement when drag forces are present. Moreover, when drag forces or torques are present in embodiments 30, 100, 100' and 100", the drag typically affects both nips similarly, i.e., a reduced magnitude of an overdrive in one nip caused for example by a retarding drag is effectively balanced by a reduced magnitude of an overdrive in the other nip. As a result, when drag forces or torques are present, it is generally possible to eliminate overdrive or underdrive by simultaneously increasing the engagement in one of the transfer nips and decreasing the engagement in the other nip, as shown for the zero drag cases illustrated in FIGS. 3*c,d,e*.

FIG. 8 shows a preferred modular color electrophotographic reproduction apparatus 200 including a plurality of modules of the type shown and described for the embodiments of FIG. 6*a,b,c*, each module of which is independently provided with a preferred engagement adjustment device (EAD) including lever arms as described above for FIG. 6*a,b,c*. Use of the EADs according to the invention solves a problem of overdrive or underdrive which varies module-to-module, e.g., because of random (typically small) variations in as-manufactured roller dimensions or variations in mechanical characteristics of individual imaging rollers or conformable intermediate transfer member rollers.

The apparatus designated as 200 shown in FIG. 8 is a full color electrophotographic printing press or apparatus and includes a plurality of electrophotographic modules working in parallel. The apparatus has some similarity to that described in T. Tombs et al., U.S. Pat. No. 6,075,965 the content of which is incorporated herein by reference. Each electrophotographic module 201, 301, 401 and 501 produces a different color image and all operate simultaneously to construct a four-color image. For example, the colors in order from left to right may be black, cyan, magenta and yellow. Although four modules are showing, more or fewer modules may be used. With regard to image module 201, there are shown various devices for creating a toner image on the primary image forming member (PIFM) 221 and similar devices are also associated with the PIFMs 321, 421 and 521 but not illustrated. A primary charger 202 applies a uniform electrostatic primary charge to the photoconductive member 221 which is in the form of a drum or roller. An LED, laser or other suitable imaging source 203 which may even be an image projection device, image-wise modulates the electrostatic primary charge to form an electrostatic latent image on the peripheral surface of the photoconductive member 221. The latent image on the photoconductive member is developed with dry pigmented insulative toner particles by development station 204 to form a developed toner particle image and electrostatically transferred in primary toner image transfer nip 216*a* to an intermediate transfer member or roller (ITR) 210. Other modules have respective primary nips 316*a*, 416*a*, 516*a* between a respective primary image forming member (PIFM) and a respective ITR. The material characteristics and dimensions of layers included in PIFM 221 and in ITR 210, respectively, are similar in all respects to the described material characteristics and dimensions of layers included in similarly functional rollers 31 and 41 of FIG. 3*b*, respectively, and similarly for the other modules. Thus, PIFM 221 is typically relatively nonconformable. Alternatively, it may be conformable, i.e., including a compliant elastomeric layer which is for all practical purposes incompressible, or it may include a resilient foam layer. ITR 210 is preferably conformable. Preferably, it includes a compliant elastomeric layer which is for all practical purposes incompressible.

Alternatively, ITR 210 may include a resilient foam layer. However, any suitable materials and dimensions may be used for PIFM 221 and ITR 210. The developer may be a so-called single component developer wherein the carrier and toner particles are one and the same. Preferably, however, the developer includes at least two components; e.g., non-marking magnetic carrier particles and marking non-magnetic insulative toner particles. In addition, the developer can also include so-called "third component" addenda such as, for example, submicron silica particles to enhance toner transfer charge stability and developer flow properties. For high quality images, toners having relatively small particle size are preferred, such as toners that have a mean volume weighted average diameter between 2 micrometers and 9 micrometers, as can be measured by commercially available equipment such as a Coulter Multisizer. Typically, the toner particles are triboelectrically charged in the developer station and transferred through electrostatic attraction to the PIFM to develop the electrostatic latent image. An electrical power supply 213 applies a voltage, e.g. a DC electrical voltage bias of proper polarity to ITR 210 to attract the oppositely charged toner particles of the toner image to transfer to the ITR. After transfer, the surface of the rotating photoconductive member 221 is moved to a cleaning station 205 wherein any untransferred toner remnants and other debris are cleaned from the surface and the surface is prepared for reuse for forming the next image to be developed with the particular color toner associated with this module. A cleaning brush 206 or other cleaning device may be provided for ITR 210 as shown. In this embodiment, a single transport web 215 in the form of an endless belt serially transports each of the receiver members or sheets 231A, 231B, 231C and 231D through four secondary toner image transfer nips 216*b*, 316*b*, 416*b* and 516*b* formed by the ITRs 210, 310, 410 and 510, respectively of each module with respective transfer backup rollers 261, 361, 461 and 561 where each color separation image is transferred in turn to a receiver member so that each receiver member receives up to four superposed registered color images to be formed on one side thereof.

The insulative endless belt or web (IEW) 215 is preferably made of a material having a bulk electrical resistivity greater than $10^5$ ohm-cm and where electrostatic hold down of the receiver member is not employed, it is more preferred to have a bulk electrical resistivity of between $10^8$ ohm-cm and $10^{11}$ ohm-cm. Where electrostatic hold down of the receiver member is employed, it is more preferred to have the endless web or belt have a bulk resistivity of greater than $1\times10^{12}$ ohm-cm. This bulk resistivity is the resistivity of at least one layer if the belt is a multilayer article. The web material may be of any of a variety of flexible materials such as a fluorinated copolymer (such as polyvinylidene fluoride), polycarbonate, polyurethane, polyethylene terephthalate, polyimides (such as Kapton®), polyethylene napthoate, or silicone rubber. Whichever material that is used, such web material may contain an additive, such as an anti-static (e.g. metal salts) or small conductive particles (e.g. carbon), to impart the desired resistivity for the web. When materials with high resistivity are used (i.e., greater than about $10^{11}$ ohm-cm), additional corona charger(s) may be needed to discharge any residual charge remaining on the web once the receiver member has been removed. The belt may have an additional conducting layer beneath the resistive layer which is electrically biased to urge marking particle image transfer, however, it is more preferable to have an arrangement without the conducting layer and instead apply the transfer bias through either one or more of the support rollers or with a corona charger. The endless belt is relatively thin (20 micrometers to 1000 micrometers, preferably, 50 micrometers to 200 micrometers) and is flexible.

Registration of the various color images requires that a receiver member be transported through the modules in such a manner as to eliminate any propensity to wander and a toner image being transferred from an ITR in a given module must be created at a specified time. The first objective may be accomplished by electrostatic web transport whereby the receiver is held to the transport web (IEW) 215 which is a dielectric or has a layer that is a dielectric. A charger 269, such as a roller, brush or pad charger or corona charger may be used to electrostatically adhere a receiver member onto the web. The second objective of registration of the various stations' application of color images to the receiver member may be provided by various well known means such as by controlling timing of entry of the receiver member into the nip in accordance with indicia printed on the receiver member or on a transport belt wherein sensors sense the indicia and provide signals which are used to provide control of the various elements. Alternatively, control may be provided without use of indicia using a robust system for control of the speeds and/or position of the elements. Thus, suitable controls including a logic and control unit (LCU) can be provided using programmed computers and sensors including encoders which operate with same as is well known in this art.

Additionally, the objective may be accomplished by adjusting the timing of the exposure forming each of the electrostatic latent images; e.g. by using a fiducial mark laid down on a receiver in the first module or by sensing the position of an edge of a receiver at a known time as it is transported through a machine at a known speed. As an alternative to use of an electrostatic web transport, transport of a receiver through a set of modules can be accomplished using various other methods, including vacuum transport and friction rollers and/or grippers.

In the embodiment 200 of FIG. 8, each module 201, 301, 401 and 501 is of similar construction to that shown in FIGS. 6*a–c* except that as shown one transport web operates with all the modules and the receiver member is transported by the IEW from module to module. Four receiver members or sheets 231A, B, C and D are shown about to be receiving images from the different modules, it being understood as noted above that each receiver member may receive one color image from each module and that up to four color images can be received by each receiver member. Each color image may be a color separation image. The movement of the receiver member with the transport belt (IEW 215) is such that each color image transferred to the receiver member at the secondary toner image transfer nip (216*b*, 316*b*, 416*b*, 516*b*, respectively) of each module formed with the transport belt is a transfer that is registered with the previous color transfer so that a four-color image formed in the receiver member has the colors in registered superposed relationship on the receiver member. The receiver members are then transported to a fusing station 250 as is the case for all the embodiments to fuse the dry toner images to the receiving member using heat and pressure. A detack charger 218 or scraper may be used to overcome electrostatic attraction of the receiver member to the IEW such as receiver member 231E upon which one or more toner images are formed. The transport belt is reconditioned by providing charge to both surfaces by opposed corona chargers 216, 217 which neutralize charge on the surfaces of the transport belt.

In the embodiment of FIG. 8 a receiver member may be engaged at times in more than one image transfer nip and preferably is not in the fuser nip and an image transfer nip simultaneously. The path of the receiver member for serially receiving in transfer the various different color images is generally straight facilitating use with receiver members of different thickness. Support structures are provided before entrance and after exit locations of each transfer nip to engage the transport belt on the backside and alter the straight line path of the transport belt to provide for wrap of the transport belt about each respective intermediate transfer member (ITM) so that there is wrap of the transport belt of greater than 1 mm on each side of the nip. This wrap allows for reduced pre-nip and post-nip ionization. The nip is where the pressure roller contacts the backside of the web or where no roller is used where the electrical field for image transfer to a receiver sheet is substantially applied but preferably still a smaller region than the total wrap of the transport belt about the ITM. The wrap of the transport belt about the ITM also provides a path for the lead edge of the receiver member to follow the curvature of the ITM but separate from engagement with the ITM while moving along a line substantially tangential to the surface of the cylindrical ITM. Pressure of the transfer backup rollers 261, 361, 461 and 561 upon the backside of the transport belt forces the surface of the compliant ITM to conform to the contour of the receiver member during transfer. Preferably, the pressure of the backup rollers on the transport belt is 7 pounds per square inch or more and it is also preferred to have the backup rollers have a layer whose hardness is in the same range for the compliant layer of the ITM noted above. The electrical field in each nip is provided by an electrical potential provided to the ITM and the backup roller. Typical examples of electrical potential might be grounding of a conductive stripe or layer on the photoconductive member, an electrical bias of about 600 volts on the ITM and an electrical bias of about 900 volts on the backup roller. The polarity would be appropriate for urging electrostatic transfer of the charged toner particles and the various electrical potentials may be different at the different modules. In lieu of a backup roller, other means may be provided for applying the electrical field for transfer to the receiver member such as a corona charger or conductive brush or pad.

Drive to the respective modules is preferably provided from a motor M which is connected to drive roller 228, which is one of plural (two or more) rollers about which the IEW is entrained. The drive to roller 228 causes belt 215 to be preferably frictionally driven and the belt frictionally drives the backup rollers 261, 361, 461 and 561 and also the intermediate transfer rollers (ITRs) 210, 310, 410 and 510. The respective ITRs 210, 310, 410 and 510 then frictionally provide drive in the directions indicated by the arrows through respective nonslip engagement to the respective photoconductive members 221, 321, 421 and 521 so that the image bearing surfaces run synchronously for the purpose of proper registration of the various color separations that make up a completed color image.

Each module is provided with an engagement adjustment device (EAD). The EAD of each module increases an engagement in one of the primary or secondary transfer nips, and decreases the engagement in the other nip. Preferably, these adjustments are made simultaneously. For example, the engagement of transfer nip 216*a* may be increased by the action of an EAD and the engagement of transfer nip 216*b* simultaneously decreased, or vice versa. The changes of engagement produced by adjusting the two nips with the EAD is such that a net speed ratio measured between web 215 and the peripheral surface of roller 221 far away from the nip is made equal to a predetermined value, in a manner similar to that discussed above for the embodiments of FIGS. 6*a,b,c* and the simplified model relating to FIGS. 3*c,d,e*. Preferably, this predetermined value is 1.000, thereby eliminating overdrive or underdrive between roller 221 and a receiver member adhered to web 215, the receiver and web moving at the same speed. The action of the EADs of the other modules similarly provides the same predetermined speed ratio in each of the modules. It is to be understood that any suitable EAD may be employed which increases the engagement in one of the transfer nips, e.g., nip 216*a* and decreases the engagement in the other, e.g., nip 216*b*, preferably simultaneously. A substantial elimination of overdrive is preferably accomplished in each color module so that each latent image on the photoconductive elements 221, 321, 421 and 521 once developed as a toned image, can be accurately transferred with minimal distortion to ITMs 210, 310, 410, 510. The toned images are transferred sequentially to a respective receiver electrostatically attached to the transport web 215 supported by backup rollers 261, 361, 461, 561 as the receiver successively passes underneath the respective ITMs through nips 216*b*, 316*b*, 416*b*, 516*b*. The power supply 213 provides a respective electrical bias potential to each ITM 210, 310, 410 and 510 and also electrically biases the backup rollers 261, 361, 461 and 561 with a respective DC voltage of suitable polarity to electrostatically attract the respective toner on the respective ITM to the receiver sheet in the respective nip. The substantial elimination or reduction of overdrive (or underdrive) in this embodiment may be accomplished by the various mechanisms described herein.

Preferably, an engagement adjustment device (EAD) is used which includes lever arms secured fixedly to rigid frame elements, such as described above for the embodiments of FIGS. 6*a,b,c*. Module 201 includes a primary image forming member (PIFM) roller 221 forming a first transfer nip 216*a* with a conformable intermediate transfer roller (ITR) 210, and a transfer backup roller 261 forming a second transfer nip 216*b* with ITR 210. Typically, rollers 221 and 261 are relatively nonconformable or hard. However, in some applications one or both of rollers 221 and 261 may have conformability. PIFM 221 is shown rotating clockwise and is provided with a coaxial shaft 209 projecting from each end of roller 221. Shaft 209 is supported by bearings 242*a* secured to frame portions 243*a* of the electrostatographic machine. ITR 210 is shown rotating anticlockwise on a coaxial shaft 219 projecting from each end of roller 310, shaft 219 being parallel to shaft 209 and supported by bearings 242*b*. PIFM 221 is frictionally driven by ITR 210 in a nonslip condition of engagement in the first transfer nip 216*a*. Backup roller 261 is shown rotating clockwise on a coaxial shaft 229 projecting from each end of roller 261, shaft 229 being parallel to shaft 219 and supported by bearings 242*c* secured to frame portions 243*b* of the electrostatographic machine. ITR 210 is frictionally driven by the web 215 in a nonslip condition of engagement with the web in the second transfer nip 216*b*. Similarly, when a receiver sheet , e.g., receiver 231A is in nip 216*b*, the ITR 210 is frictionally driven in a nonslip condition of engagement by contact with the receiver adhered to the web. Parallel shafts 209, 219 and 229 are shown as coplanar in FIG. 8. Alternatively, shafts 209 and 219 may lie in one plane and shafts 219 and 229 in another, such as illustrated in FIGS. 6*b* and 6*c*. The preferred EAD includes lever arms indicated as 240 in module 201 which are preferably attached to bearings 242*b* and fixedly secured to frame portions 241 as previously described in other embodiments above. As also described in detail above for embodiments

50, 50', 100, 100', and 100", the ends of the lever arms 240 that are not secured to a frame portion can be moved separately or jointly by a prime mover 230, i.e., up (down) along an arc Y1 which moves shaft 219 correspondingly up (down), thereby increasing (decreasing) an engagement in nip 216*a* and simultaneously decreasing (increasing) an engagement in nip 216*b*. Movement of each shaft 219 by a prime mover, e.g., separately or jointly, maintains the parallelism with shafts 209 and 229. The prime mover(s) may include screws, cams, gears or other suitable movable mechanical members as described above, including piezoelectric devices. The magnitudes of the engagement adjustments may be set manually or through an automatic system such as a servo system which preferably includes sensors to assess the value of the adjustment needed and so change the engagement by the appropriate prime mover, e.g., through a feedback loop. In the other modules 301, 401 and 501, respective EADs preferably including lever arms 340, 440 and 540 are similarly employed through arcs Y2, Y3 and Y4 to produce speed ratios equal to the same value as for module 201, i.e., speed ratios preferably equal to 1.000. In this way, as a receiver moves through the modules all of the single color toner images transferred sequentially to the receiver to form a full color toner image will be in excellent registration.

In an alternative embodiment to embodiment 200 (not illustrated) the axis of roller 210 is the fixed axis, i.e., with bearings 242*b* fixedly secured to a frame portion and the separations between shafts 209 and 219 and between shafts 219 and 229 being adjustable, separately or jointly, by an engagement device (EAD). In this alternative embodiment, lever arms 240 are not used. Instead, the EAD is provided with one or more appropriate prime movers for moving the respective shafts of one or both rollers 209 and 229 in order to alter the engagements in nips 216*a* and 216*b*, keeping all of the roller shafts of the module parallel throughout. Preferably, both of the separations between shafts 209 and 219 and shafts 219 and 229 are simultaneously adjusted by respective prime movers. Actuation of a prime mover may be accomplished by appropriate mechanical coupling to a suitable drive mechanism, either via a manually activated drive or via a motor drive, as previously described above for other embodiments. In the alternative embodiment it is further preferred that when an engagement in nip 216*a* is increased, the engagement in nip 216*b* is decreased, or vice versa. Also, in this alternative embodiment to embodiment 200, a preferred EAD for adjusting the engagement of each of nips 216*a* and 216*b* includes rigid lever arms (not shown) fixedly secured to rigid frame portions (not shown) and corresponding prime movers for moving both of shafts 209 and 229 preferably simultaneously and in a parallel fashion entirely similar to that described above for apparatus 30. In this alternative embodiment, engagements of the corresponding primary and secondary transfer nips in the other modules 301, 401 and 501 are similarly controlled by similar engagement adjustment devices for adjusting the locations of the shafts of the imaging and backup rollers while keeping unchanged the locations of the shafts of the corresponding intermediate transfer rollers.

A logic and control unit (LCU) may be employed to control the motion of a prime mover of an engagement adjustment device (EAD) used to adjust an engagement in nips 216*a* and 216*b* of module 201, and similarly for the other modules. In a preferred method, fiducial marks or indicia preferably in the form of identically spaced parallel fine lines or bars are provided, e.g., on roller 221. These lines or bars are preferably parallel to shaft 209, and preferably have a predetermined center-to center distance which is known precisely. The fiducial marks may be included as permanent markings of, or in, the outer layer of roller 221 may be placed for example near one edge of the roller, i.e., outside of the toner image area. Alternatively, fiducial marks such as in the form of fine markings or rulings may be provided on wheels secured coaxially to shaft 209. As roller 221 rotates, a sensor 251 situated far from the distorted pressure nip 216*a* senses the passage of the fine lines or rulings moving past the sensor and sends signals to the LCU which the LCU decodes as an angular velocity, so that if the radius of roller 221 is accurately known the peripheral speed of the roller may be calculated with accuracy. This calculated peripheral speed is then compared in the LCU to the known speed of web 215, whereupon a prime mover for an EAD is actuated by suitable signals sent from the LCU to the prime mover, e.g., to move lever arms 240 of module 210. If desired or necessary, similar fine lines or bars having a known spatial frequency may be provided on the outer (upper) surface of web 215, and signals sent to the LCU produced by passage of these lines past a sensor 252 may similarly be converted by the LCU into a speed which is compared in the LCU with the speed determined from the angular velocity of roller 221. Preferred prime movers for lever arms 240, 340, 440 and 540 are piezoelectric actuators (not shown) such as described herein for embodiment 100, preferably used in conjunction with auxiliary piezoelectric sensors or transducers as described for embodiment 100 in order to suppress effects of differential overdrive in each of the modules.

Alternatively, fiducial marks on the surface of roller 31 may be provided in the form of a toner test image, such as for example an electrophotographically created set of parallel equi-spaced toned bars or lines having directions perpendicular to the direction of rotation of roller 221. These toned bars or lines on the surface of roller 221 are sensed by a sensor 251 as they move past the sensor and corresponding signals are sent from sensor 36 to the LCU, the number of bars or lines passing the sensor in unit time being equal to a frequency j which is stored in the LCU. The toner bar test image is transferred to intermediate transfer roller 210 via nip 216*a* and thence from roller 210 to a receiver passing through nip 216*b*. The receiver may be a test sheet used specifically for correcting for overdrive or underdrive. As the test sheet moves past a sensor 252 a frequency, say j', of passage of the toned bars or lines on the receiver past the sensor is stored in the LCU from signals sent from sensor 252 to the LCU. Generally, as a result of overdrive or underdrive in nip 216*b*, the frequencies j and j' will not be the same. An adjustment of the engagements in both nips 216*a* and 216*b* is provided via lever arms 240 such that a difference between the frequencies j and j' is equal to an operational or a predetermined value stored in the LCU. This operational or predetermined value corresponds to an operational or predetermined speed ratio, e.g., of the peripheral speed of roller 221 divided by the speed of web 215, where the speed of the web is the same as that of the receiver adhered to the web. Preferably, the operational or predetermined difference (j–j') equals zero, and the operational or predetermined speed ratio is 1.000.

In color electrostatographic machine embodiment 200, modules 201, 301, 401 and 501 may each be used to make a similar set of short bars or lines, e.g., on a test receiver, with each single color set being preferably displaced, e.g., in a direction parallel to the axis of shaft 32, so that no set overlaps another, and a similar frequency measuring and comparison procedure is used in each station. After passage through the first secondary transfer nip 216*b*, the test receiver is transported by web 215 through the other secondary nips 316*b*, 416*b* and 516*b*. Alternatively, frequency j' and the corresponding frequencies of the other test images transferred to the test receiver may be sensed by one or more sensors located past the last module, e.g., between module 501 and charger 218, and the corresponding numbers of lines in the individual single color toner test patterns passing the sensor(s) per unit time are sent to the LCU so that the respective prime movers in each module may be suitably activated by signals from the LCU.

Alternatively, a toner test image formed on roller 221 and transferred to a test receiver may include a registration test pattern, e.g., a well known rosette pattern of dots similar to that typically used in color printing applications. In embodiment 200, a separate registration pattern from each color module is transferred to form a composite toner image on the test receiver sheet as it passes sequentially through the modules 201, 301, 401 and 501. The composite image on the test sheet is examined for registration, e.g., by using a loupe. If registration of one or more of the color registration pattern images with the remaining color registration pattern images is not satisfactory, then an engagement adjustment device (EAD) is used to adjust the engagement, e.g., manually, in the color station(s) corresponding to an unregistered color toner registration pattern image on the receiver, or a servo system may be used to activate the corresponding EAD. A second set of registration test pattern images is similarly formed by the modules and transferred to another test sheet and further adjustments to engagements similarly made by corresponding EADs. This procedure is repeated with subsequent test sheets until the registration is satisfactory.

When all modules have adjusted the respective engagements by suitable EADs applied separately in each module so that the speed ratios are the same in each module and preferably equal to 1.000 in all modules, it will be evident that a full color image made immediately subsequent to the test sheet passing through the machine will be in good registration. A test sheet may be utilized at any convenient time, e.g., between runs. Thereby, changes in dimensions of rollers or other members due to wear, aging, temperature changes and so forth may be compensated for in a simple way without the need for complicated adjustments to the individual image writers.

The present invention has a number of advantages in a transfer system employing any conformable roller and in particular for conventional elastomeric ITM rollers so that it can be readily implemented. The apparatus of the invention is not strongly dependent on the properties of the rollers, their detailed dimensions or friction coefficients, provided there is no gross slippage.

The invention is also applicable to an electrographic process and to other image transfer systems which employ rollers for transferring images in register to other members. The invention is also highly suited for use in other electrostatographic reproduction apparatus such as, for example, those illustrated in FIGS. 9 and 10. In the apparatus 300 of FIG. 9, a plurality of color electrophotographic modules M1, M2, M3 and M4 are provided but situated about a large rotating receiver transport roller 319. Roller 319 is of sufficient size to carry or support one or more, and preferably as shown, at least four receiver sheet members RS1, RS2, RS3, RS4 and RS5 on the periphery thereof so that a respective color image is transferred to each receiver member as the receiver members each serially move from one color module to the other with rotation of roller 319. The receiver members are moved serially from a paper supply (not shown) on to the drum or roller 319 in response to suitable timing signals from a logic and control unit (LCU) as is well known. After being fed onto roller 319, the receiver member R1 may be retained on the roller by electrostatic attraction or gripper member(s). The receiver member, say RS1, then rotates past module M1 wherein a toner image formed on intermediate transfer member or roller ITM1 is transferred to RS1 at a secondary transfer nip 315 between roller 329 (e.g., ITM1) and roller 319. Each ITM in this embodiment is formed with a conformable layer as described for the previously described embodiments herein so the problem of overdrive (or underdrive) is corrected for, as will be described. The toner image, for example black color, is first formed on primary image forming member PIFM 339 (e.g., photoconductor PC1) in a manner as described for prior embodiments and transferred to ITM1 at a primary transfer nip 309 between PC1 and ITM1, preferably using electrostatic transfer. PC1 and the other photoconductive drums may include a conformable layer. Drive is provided from a motor M. The other members are frictionally driven by the member receiving the motor drive through friction drive at each of the nips. Thus, if roller 319 receives the motor drive, each ITM is driven without slip by frictional engagement under pressure at the secondary transfer nip. In addition to the frictional drive between roller 319 and each ITM, there is a frictional drive without slip between each ITM and the respective PIFM such as PC1 at the no-slip engagement at the primary nip. Each primary and secondary nip has the members under pressure so that the ITMs each deform at each nip. Additionally, there is an engagement adjustment device (EAD) provided to each ITM.

Because of random (typically small) variations in as-manufactured roller dimensions or variations in mechanical characteristics of the rollers, e.g., individual PC rollers or conformable ITMs, a problem is presented of overdrive or underdrive which varies module-to-module. Similarly, the presence of variable amounts or coverages of toner particles on individual PC rollers or ITMs in the different modules generally results in variations of the effective radii module-to-module, with corresponding variations of overdrive or underdrive due to the varying thicknesses of the toner layers on these members. The problem may be effectively resolved by providing an engagement adjustment device (EAD) in each module that adjusts the engagements, e.g., in nips 309 and 315, to provide a predetermined net speed ratio of the peripheral speed of roller 339 measured far from nip 309 divided by the peripheral speed of roller 319, also preferably measured far from any nip with an ITM, e.g., nip 315. Similar EADs are provided modules M2, M3 and M4, respectively, to provide the same predetermined speed ratio as for module M1. Preferably, this predetermined speed ratio is equal to 1.000. An electrical bias is provided by power supply PS to the ITMs and to roller 319 to provide suitable electrical biasing for urging transfer of a respective color toner image from a respective PIFM such as photoconductive drums (PC 1–4) to a respective ITM and from the ITM to a receiver sheet to form the plural color toner image on the receiver member as the receiver member moves serially past each color module to receive respective color toner images in register. After forming the plural color toner image on the receiver member, the receiver member, e.g., RS5 is moved to a fusing station (not shown) wherein the plural color toner images formed thereon are fixed to the receiver member. The color images described herein have the colors suitably registered on the receiver member to form full process color images similar to color photographs.

The other color modules M2, M3 and M4 are similar to that described and may form toner images in, for example, cyan, magenta and yellow, respectively.

Figure 9:
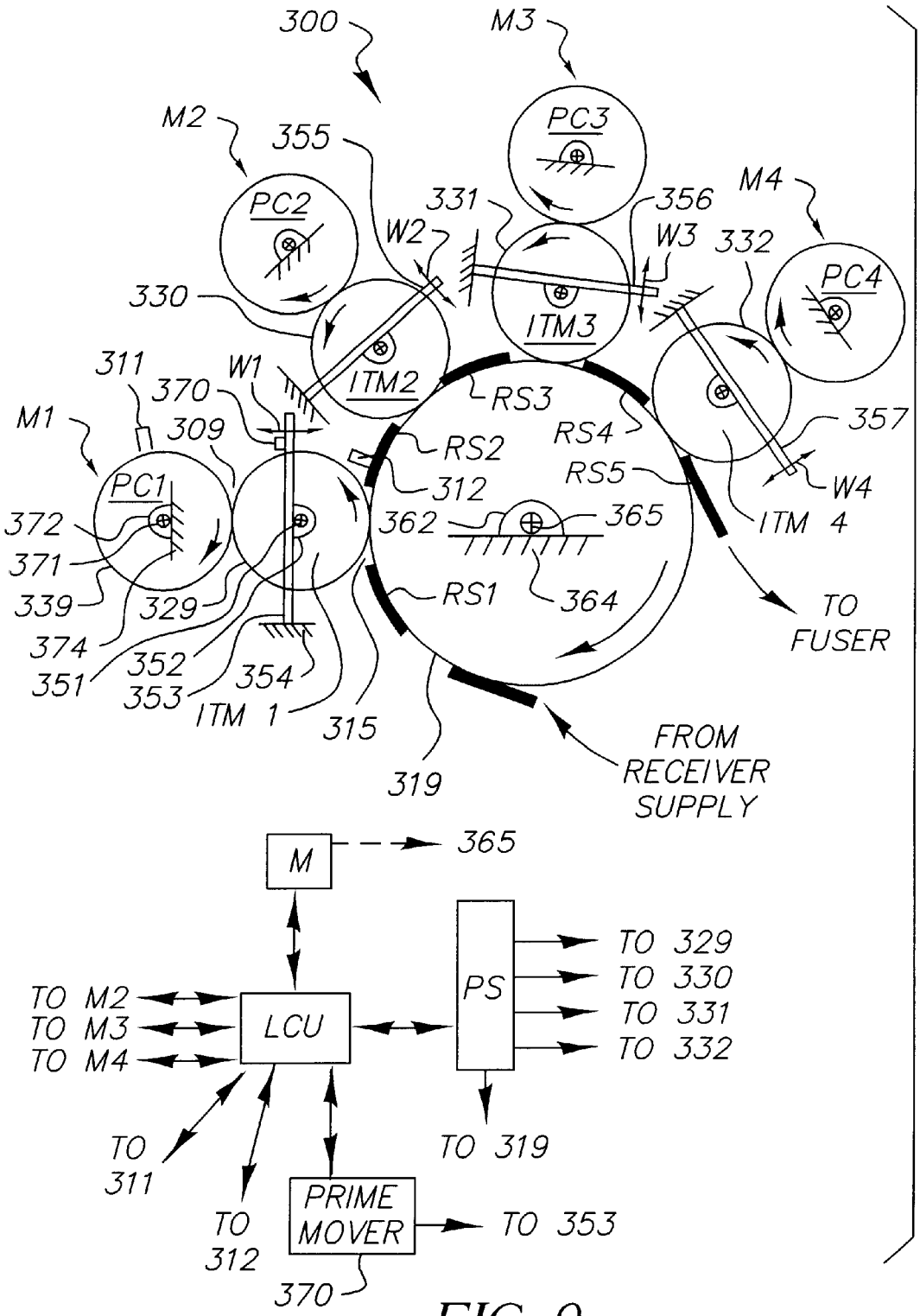
FIG. 9 is a schematic side elevational view of still another embodiment of the invention.

In a preferred embodiment, roller 319 is provided with a coaxial shaft 365 supported on bearings 362, the bearings fixedly secured to a rigid frame portion 364. Roller 339 (PC1) is provided with a coaxial shaft 371 supported on bearings 372 fixedly secured to rigid frame portions 374. An engagement adjustment device (EAD) is provided including lever arms 353 fixedly secured to rigid frame portions 354, the lever arms being also preferably attached to bearings 351 supporting a coaxial shaft 352 provided for roller 329 (ITM1). The nonfixed ends of lever arms 353 may be separately or jointly moved through an arc W1 by a suitable prime mover 370 such as described herein above. Movement of the lever arms 353 causes the engagement in one of the nips 309 and 315 to increase, and the engagement in the other nip to decrease. The shafts 351, 365 and 371 are mutually parallel before and during operation of the EAD, and may be coplanar as illustrated in FIG. 9, or alternatively the shafts may not lie in one plane, as for example shown in FIGS. 6*b* and 6*c*. A prime mover may be manually driven, or alternatively driven via a motor or by an electrical signal, as described herein above. Similar EADs are provided to the other modules M2, M3 and M4, including lever arms movable through arcs W2, W3 and W4 for respectively moving rollers 330, 331 and 332, the locations of the shafts of the photoconductive rollers PC2, PC3 and PC4 being respectively fixed.

As previously mentioned, the EAD for module M1 provides adjustments of the engagements in nips 309 and 315 such that a peripheral speed of roller 339 (PC1) far from nip 309 is the preferably the same as a peripheral speed of roller 319 far away from any nip, and similarly for the other modules. To accomplish this, individual color toner images, e.g., in the form of patterns of fine line or registration test patterns may for example be formed on photoconductive rollers PC1, PC2, PC3 and PC4 and transferred to a test receiver sheet, using the individual EADs in each module to suitably adjust the engagements in ways similar to the methods previously described, e.g., for embodiments 30, 100 and 200.

Alternatively, a sensor 311 may be employed to sense fiducial marks, e.g., parallel line markings provided or formed on roller 339 or on a wheel secured coaxially to shaft 371. A first frequency of passage of these fiducial marks past the sensor 311 is computed by and stored in a logic and control unit (LCU) from signals sent to the LCU by sensor 311. This first frequency may be compared with a second frequency of passage past another sensor 312 of a set of lines, provided or formed on the outer surface of roller 319 or alternatively on a test receiver sheet, and the EAD of module M1 activated by the LCU to provide a predetermined difference between the first and second frequencies, in ways similar to the methods previously described, e.g., for embodiments 30, 100 and 200.

Preferred prime movers 370 for lever arms 353 are preferably piezoelectric actuators such as described herein for embodiment 100, and similarly for lever arms 355, 356 and 357. The piezoelectric actuators are preferably used in conjunction with auxiliary piezoelectric sensors or transducers as described for embodiment 100 in order to suppress effects of differential overdrive in each of the modules.

Other mechanisms may also be provided as disclosed herein for adjusting the engagements of the primary and secondary transfer nips in each module of embodiment 300.

Figure 10:
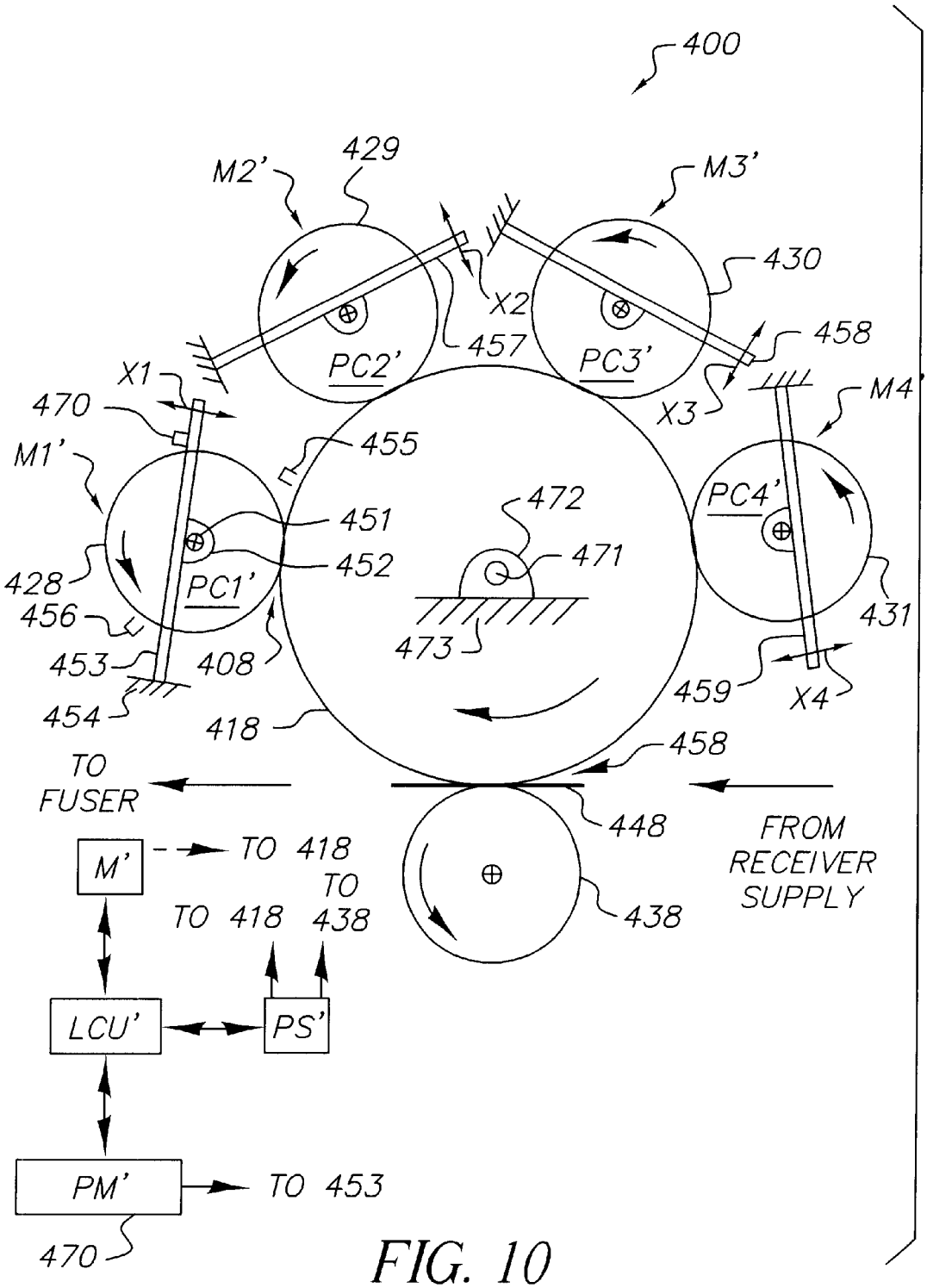
FIG. 10 is a schematic side elevational view of another embodiment of the invention.

In the embodiment of FIG. 10, four-color modules M1', M2', M3', and M4' are shown in the apparatus 400 situated about a common intermediate transfer member (ITM) roller 418. Each color module is a primary image forming member (PIFM) having members associated therewith for forming a primary image on each corresponding PIFM of a respective color. Each color module preferably includes a photoconductive drum 428 (PC1'), 429 (PC2'), 430 (PC3'), 431 (PC4') and forms a respective color toner image in a similar manner as for the PIFMs described above. Preferably, the order of color toner image transfer to the ITM 418 is PC1'—yellow, PC2'—magenta, PC3'—cyan, and PC4'—black. The respective toner images formed on the respective photoconductive drums are each transferred electrostatically to the ITM 418 at a respective primary nip, e.g., nip 408, formed with the ITM under pressure and with suitable electrical biasing provided by power supply PS' to ITM 418. Each color image is sequentially transferred in register to the outer surface of the ITM to form a plural color image on the ITM. Drive from a motor drive M' is preferably provided to ITM 418 which has a conformable layer, preferably a compliant elastomeric layer. The photoconductive drums PC1'–4' may include a conformable layer. The ITM is frictionally engaged (nonslip) with the photoconductive drums PC1'–4' under pressure so that the respective nip areas of the ITM tend to distort. A receiver member 448 is fed from a suitable paper supply in timed relationship with the four-toner color toner image formed serially in registered superposed relationship on the ITM, the four-color image being transferred to the receiver member at a nip 460 formed with backup roller 438. The power supply PS' provides suitable electrical biasing to backup roller 438 to induce transfer of the plural or multicolor image to the receiver member. The receiver member is then fed to a fuser member (not shown) for fixing of the four-color image thereto. A transport belt (not shown) may be used to transport the receiver member 448 through the nip 460 wherein in the nip, the receiver member is between the ITM and the transport belt.

Overdrive (or underdrive) corrections using engagement adjustment devices (EAD's) may be provided as described herein for the previous embodiments, preferably using respective lever arms for adjusting the engagements. Thus, roller 418 is provided with a shaft 471 supported by bearings 472, the bearings being fixedly secured to frame portions 473. An EAD' is provided including lever arms 453 fixedly secured to rigid frame portions 454, the lever arms being also preferably attached to bearings 452 supporting at each end a coaxial shaft 451 provided for roller 428 (PC1'). The nonfixed ends of lever arms 453 may be separately or jointly moved through an arc X1 by a suitable prime mover (PM') 470 such as described herein above. Movement of the lever arms 453 may cause the engagement in nip 408 to increase or decrease as required. Similar respective EAD's and prime movers are provided for modules M2', M3' and M4', including lever arms 457, 458 and 459 movable through arcs X2, X3 and X4 for respectively moving the locations of rollers 429, 430 and 431, the locations of the shafts of the photoconductive rollers PC2", PC3' and PC4' being respectively fixed.

Preferred prime movers for lever arms 453 are preferably piezoelectric actuators such as described herein for embodiment 100, and similarly for lever arms 457, 458 and 459. The piezoelectric actuators are preferably used in conjunction with auxiliary piezoelectric sensors or transducers as described for embodiment 100 in order to suppress effects of differential overdrive in each of the modules.

The EAD' for module M1' provides adjustment of the engagement in nip 408 such that a ratio of a peripheral speed of roller 428 (PC1') far from nip 408 divided by a speed of roller 418 far away from any nip is equal to a predetermined value, and similarly for the other modules. Inasmuch as embodiment module M1' involves only two rollers, i.e., rollers 428 and 418, it is generally not possible using an EAD' to eliminate overdrive (or underdrive) unless substantial drag forces or torques are present, such drag forces or torques being inherent to the system or applied by external mechanical means. Hence, a predetermined speed ratio is chosen which can be attained without gross slippage in nip 408. This same speed ratio is produced for each of the other nips of modules M2', M3' and M4' by the respective EAD's. To accomplish this, individual color toner images, e.g., in the form of patterns of fine line or registration test patterns may for example be formed on photoconductive rollers PC1', PC2', PC3' and PC4' and transferred to a test receiver sheet, using the individual EAD's in each module to suitably adjust the engagements, e.g., by including a use of sensors 455 and 456 and fiducial marks in conjunction with LCU' in ways similar to the methods described previously herein. A fully registered 4-color toner image on a receiver will be the result. As described above in this paragraph, inasmuch as there will generally be produced in each module the same uncompensated overdrive or underdrive associated with a speed ratio of the same magnitude in each module, this uncompensated overdrive or underdrive may be compensated for as is well known by suitably programming a programmable image writer in each module to form an electrostatic latent image of a proper length on each of photoconductive rollers PC1', PC2', PC3' and PC4'. This proper length is chosen so that when the respective color toner images are transferred to roller 418, each such toner image will be stretched (or compressed) similarly so that an undistorted full color image in registry is formed on a receiver.

Other mechanisms may also be provided as disclosed herein for adjusting the engagements of the primary and secondary transfer nips in each module of embodiment 400.

As may be seen from the description above, engagement adjustment devices of the invention are well suited to apparatus featuring several image separation printing stations that are ganged together to produce a complete electrophotographic print engine where the surface speeds of all nips are synchronized. Image damaging module-to-module variabilities of overdrives or underdrives associated with conformable frictionally driven members are drastically reduced.

The improved apparatus and method including engagement adjustment devices compensates for roller wear in terms of dimensional changes and property changes that under other circumstances such as changes in ambient conditions would change the engagement characteristics and thus the overdrive or underdrive. Corrections for random variations in manufactured thickness of a conformable layer or layers on an imaging roller or an intermediate transfer roller are provided.

In the various embodiments described above it is preferred that the conformable ITMs have a blanket layer having the characteristics described with reference to compliant elastomeric ITR 41 of FIG. 3*b* as to Young's modulus, thickness, electrical resistivity and are preferably covered with a relatively thin, hard surface or covering layer with the properties described for such layer as in ITR 41. Furthermore, as a preferred embodiment, the blanket layer or (where a hard outer covering layer covers the blanket layer) the composite blanket layer including the hard outer covering layer preferably has an operational Poisson ratio of approximately 0.45 to 0.50 measurable as described above.

In embodiments above in which fiducial marks are used in order to monitor surface speeds or angular speeds of members including rollers or other elements, the fiducial marks on a primary image forming roller, an intermediate transfer roller or a transport web may be provided to be removable and replaceable during the life of each of these members, e.g., by using an ink jet machine or other marking mechanism to apply new marks after old marks are removed.

Although intermediate transfer embodiments described above relate to intermediate transfer rollers and in particular to conformable intermediate transfer rollers, it will be appreciated that an intermediate transfer member web in the form of an endless loop having a conformable surface may be used in conjunction with an engagement adjustment device applied to the loop or another member coming into pressure contact with the web, such that the intermediate transfer web passes through a transfer pressure nip formed by a primary imaging member roller and a backup roller, in which nip a toner image previously formed on the primary imaging member is transferred to the conformable surface, the web subsequently moving through another transfer nip wherein the toner image is transferred to a receiver.

The invention has been described in detail with particular reference to certain preferred embodiments thereof, but it will be understood that variations and modifications can be effected within the spirit and scope of the invention.

What is claimed is:

1. For use in an electrostatographic machine having a plurality of rotatable members, an operational surface associated respectively with each of said plurality of rotatable members, said plurality of rotatable members including a first member having a first operational surface and a second member having a second operational surface, said plurality of rotatable members being in engagement in pressure nips involving the operational surfaces of said plurality of rotatable members, each pressure nip including an engagement between two of said rotatable members, said first member being included in one nip only, and no rotatable member being included in more than two nips, said plurality of rotatable members includes at least one roller, said at least one roller being substantially cylindrical about an axis when not engaged with another rotatable member of said plurality of rotatable members, and a member of said plurality of rotatable members being a driving member causing frictional rotation of all the other rotatable members by a nonslip frictional drive in each of said pressure nips, and an apparatus for controlling a speed ratio between certain of said rotatable members, said apparatus comprising:

at least one engagement adjustment device including at least one prime mover to controllably adjust at least one of said pressure nips, wherein said speed ratio, defined as a speed of a first surface portion included in said first operational surface divided by a speed of a second surface portion included in said second operational surface, said first and second surface portions being located where any distortions of said operational surfaces caused by said pressure nips are negligible, is made equal to a predetermined value by activating said at least one engagement adjustment device; wherein said shaft of said at least one roller is adjustable, and a shaft of another rotatable member is non-adjustable, and said at least one engagement adjustment device is activated to controllably adjust engagement in at least one of said pressure nips by adjusting said at least one adjustable shaft to change the distance of separation between said at least one adjustable shaft and said at least one non-adjustable shaft, said shafts being kept parallel to one another upon such adjustment.

2. The apparatus of claim 1 wherein said plurality of rotatable members includes at least one roller and a web having the form of an endless loop.

3. The apparatus of claim 1 wherein at least one of said rotatable members includes an elastomer.

4. The apparatus of claim 3 wherein said elastomer has a Poisson ratio in a range between approximately 0.45 and 0.50.

5. The apparatus of claim 1 wherein at least one of said rotatable members includes a resilient foam.

6. The apparatus of claim 1 wherein said at least one roller is a fusing roller for a fusing apparatus for fusing a toner image on a receiver member.

7. The apparatus of claim 1 wherein said plurality of rotatable members includes a fuser roller and a pressure roller engaged to form a fusing nip, said fuser roller being said first member and said pressure roller being said second member.

8. The apparatus of claim 7 wherein each of said fuser roller and said pressure roller includes a coaxial shaft having a first end and a second end, said shafts being mutually parallel and the ends of said shafts projecting respectively from each end of each of said fuser roller and said pressure roller, said ends of said shafts being supported by bearings, wherein said at least one engagement adjustment device is activated to controllably adjust engagement in said fusing nip by moving at least one of said shafts in order to change the distance of separation between said shafts while maintaining said shafts parallel to one another.

9. The apparatus of claim 1 wherein said at least one roller is a transfer roller for a transfer apparatus for transferring a toner image from a primary image forming member to a receiver member.

10. The apparatus of claim 1 wherein said at least one roller includes at least two rollers each having a respective longitudinally coaxial shaft having a first end and a second end, said shafts being mutually parallel and said ends of said shafts projecting respectively from each end of each of said at least two rollers, said ends of the shafts being supported by bearings.

11. The apparatus of claim 10, wherein said bearings supporting each of said non-adjustable longitudinal shafts are fixedly secured to at least one rigid frame portion of said electrostatographic machine, and further wherein said at least one engagement adjustment device includes at least two lever arms for said at least one adjustable shaft, each lever arm having two ends, one end of each lever arm being fixedly secured to a rigid frame portion of the electrostatographic machine and the other end being movable by a prime mover of said at least one engagement adjustment device, each lever arm being attached to a bearing supporting a corresponding end of each of said at least one adjustable shaft at a location part way along the length of said lever arm.

12. The apparatus of claim 10, wherein said at least one roller includes a primary image forming member (PIFM) roller having a coaxial first shaft, the PIFM being in a first pressure nip engagement in a first transfer nip with an intermediate transfer roller (ITR) having a coaxial second shaft, the ITR being in a second pressure nip engagement in a second transfer nip with a transfer backup roller (TBR) having a coaxial third shaft, each of said shafts being parallel to each other, and wherein said at least one engagement adjustment device is activated by at least one prime mover to controllably adjust said first and second pressure nip engagements by moving at least one of said adjustable shafts in a direction parallel to the other shafts in order to change a distance of separation between said first and second shafts and between said second and third shafts, thereby increasing an engagement in one of said nips and decreasing an engagement in the other of said nips.

13. The apparatus of claim 12 wherein said first shaft, second shaft and third shaft are coplanar.

14. The apparatus of claim 12, wherein said second shaft is adjustable and said first and third shafts are non-adjustable, and wherein said PIFM is said first member and said second transfer nip includes a receiver member, which receiver member is said second member, said speed ratio being adjustable to a value of substantially 1.000 by said at least one engagement adjustment device.

15. The apparatus of claim 12, wherein said second shaft is non-adjustable and said first and third shafts are adjustable, and wherein said PIFM is said first member and said second transfer nip includes a receiver member, which receiver member is said second member, said speed ratio being adjustable to a value of substantially 1.000 by said at least one engagement adjustment device.

16. The apparatus of claim 12, wherein one of said plurality of rotatable members is a transport web in the form of an endless loop, said transport web being captured in a pressure nip formed between said ITM and said TBR, and supported in tension by one or more web-supporting rollers including a driving roller.

17. The apparatus of claim 16 wherein said transport web is said second member.

18. The apparatus of claim 16 wherein a receiver member is adhered to said transport web and is transported by said transport web though said pressure nip formed between said ITM and said TBR.

19. The apparatus of claim 18 wherein said receiver member is said second member.

20. The apparatus of claim 12 wherein a receiver member is included in said pressure nip formed between said ITM and said TBR, which receiver member is said second member and said PIFM is said first member.

21. The apparatus of claim 1 wherein one of said plurality of rotatable members is an intermediate transfer web.

22. The apparatus of claim 1 wherein one of said plurality of rotatable members is a primary imaging web.

23. The apparatus of claim 1 wherein said at least one prime mover of said engagement adjustment device includes at least one of a group including screws, cams, differential screws, gears, levers, ratchets, wedges, springs, tensioning members, motors, actuators, piezoelectrics, hydraulics, and pneumatics.

24. Apparatus for controlling a speed ratio in a transfer apparatus of an electrostatographic machine including a conformable toner image bearing member (TIBM) roller having a first outer surface, and a transfer backup roller (TBR) relatively movable with respect to said TIBM, said TBR having a second outer surface, associated with said TIBM so as to establish a pressure-generated transfer nip between said TIBM and said TBR, wherein said first outer surface deforms in the nip, one of said TIBM and said TBR being rotated about a first axis of rotation, thereby frictionally rotating the other of said TIBM and said TBR about a second axis of rotation in a nonslip condition of engagement in said nip, comprising:

an engagement adjustment device enabling engagement in said pressure-generated transfer nip to be controllably adjusted for relocating one of said first axis and said second axis keeping both axes mutually parallel, in order to change, to a predetermined difference, any difference in speeds between a speed of a first portion of said first outer surface and a speed of a second portion of said second outer surface, said first and second portions being situated away from said pressure-generated transfer nip and located where any distortions caused by said pressure-generated transfer nip are negligible.

25. Apparatus for controlling a speed ratio in a transfer apparatus of an electrostatographic machine including a conformable toner image bearing member (TIBM) roller rotatable about a first axis of rotation and having a first outer surface, a transfer backup roller (TBR) relatively movable with respect to said TIBM, said TBR rotatable about a second axis of rotation parallel to said first axis, said TBR associated with said TIBM so as to establish a pressure-generated transfer nip, wherein said first outer surface deforms in said pressure-generated transfer nip, and a transport web, captured in said pressure-generated transfer nip between said TIBM and said TBR, for transporting through said transfer nip a receiver member, having a second outer surface, adhered to said transport web wherein when said transport web is moved through said pressure-generated transfer nip, frictionally causes said TBR and said TIBM to rotate in a nonslip condition of engagement, comprising:

an engagement adjustment device enabling engagement in said pressure-generated transfer nip to be controllably adjusted by relocating one of said first axis and said second axis and keeping both axes mutually parallel in order to change, to a predetermined difference, any difference in speeds between a speed of a first portion of said first outer surface and a speed of a second portion of said second outer surface, the first and second portions being situated away from said pressure-generated transfer nip and located where any distortions caused by the nip are negligible.

26. In an apparatus having a plurality of image forming modules wherein a plurality of toner images are transferred in register to a receiver member, each module respectively including a rotating generally cylindrical conformable primary image forming member with a respective toner image being formed thereon, a method of controlling a magnitude of a speed ratio comprising the steps of:

advancing a receiver member serially into a respective transfer nip with each primary image forming member to transfer a respective toner image formed on each primary image forming member to said receiver member, the generally cylindrical primary image forming member of each module deforming in response to pressure in the respective nip and being in a substantially nonslip condition of engagement with the receiver member in the respective nip; and in each module, adjusting engagement in the respective transfer nip to control, to a same predetermined value in each module, a ratio of a peripheral speed of each respective primary image forming member far from the respective transfer nip, divided by a speed of the receiver in the respective transfer nip.

27. In an apparatus having a plurality of image forming modules wherein a plurality of toner images are transferred in register to a receiver member, each module respectively including a primary image forming member and a rotating generally cylindrical conformable intermediate transfer member, respective toner images being formed on each primary image forming member and respectively transferred to each intermediate transfer member in a respective first transfer nip, a method of controlling a magnitude of a speed ratio comprising the steps of:

advancing a receiver member serially into a respective second transfer nip with each intermediate transfer member to transfer a respective toner image from each intermediate transfer member to said receiver member, the generally cylindrical intermediate transfer member of each module deforming in response to pressure in the respective second transfer nip and being in a substantially nonslip condition of engagement with the receiver member in the respective second transfer nip; and in each module, adjusting engagement in at least one of the first and second respective transfer nips to control, to a same predetermined value in each module, a ratio of a peripheral speed of each respective intermediate transfer member far from the respective transfer nip, divided by a speed of the receiver in the respective transfer nip, said predetermined value including substantially 1.000.

28. Included in an electrostatographic machine, an apparatus for use in controlling a frictional drive, the apparatus comprising:

a system of frictionally driven rotatable members including rotating rollers, said rotatable members including at least one conformable member, the rotatable members having respective operational surfaces, the rotational members engaged to establish pressure nips, no rotatable member being engaged in more than two nips, and the rotations of said driven rollers being produced by a driving element which may be a member in frictional driving relation to one of the driven rotatable members; and wherein one of said frictionally driven rotatable members and said driving element is a specified one of said rotatable members, said apparatus including an engagement adjustment device for controllably adjusting at least one engagement of a pressure nip between certain of said rotatable members in order to control a speed ratio to a predetermined value, said speed ratio being a speed of the operational surface of said specified one of said rotatable members far from any nip divided by a speed far from any nip of the operational surface of a member which is not said specified one of said rotatable members.

29. The apparatus according to claim 28 wherein two or more pressure nip engagements are adjusted by said engagement adjustment device, and said speed ratio includes substantially 1.000.

30. The apparatus according to claim 28 wherein said system of rotatable members is included in a toner fusing station of an electrostatographic machine.

31. The apparatus according to claim 28 wherein said system of rotatable members is included in a toner transfer station of an electrostatographic machine.

32. The apparatus according to claim 31 wherein said system includes at least two rollers each comprising a coaxial shaft having a first end and a second end, said shafts being mutually parallel and the ends of the shafts projecting from each end of each of said at least two rollers, said ends of the shafts being supported by bearings.

33. The apparatus according to claim 32, wherein at least one of said shafts being an adjustable shaft and at least one of said shafts being a non-adjustable shaft, said engagement adjustment device being activated by at least one prime mover to controllably adjust engagement in at least one of said nips by relocating an axis of said at least one adjustable shaft to change at least one distance of separation between said shafts, said shafts being kept parallel to one another during the adjustment.

34. The apparatus according to claim 33, wherein said bearings supporting each said adjustable shaft being fixedly secured to at least one rigid frame portion of said electrostatographic machine, and wherein said engagement adjusting device comprises at least two lever arms for said adjusting, each lever arm having two ends, one end of each lever arm being fixedly secured to a rigid frame portion of the electrostatographic machine and the other end being movable by a prime mover, each lever arm being attached at a location part way along the length of the lever arm to a bearing supporting a corresponding end of each of said adjustable shafts.

35. The apparatus according to claim 34 wherein said engagement adjustment device includes at least one of a group including screws, cams, differential screws, gears, levers, ratchets, wedges, springs, tensioning members, motors, actuators, piezoelectrics, hydraulics, and pneumatics.

36. The apparatus according to claim 34 wherein said prime mover includes a piezoelectric actuator activated by a voltage controlled by a programmable power supply.

37. The apparatus according to claim 36 wherein said piezoelectric actuator is used in conjunction with an auxiliary piezoelectric sensor to sense a pressure change produced by a differential overdrive in at least one of said pressure nips, said piezoelectric sensor sandwiched between and attached to both said lever arm and said bearing.

38. For use in an electrostatographic machine, an apparatus for adjusting a speed difference between members of a frictionally driven system such that the speed difference is made equal to a predetermined value, said members of said frictionally driven system including a conformable member having a nip relationship with at least one other member, the speed difference adjusting apparatus comprising:

a plurality of rotatable members having respective operational surfaces, said plurality of rotatable members including a first member having a first operational surface and a second member having a second operational surface, at least one of said plurality of rotatable members being conformable;

a plurality of pressure nips being produced by engagements between said plurality of rotatable members, said first member being included in one nip only, and no rotatable member being included in more than two nips; and at least one engagement adjustment device for activation by at least one prime mover for controllably adjusting at least one said engagements for provision of said speed difference between said first operational surface and said second operational surface, which speed difference being related to locations on said first operational surface and said second operational surface far from any said nips.

39. For use in an electrostatographic machine having a plurality of rotatable members, an operational surface associated respectively with each of said plurality of rotatable members at least one of which is conformable, said plurality of rotatable members including a first member having a first operational surface and a second member having a second operational surface, said plurality of rotatable members being in engagement in pressure nips involving the operational surfaces of said plurality of rotatable members, each pressure nip including an engagement between two of said rotatable members, said first member being included in one nip only, and no rotatable member being included in more than two nips, and a member of said plurality of rotatable members being a driving member causing frictional rotation of all the other rotatable members by a nonslip frictional drive in each of said pressure nips, and an apparatus for controlling a speed ratio between certain of said rotatable members, said apparatus comprising:

at least one engagement adjustment device including at least one prime mover to controllably adjust at least one of the engagements, wherein said speed ratio, defined as a speed of a first surface portion included in said first operational surface divided by a speed of a second surface portion included in said second operational surface, said first and second surface portions being located where any distortions of said operational surfaces caused by said pressure nips are negligible, is made equal to a predetermined value by activating said at least one engagement adjustment device.

* * * * *